US009139013B2

(12) United States Patent
Nagashima et al.

(10) Patent No.: US 9,139,013 B2
(45) Date of Patent: Sep. 22, 2015

(54) CARTRIDGE AND PRINTING MATERIAL SUPPLY SYSTEM

(71) Applicant: SEIKO EPSON CORPORATION, Tokyo (JP)

(72) Inventors: Takumi Nagashima, Shiojiri (JP); Yuji Aoki, Matsumoto (JP); Yuki Takeda, Fujimino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/277,927

(22) Filed: May 15, 2014

(65) Prior Publication Data

US 2014/0340453 A1 Nov. 20, 2014

(30) Foreign Application Priority Data

May 15, 2013 (JP) ..... 2013-103008
Feb. 12, 2014 (JP) ..... 2014-024059

(51) Int. Cl.
*B41J 2/175* (2006.01)

(52) U.S. Cl.
CPC ..... *B41J 2/17523* (2013.01); *B41J 2/1752* (2013.01); *B41J 2/1753* (2013.01); *B41J 2/17513* (2013.01); *B41J 2/17553* (2013.01)

(58) Field of Classification Search
USPC ..... 347/86
See application file for complete search history.

(56) References Cited

U.S. PATENT DOCUMENTS

| | | | | |
|---|---|---|---|---|
| 2005/0151811 | A1* | 7/2005 | Shimizu et al. | 347/86 |
| 2006/0082625 | A1 | 4/2006 | Kotaki et al. | |
| 2008/0106575 | A1 | 5/2008 | Shimizu et al. | |
| 2012/0056920 | A1 | 3/2012 | Asauchi | |
| 2012/0056955 | A1* | 3/2012 | Kodama et al. | 347/86 |
| 2012/0120165 | A1 | 5/2012 | James, III et al. | |
| 2012/0249693 | A1 | 10/2012 | Mizuno | |

FOREIGN PATENT DOCUMENTS

| | | | |
|---|---|---|---|
| EP | 1719625 | A1 | 11/2006 |
| EP | 1892103 | A2 | 2/2008 |
| JP | 2008-137376 | A | 6/2008 |

* cited by examiner

*Primary Examiner* — Stephen Meier
*Assistant Examiner* — Alexander D Shenderov
(74) *Attorney, Agent, or Firm* — Stroock & Stroock & Lavan LLP

(57) ABSTRACT

A cartridge comprises: a printing material container; a printing material supplier that supplies a printing material contained in the printing material container to a printing device; a first surface and a second surface that are opposed to each other; a third surface that intersects with the first surface and the second surface; a fourth surface that is opposed to the third surface; a cartridge-side engagement structure that is provided on the third surface at a position closer to the first surface than the second surface and is configured to be engaged with a device-side engagement structure of the printing device; and contact portions that are provided in an area where both an end of the first surface proximate to the fourth surface and an end of the fourth surface proximate to the first surface are located and are configured to be in contact with the printing device. A contact surface defined by the contact portions is inclined to the fourth surface.

12 Claims, 35 Drawing Sheets

VIEW FROM F12

AT FIRST TIME

F2-F2 CROSS SECTION

AT THIRD TIME

F2-F2 CROSS SECTION

F27-F27 CROSS SECTION

CARTRIDGE AND PRINTING MATERIAL SUPPLY SYSTEM

CROSS REFERENCE TO RELATED APPLICATIONS

This application claims priority to Japanese Patent Applications No. 2013-103008 filed on May 15, 2013 and No. 2014-24059 filed on Feb. 12, 2014, the entire contents of which are incorporated by reference herein.

TECHNICAL FIELD

The present invention relates to a cartridge-related technology for containing a printing material.

BACKGROUND ART

There has been conventionally known technology using an ink cartridge that contains ink (also simply called "cartridge"), as the technology of supplying ink to a printer as one example of printing devices. The cartridge includes: a printing material container that contains ink as a printing material; and a printing material supplier that supplies ink contained in the printing material container to the printer. The cartridge is configured to be attached to and detached from the printing device.

A known structure of the cartridge has: a circuit board located on a first side face; and a cartridge-side engagement structure located on a second side face opposed to the first side face (for example, JP 2008-137376A). The circuit board has contact portions that are in contact with those of the printing device. The cartridge-side engagement structure is engaged with a device-side engagement structure provided on a cartridge holder of the printer, so as to restrict the movement of the cartridge in a direction opposite to the direction of attachment of the cartridge in a releasable manner.

SUMMARY

There may be a variety of problems in the course of attachment and detachment of the cartridge with the cartridge-side engagement structure to and from the cartridge holder. More specifically, when the cartridge is attached to the cartridge holder, an external force is applied from the cartridge holder to clamp the cartridge on their first side face and the second side face. An excessive increase of this external force may make it difficult to detach the cartridge from the cartridge holder. Unbalance of the external force for clamping the cartridge may cause the cartridge to be tilted or rotated and may thus make it difficult to detach the cartridge from the cartridge holder. Additionally, such tilt or rotation may cause a contact failure between the contact portions on the circuit board and the printing device.

In order to solve at least part of the problems described above, the invention may be implemented by the following aspects.

(1) According to one aspect of the invention, there is provided a cartridge configured to supply a printing material to a printing device. This cartridge comprises: a printing material container that is capable of containing the printing material; a printing material supplier that supplies the printing material contained in the printing material container to the printing device; a first surface and a second surface that are opposed to each other; a third surface that intersects with the first surface and the second surface; a fourth surface that is opposed to the third surface; a cartridge-side engagement structure that is provided on the third surface at a position closer to the first surface than the second surface and is configured to be engaged with a device-side engagement structure of the printing device; and contact portions that are provided in an area where both an end of the first surface proximate to the fourth surface and an end of the fourth surface proximate to the first surface are located and are configured to be in contact with the printing device. A contact surface defined by the contact portions is inclined to the fourth surface.

In the cartridge according to this aspect, the contact surface is not parallel to the fourth surface but is inclined to the fourth surface along a predefined direction. This reduces the force applied to the cartridge in a cartridge clamping direction, even when force is applied from the printing device to the cartridge by contact between the contact portions with the printing device or engagement of the cartridge-side engagement structure with the device-side engagement structure of the printing device. This accordingly enables the cartridge to be readily detached from the printing device.

(2) One embodiment of the cartridge of the above aspect may further comprise: a fifth surface that intersects with the first surface, the second surface, the third surface and the fourth surface; a sixth surface that is opposed to the fifth surface; and a plurality of terminals, each comprising one of the contact portions. The contact portions may be arranged to form at least one array in a width direction in which the fifth surface and the sixth surface are opposed to each other. The plurality of terminals may include a first terminal having a first contact portion located at a center of the array. An engagement portion which is a portion of the cartridge-side engagement structure to be engaged with the device-side engagement structure may be located on a virtual plane, the virtual plane passing through the first terminal and being perpendicular to the width direction.

In the cartridge of this embodiment, the engagement portion is located at the position on the virtual plane that passes through the first terminal and is perpendicular to the width direction. The cartridge is positioned relative to the printing device to some extent by engagement of the engagement portion with the device-side engagement structure. Locating the engagement portion on the virtual plane thus enables the plurality of terminals to be positioned relative to the printing device with high accuracy. Locating the engagement portion on the virtual plane also enables the cartridge to be clamped by the engagement portion and the first terminal on the virtual plane, thus suppressing rotation or tilt of the cartridge. This enables the cartridge to be readily detached from the printing device.

(3) In the cartridge of the above embodiment, the printing material supplier may include a supply port at one end, the supply port being located at a position on the virtual plane.

A flow tube which is a part of the printing device is inserted through the supply port into the printing material supplier. Insertion of the flow tube into the printing material supplier also positions the cartridge relative to the printing device. In the cartridge of this embodiment, locating the supply port at the position on the virtual plane enables the plurality of terminals to be positioned relative to the printing device with high accuracy. Accurate positioning of the cartridge relative to the printing device by the supply port enables the engagement portion and the first terminal located on the virtual plane to be arranged at designed positions with high accuracy. This enables the cartridge to be stably clamped by the engagement portion and the first terminal and thereby suppresses rotation or tilt of the cartridge. Suppressing the rotation or tilt of the cartridge enables the cartridge to be readily detached from the printing device.

(4) In the cartridge of the above embodiment, the first contact portion may be located at a position on the virtual plane.

In the cartridge of this embodiment, the first contact portion located at the center in the width direction among the plurality of contact portions is located on the virtual plane, so that the plurality of terminals are enabled to be positioned relative to the printing device with high accuracy. Locating the supply port at the position on the virtual plane enables the cartridge to be clamped by the engagement portion and the first contact portion on the virtual plane and thereby suppresses rotation or tilt of the cartridge. This enables the cartridge to be readily detached from the printing device.

(5) In another embodiment of the cartridge of the above aspect, the printing material supplier may include a supply port at one end, the supply port being located at a position closer to the third surface than the fourth surface.

In the cartridge of this embodiment, the supply port is located at the position closer to the third surface side than the fourth surface side. This locates the supply port at a distance from the contact portion disposed in a corner section where the first surface intersects with the fourth surface. This reduces the likelihood that the contact portions are stained with the printing material even in the event of leakage of the printing material from the supply port. This ensures the good contact between the contact portions and the printing device.

(6) In another embodiment of the cartridge of the above aspect, the third surface may have: a one-end-side face that is connected with the second surface; and an other-end-side face that is connected with the first surface and is located at a position closer to the fourth surface than the one-end-side face, and the cartridge-side engagement structure may be formed on the other-end-side face.

In the cartridge of this embodiment, the cartridge-side engagement structure is formed on the other-end-side face that is located at the position closer to the fourth surface than the one-end-side face. This allows for reduction of the first surface-side dimension of the cartridge in the direction in which the third surface and the fourth surface are opposed to each other. Reduction of the first surface-side dimension of the cartridge ensures the sufficient space in a location where the device-side engagement structure of the printing device is located. This reduces the likelihood of a contact failure between the printing device and the contact portions on a circuit board.

(7) In another embodiment of the cartridge of the above aspect, the printing device may comprise: a flow tube that is inserted into the printing material supplier; and the printing material supplier may include a supply port at one end, the supply port coming to be located above the printing material receiver in a state prior to engagement of the cartridge-side engagement structure with the device-side engagement structure.

In the cartridge of this embodiment, the supply port is located above the printing material receiver in the state prior to engagement of the cartridge-side engagement structure with the device-side engagement structure. Even in the event of leakage of the printing material from the supply port toward the third surface, this arrangement enables the printing material receiver to trap the leaked printing material. This reduces the likelihood that the cartridge-side engagement structure and the device-side engagement structure located below the supply port are stained with the printing material, while enabling the cartridge to be adequately clamped and suppressing rotation or tilt of the cartridge.

(8) In another embodiment of the cartridge of the above aspect, the printing device may comprise: a flow tube that receives the printing material; and a printing material receiver that traps the printing material, and the printing material supplier includes a supply port at one end and the third surface coming to a positional relationship where the printing material receiver is between the supply port and the third surface in a state prior to engagement of the cartridge-side engagement structure with the device-side engagement structure.

In the cartridge of this embodiment, the supply port and the third surface come to the positional relationship where the printing material receiver is between the supply port and the third surface in a state prior to engagement of the cartridge-side engagement structure with the device-side engagement structure. Even in the event of leakage of the printing material from the supply port toward the third surface, this positional relationship enables the printing material receiver to trap the leaked printing material. This reduces the likelihood that the cartridge-side engagement structure and the device-side engagement structure located below the supply port are stained with the printing material, while enabling the cartridge to be adequately clamped and suppressing rotation or tilt of the cartridge.

(9) In the cartridge of the above embodiment, the cartridge-side engagement structure may be a groove structure formed on the third surface. The cartridge-side engagement structure may comprise: a receiver portion that is extended from the first surface toward the second surface and is configured to receive the device-side engagement structure; and a guide portion that is connected with the receiver portion, is extended in a direction inclined to a direction of attachment of the cartridge in the course of attachment of the cartridge to the printing device and is configured to guide the device-side engagement structure to an engagement position where the device-side engagement structure is engaged with the cartridge-side engagement structure. The guide portion may be shorter than the printing material receiver in a direction in which the first surface and the second surface are opposed to each other.

In the cartridge of this embodiment, the guide portion is shorter than the printing material receiver. The printing material receiver can thus trap the printing material leaked from the supply port toward the third surface, at least when the device-side engagement structure is located at the guide portion. This reduces the likelihood that the cartridge-side engagement structure and the device-side engagement structure located below the supply port are stained with the printing material, while enabling the cartridge to be adequately clamped and suppressing rotation or tilt of the cartridge.

(10) An embodiment of the cartridge of the above aspect may further comprise a container main body that defines the first surface to the fourth surface and accommodates the printing material container inside thereof. The container main body may comprise: a first container body that includes the first surface but does not include the second surface; and a second container body that includes the second surface but does not include the first surface and is configured to be detachable from the first container body. The cartridge-side engagement structure may be formed on the first container body.

This arrangement suppresses a contact failure between the printing device and the contact portions on a circuit board caused by, for example, rattling of the second container body, while suppressing rotation or tilt of the cartridge.

(11) In the cartridge of the above embodiment, the first container body may have a projection protruded toward the second container body. At least part of the cartridge-side engagement structure may be formed on the projection. The projection and the second container body may have a play therebetween.

In the cartridge of this embodiment, at least part of the cartridge-side engagement structure is formed on the projection that is protruded toward the second container body, and there is some play between the projection and the second container body. This arrangement suppresses a contact failure between the printing device and the contact portions on a circuit board caused by, for example, rattling of the second container body, while suppressing rotation or tilt of the cartridge.

(12) According to another aspect of the invention, there is provided a printing material supply system including a printing device and a cartridge. The printing material supply system of this aspect comprises: the cartridge according to any of the aspect and embodiments described above; and a printing device that has a flow tube that is to be inserted into the printing material supplier. The printing device comprises: a device-side engagement structure that is to be engaged with the cartridge-side engagement structure; and a contact mechanism that is to be in contact with the contact portions.

The printing material system of this aspect enables the cartridge to be readily detached from the printing device.

The plurality of components included in each aspect of the invention described above are not all essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as a device comprises: one or more components among the plurality of components including the printing material container, the printing material supplier, the first surface, the second surface, the third surface, the fourth surface, the cartridge-side engagement structure and the contact portions. This device may include or may not include the printing material container. This device may include or may not include the printing material supplier. This device may include or may not include the first surface. This device may include or may not include the second surface. This device may include or may not include the third surface. This device may include or may not include the fourth surface. This device may include or may not include the cartridge-side engagement structure. This device may include or may not include the contact portions. This device may be provided as a cartridge or may be provided as a device other than cartridge.

The invention may be implemented by any of various aspects: for example, a cartridge, a printing material supply system, a production method of a cartridge, a production method of a printing material supply system, and a unit including a cartridge and a cartridge holder which the cartridge is removably attached to.

DESCRIPTION OF EMBODIMENTS

The following describes embodiments of the invention in the following sequence:

A, B: Embodiments

C, D: Modifications

A. First Embodiment

A-1. Configuration of Printing Material Supply System

Figure 1:
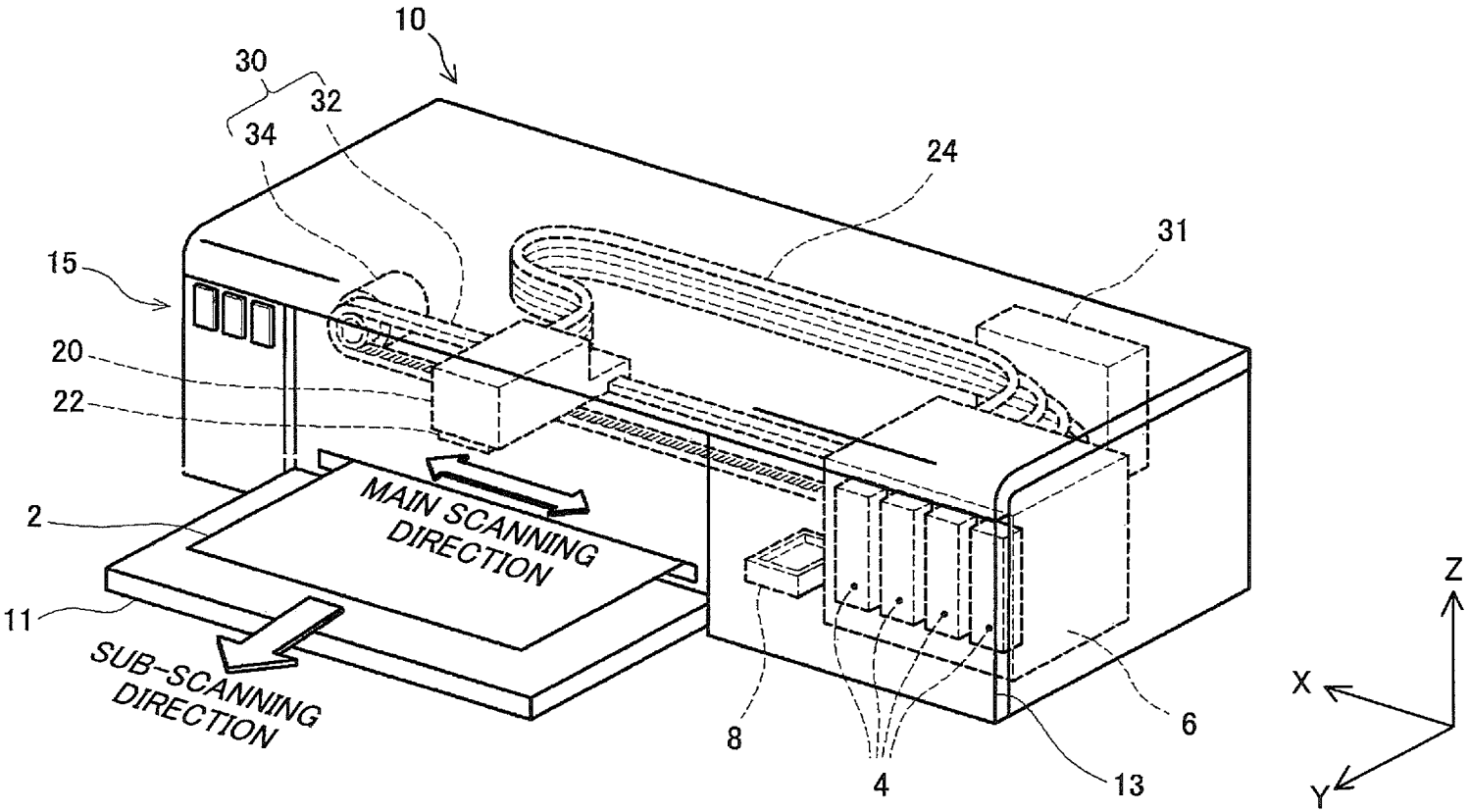
FIG. 1 is a perspective view illustrating the schematic configuration of a printing material supply system.

FIG. 1 is a perspective view illustrating the schematic configuration of a printing material supply system 1. XYZ axes orthogonal to one another are illustrated in FIG. 1 and are also given in subsequent drawings as appropriate. The XYZ axes in FIG. 1 correspond to the XYZ axes in the other drawings. The printing material supply system 1 includes a cartridge 4 and a printer 10 as a printing device. In the printing material supply system 1, the cartridge 4 is removably attached to a cartridge holder 6 of the printer 10.

The printer 10 of the embodiment is an inkjet printer that ejects ink as a printing material from a head 22. The printer 10 has a cartridge holder 6, a controller 31, a carriage 20, a head 22 and a drive mechanism 30. The printer 10 also has operation buttons 15 manipulated by the user for the operations of the printer 10.

A plurality of cartridges 4 are respectively attached removably to the cartridge holder 6. According to this embodiment, four different types of cartridges 4 corresponding to four different color inks (black, yellow, magenta and cyan), one for each, i.e., the total of four cartridges 4, are attached to the cartridge holder 6. The printer 10 of the embodiment has a cover for replacement 13 on a front surface (surface on +Y-axis direction side). When a +Z-axis direction side of the cover for replacement 13 is pulled forward (toward +Y-axis direction side), the opening of the cartridge holder 6 is made accessible to allow for attachment and detachment of the cartridges 4. When the cartridge 4 is attached to the cartridge holder 6, ink can be supplied through a tube 24 to the head 22 provided on the carriage 20. According to this embodiment, a pump mechanism (not shown) in the printer 10 serves to suck the ink in the cartridge 4 and supply the sucked ink to the head 22. The tubes 24 are provided for the respective ink types. Here the state that the cartridge 4 is attached to the cartridge holder 6 is called "state of attachment".

The head 22 has nozzles provided for each ink type. The head 22 serves to eject the ink from the ejection nozzles toward a printing sheet 2 to print data such as characters and images. The process of attaching the cartridge 4 to the cartridge holder 6 and the detailed structures of the cartridge 4 and the cartridge holder 6 will be described later. According to this embodiment, the printer 10 is a so-called "off-carriage type" printer in which the cartridge holder 6 does not move in conjunction with the move of the carriage 20. The invention is also applicable to a so-called "on-carriage type" printer in which the cartridge holder 6 is provided on the carriage 20 and moves along with the carriage 20.

The controller 31 serves to control the respective components of the printer 10 and send and receive signals to and from the cartridge 4. The carriage 20 serves to move the head 22 relative to the printing sheet 2.

The drive mechanism 30 serves to move back and forth the carriage 20 in response to control signals from the controller 31. The drive mechanism 30 includes a timing belt 32 and a drive motor 34. The power of the drive motor 34 is transmitted via the timing belt 32 to the carriage 20 to move the carriage 20 back and forth in a main scanning direction (X-axis direction). The printer 10 also has a conveyance mechanism to move the printing sheet 2 in a sub-scanning direction (+Y-axis direction). The printing sheet 2 is moved in the sub-scanning direction by the conveyance mechanism during printing, and the printing sheet 2 after printing is delivered onto a front cover 11.

An area called home position is provided at a location out of a printable area, to which the carriage 20 is moved in the main scanning direction. A maintenance mechanism for maintenance to ensure normal printing is mounted on the home position. The maintenance mechanism includes a cap member 8, a lift mechanism (not shown) and a suction pump (not shown). The cap member 8 is pressed against a nozzle-forming surface (nozzle surface) on a bottom face side of the head 22 (side facing the printing sheet 2) to define a closed space surrounding the ejection nozzles. The lift mechanism lifts up and down the cap member 8 to be pressed against the nozzle surface of the head 22. The suction pump introduces a negative pressure into the closed space defined by pressing the cap member 8 against the nozzle surface of the head 22.

According to the embodiment, in the use state of the printing material supply system 1, an axis along the sub-scanning direction in which the printing sheet 2 is conveyed is Y axis; an axis along the direction of gravity (vertical direction) is Z axis; and an axis along the moving direction of the carriage 20 (longitudinal direction) is X axis. The "use state of the printing material supply system 1" herein denotes the state that the printing material supply system 1 is placed on a horizontal plane. According to this embodiment, the sub-scanning direction (forward direction) is +Y-axis direction; and its reverse direction (backward direction) is −Y-axis direction. A direction from bottom to top in the direction of gravity (upward direction) is +Z-axis direction; and its reverse direction (downward direction) is −Z-axis direction. When the printing material supply system 1 is viewed from the front side (+Y-axis direction side), a direction from right to left is +X-axis direction; and its reverse direction is −X-axis direction. According to this embodiment, the direction of attachment of the cartridge 4 to the cartridge holder 6 is −Y-axis direction, and the direction of detachment of the cartridge 4 from the cartridge holder 6 is +Y-axis direction. The −Y-axis direction side of the cartridge holder 6 is thus called back side, and the +Y-axis direction side is called front side. According to this embodiment, the direction of array of the plurality of cartridges 4 in the cartridge holder 6 is X-axis direction.

Figure 2:
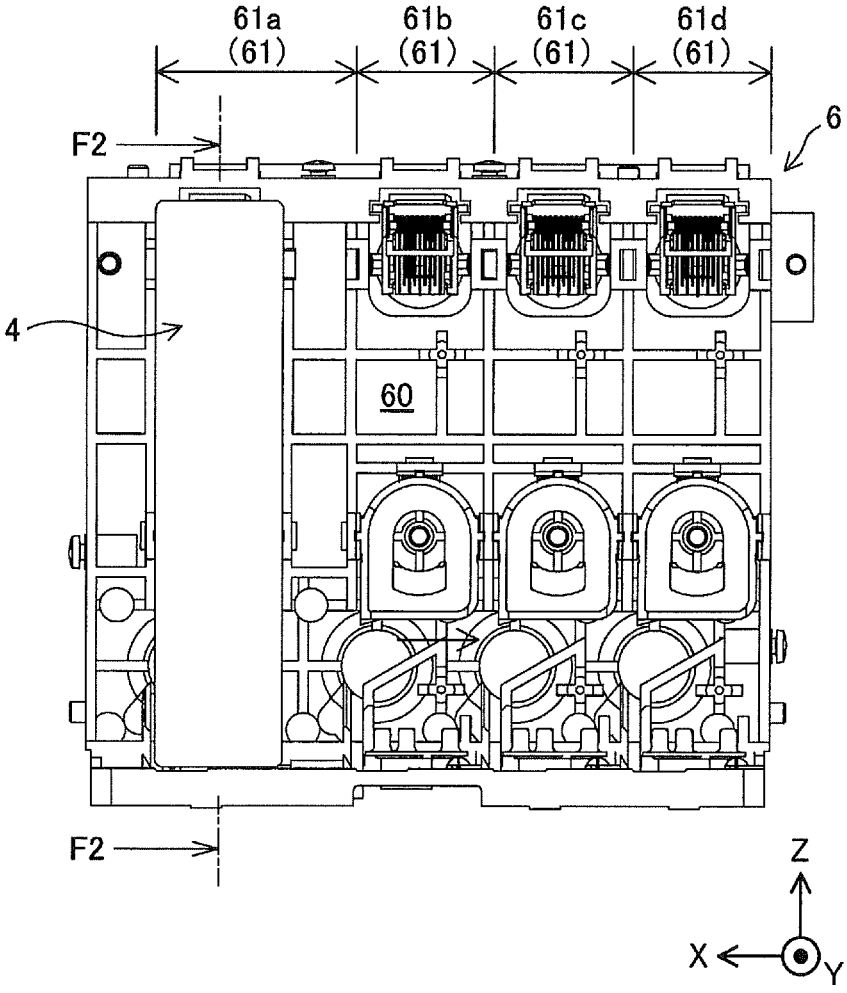
FIG. 2 is a front view of a cartridge holder in the state of attachment.

FIG. 2 is a front view of the cartridge holder 6 in the state of attachment. FIG. 2 illustrates the state that one cartridge 4 is attached to the cartridge holder 6. In the description below, the X-axis direction of the cartridge holder 6 is also called "width direction; the Z-axis direction is also called "height direction"; and the Y-axis direction is also called "length direction".

The cartridge holder 6 has a cartridge chamber 60 for accommodating the cartridges 4. Each part of the cartridge chamber 60 for accommodating one of the four cartridges 4 is called a slot 61. According to this embodiment, the cartridge holder 6 has first to fourth slots 61*a* to 61*d*. The first slot 61*a* has a greater width than those of the other slots 61*b* to 61*d*. The first slot 61*a* is enabled to accommodate a cartridge having a larger dimension in the X-axis direction than that of the cartridge 4 (called "large-capacity cartridge"), as well as the cartridge 4. The cartridge having the larger dimension in the X-axis direction is enabled to contain a greater volume of ink than that of the cartridge 4. For example, the large-capacity cartridge may be used to contain frequently-used black ink. The large-capacity cartridge and the cartridge 4 have different dimensions in the X-axis direction and contain different volumes of inks, but otherwise have the same structures.

Figure 3:
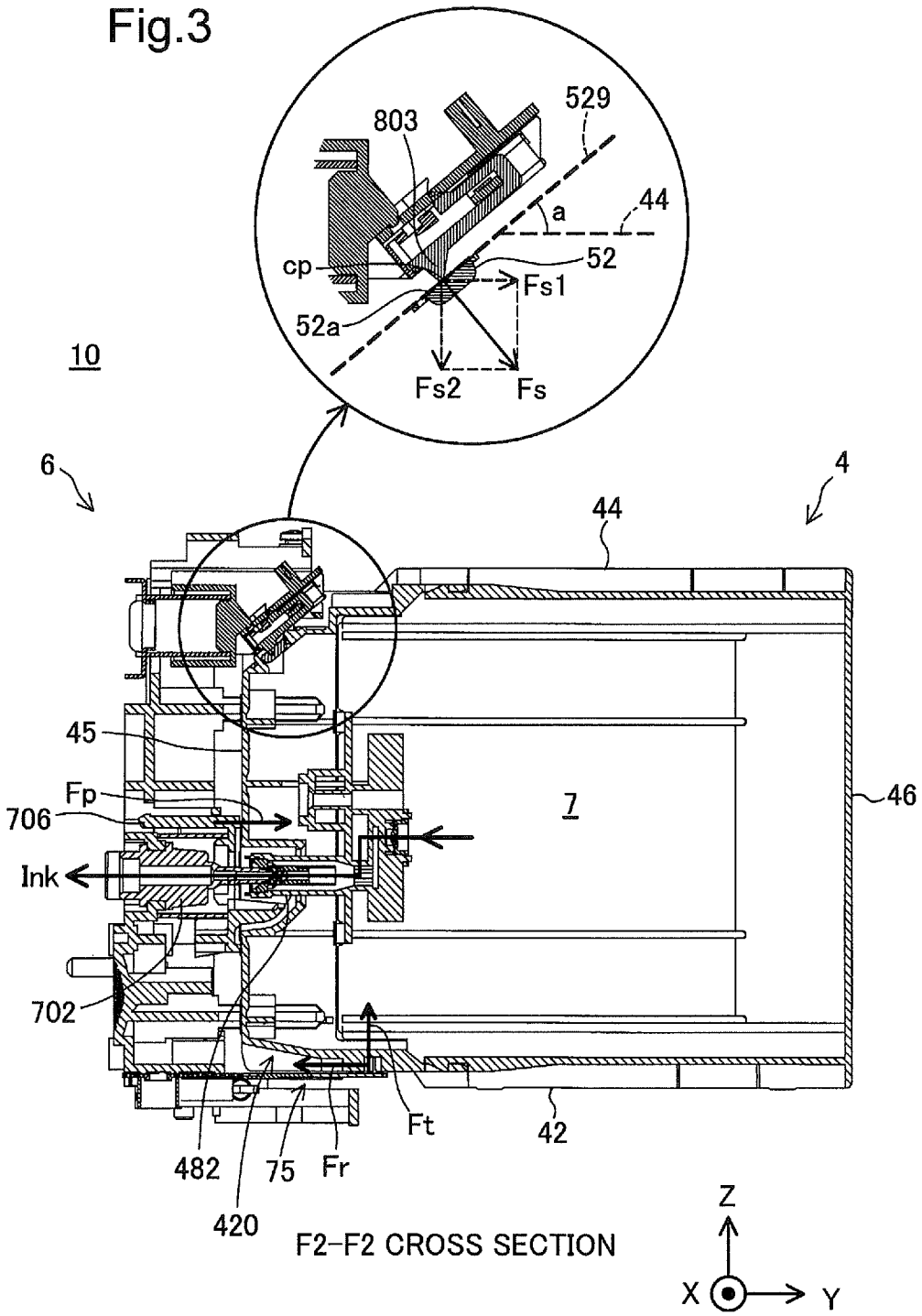
FIG. 3 is an F2-F2 cross sectional view of FIG. 2.

FIG. 3 is an F2-F2 cross sectional view of FIG. 2. FIG. 3 illustrates part of the cartridge holder 6 and the cartridge 4. After attachment of the cartridge 4 to the cartridge holder 6, a pump mechanism (not shown) is actuated to flow the ink from a printing material container 7 of the cartridge 4 to the printing device 10 as shown by an arrow. More specifically, the ink in the printing material container 7 flows from a printing material supplier 482 of the cartridge 4 to a flow tube 702 of the cartridge holder 6.

In the state that the cartridge 4 is attached to the cartridge holder 6 (in the state of attachment), a plurality of contact portions cp (only one is illustrated in FIG. 3) provided on a surface 52*a* of a circuit board 52 of the cartridge 4 are in contact with a plurality of corresponding device-side terminals 803 (only one is illustrated in FIG. 3) provided on the cartridge holder 6. A contact surface 529 defined by the plurality of contact portions cp is a plane inclined along a predefined direction. More specifically, the contact surface 529 is inclined in a direction including a +Z-axis direction component (vertically upward direction) and a −Y-axis direction component (direction of attachment). In other words, the contact surface 529 is inclined to a fourth surface 44 of the cartridge 4, such as to approach from a first surface 45 to a second surface 46 of the cartridge 4 accompanied with an approach from a third surface 42 toward the fourth surface 44. According to this embodiment, the contact surface 529 is located to be almost flush with a plane where the contact portions cp are arranged (in this embodiment, the surface 52*a* of the circuit board 52). The contact surface 529 may be inclined at an angle "a" between the fourth surface 44 which is a horizontal plane and the contact surface 529 in the range of 30 degrees to 60 degrees. According to this embodiment, the angle "a" between the fourth surface and the contact surface 529 is about 40 degrees.

In the state of attachment, a device-side engagement structure 75 provided on the cartridge holder 6 is engaged with a cartridge-side engagement structure 420 provided on the third surface 42 of the cartridge 4. Such engagement restricts the move of the cartridge 4 in the +Y-axis direction.

In the state of attachment, the cartridge 4 receives external forces Fs, Ft, Fp and Fr from the cartridge holder 6. The external force Fs is a force applied from the device-side terminals 803 to the cartridge 4. The external force Fs is set to have a predefined angle to the contact surface 529. According to this embodiment, the external force Fs is a force applied almost perpendicularly to the contact surface 529 (i.e., the surface 52*a* of the circuit board 52). The external force Ft is a force applied from the device-side engagement structure 75 to the cartridge 4. In order to ensure the good contact between the device-side terminals 803 and the contact portions cp, there is a need to press the contact portions cp by sufficiently applying the elastic force of the device-side terminals 803 to the contact portions cp. According to this embodiment, for this purpose, the external force (elastic force) applied from the device-side terminals 803 to the contact portions cp is set to be almost perpendicular to the contact surface 529.

The external force Ft is a force applied in the direction of pressing up the cartridge 4 (+Z-axis direction). More specifically, the external force Ft is a force applied almost perpendicularly to the third surface 42. In other words, the direction of the external force Ft is almost vertically upward direction. The external force Fr is a force applied from the device-side engagement structure 75 to the cartridge 4. The external force Fr is a force of pressing the cartridge 4 in the −Y-axis direction (direction of attachment). The external force Fr is produced by engagement of the device-side engagement structure 75 with the cartridge-side engagement structure 420 of the cartridge 4. The external force Fp is a force applied from a cover member 706 of the cartridge holder 6 to the cartridge 4. The external force Fp is a force applied almost perpendicularly to the first surface 45 of the cartridge 4. In other words, the external force Fp is a force of pressing the cartridge 4 in the +Y-axis direction (direction of detachment). The resultant force of the external force Fp and a force component Fs1 in the +Y-axis direction of the external force Fs is the force of moving the cartridge 4 in the +Y-axis direction. Application of the external force Ft to the cartridge 4, on the other hand, restricts the move of the cartridge 4 in the Y-axis direction.

The external force Ft and a force component Fs2 in the −Z-axis direction of the external force Fs are respectively the forces of clamping the cartridge 4. In other words, the external force Ft and the force component Fs2 are respectively the forces acting in the directions perpendicular to the direction of detachment of the cartridge 4 (+Y-axis direction). Increasing the external force Ft or the force component Fs2 makes it difficult to readily detach the cartridge 4 from the cartridge holder 6.

A-2. Detailed Structure of Cartridge Holder

Figure 4:
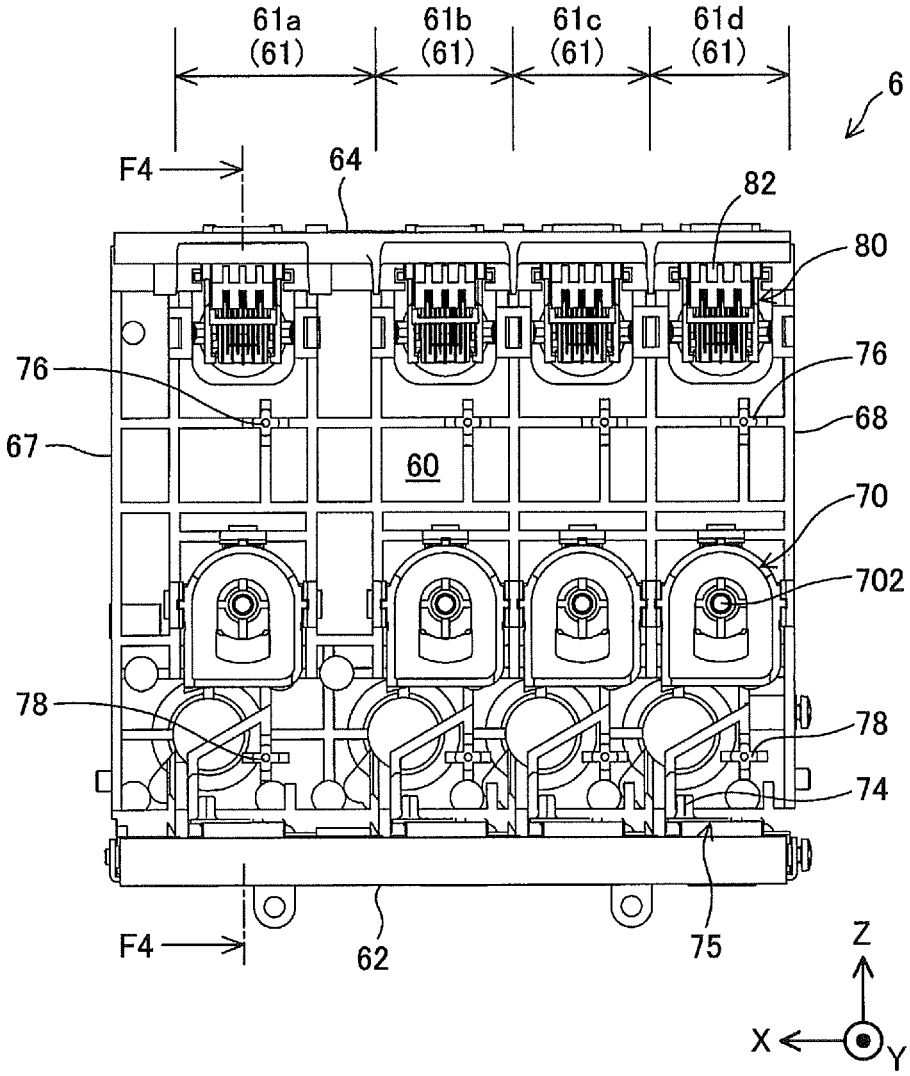
FIG. 4 is a front view of the cartridge holder.
Figure 5:
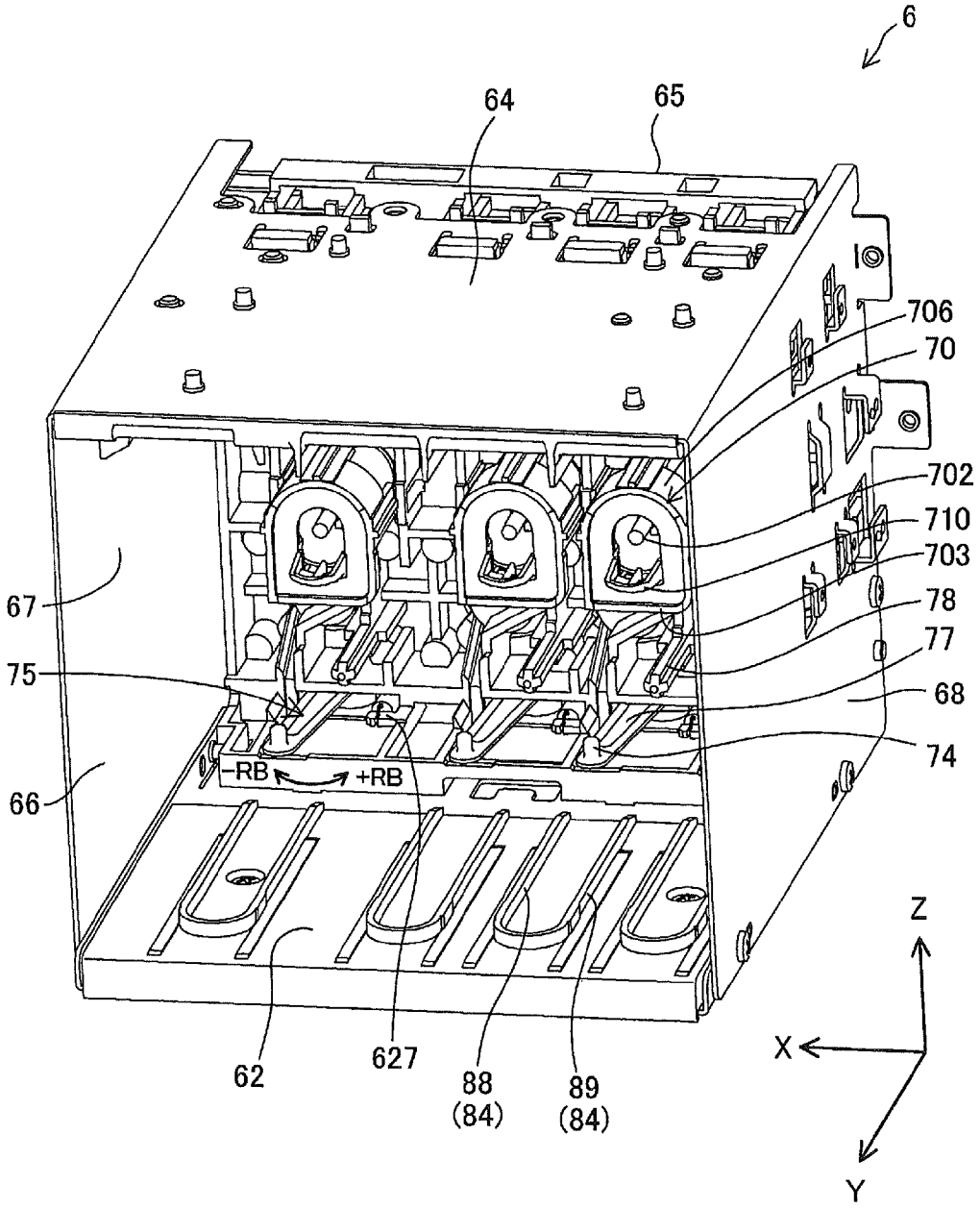
FIG. 5 is first external perspective view of the cartridge holder.
Figure 6:
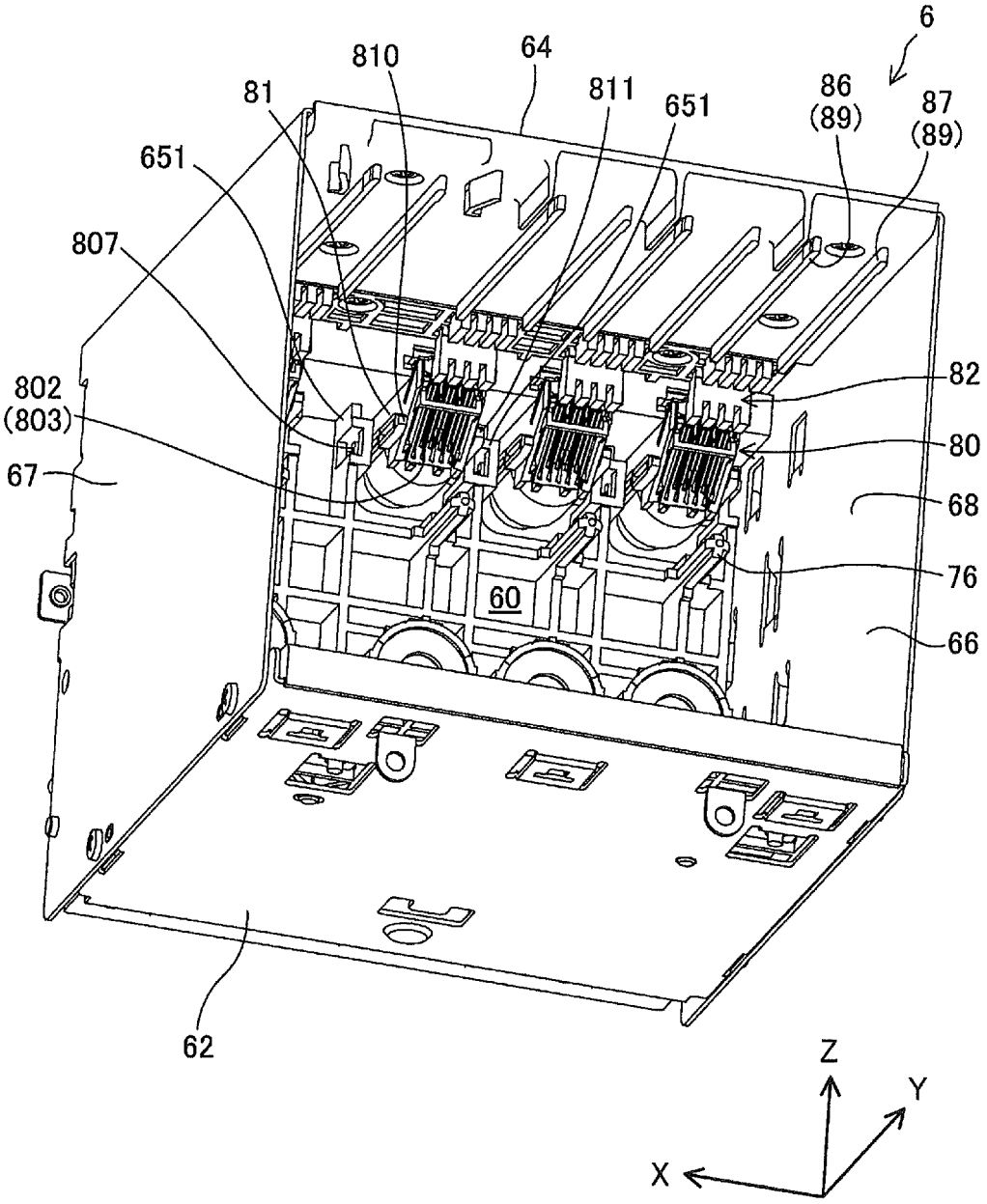
FIG. 6 is a second external perspective view of the cartridge holder.
Figure 7:
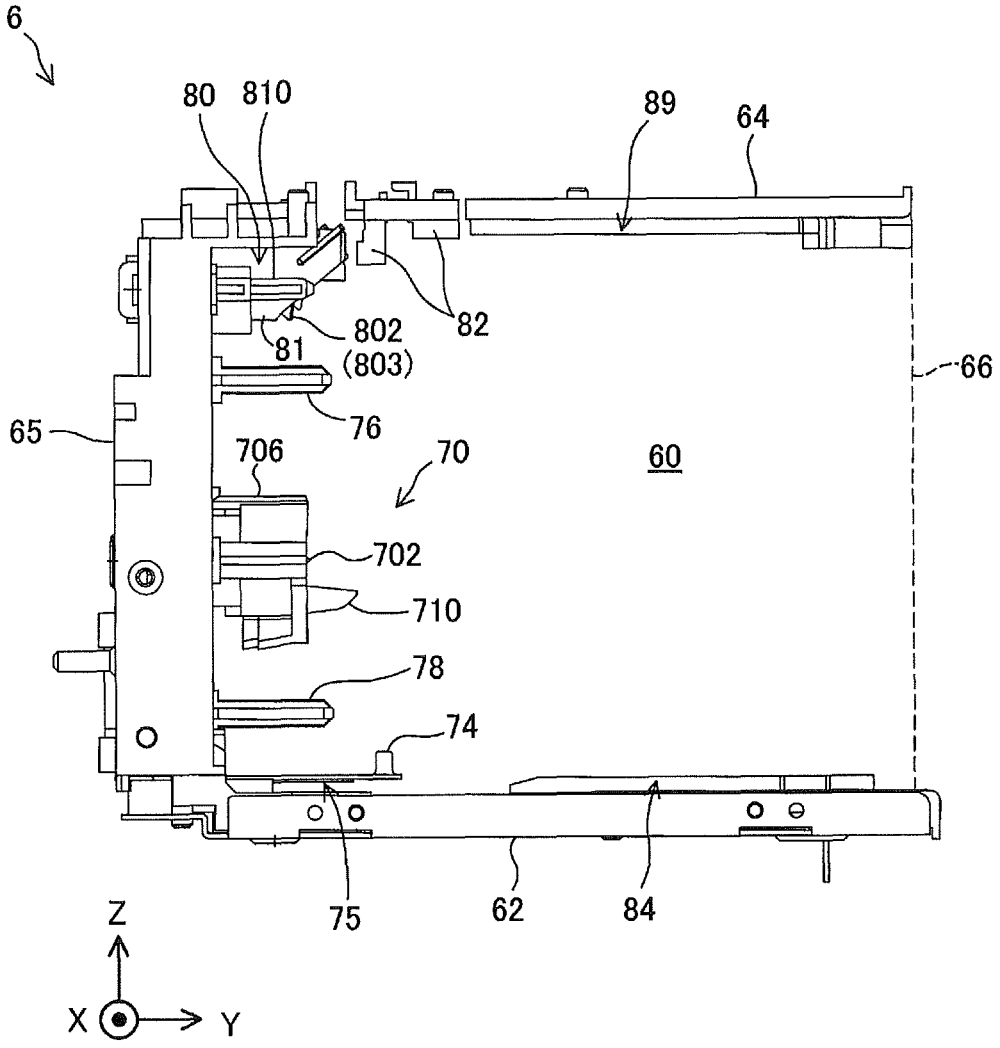
FIG. 7 is a side view of the cartridge holder.
Figure 8:
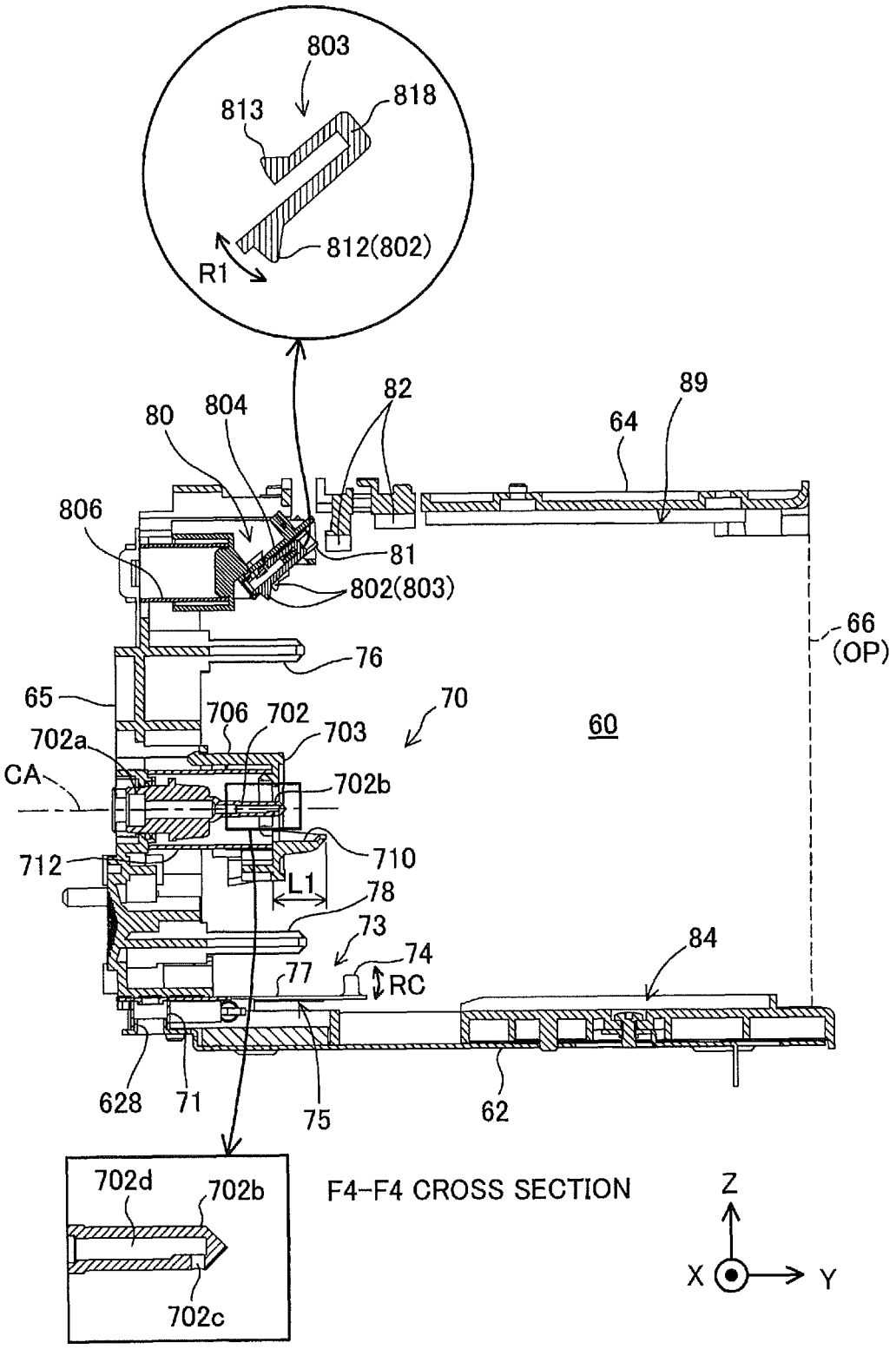
FIG. 8 is an F4-F4 cross sectional view of FIG. 4.
Figure 9:
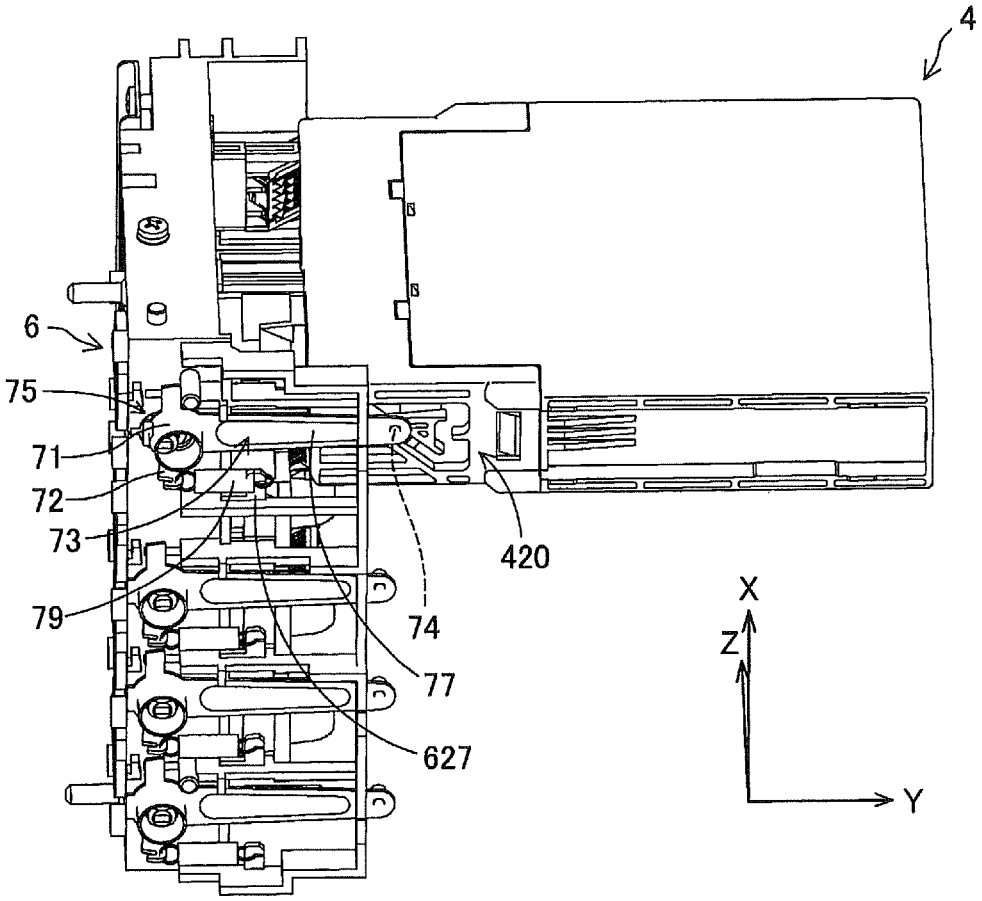
FIG. 9 is a diagram illustrating a device-side engagement structure.

The following describes the detailed structure of the cartridge holder 6 with reference to FIGS. 4 to 9. FIG. 4 is a front view of the cartridge holder 6. FIG. 5 is first external perspective view of the cartridge holder 6. FIG. 6 is a second external perspective view of the cartridge holder 6. FIG. 7 is a side view of the cartridge holder 6. FIG. 8 is an F4-F4 cross sectional view of FIG. 4. FIG. 9 is a diagram illustrating the device-side engagement structure 420. For the clarity of explanation, part of the structure of the cartridge holder 6 is omitted from the illustration of FIG. 7 to make the internal configuration of the cartridge holder 6 visible. Part of the structure of the cartridge holder 6 is also omitted from the illustration of FIG. 9 to make the configuration of the device-side engagement structure visible.

As shown in FIGS. 5 and 6, the cartridge holder 6 has six walls 62, 64, 65, 66, 67 and 68 described below. The cartridge chamber 60 is defined and formed by the six walls 62, 64, 65, 66, 67 and 68. The six walls 62, 64, 65, 66, 67 and 68 are respectively formed in almost rectangular outer shapes. The wall 65 is also called "device-side first wall 65" or "device-side rear wall 65". The wall 66 is also called "device-side second wall 66" or "device-side front wall 66". The wall 62 is also called "device-side third wall 62" or "device-side bottom wall 62". The wall 64 is also called "device-side fourth wall 64" or "device-side upper wall 64". The wall 67 is also called "device-side fifth wall 67" or "device-side first side wall 67". The wall 68 is also called "device-side sixth wall 68" or "device-side second side wall 68". Each of the walls 62, 64, 65, 66, 67 and 68 may be comprised of a single wall member or may be comprised of a plurality of wall members in combination.

As shown in FIG. 7, the device-side first wall 65 and the device-side second wall 66 are opposed to each other across the cartridge chamber 60. The device-side third wall 62 and the device-side fourth wall 64 are opposed to each other across the cartridge chamber 60. The device-side fifth wall 67 and the device-side sixth wall 68 are opposed to each other across the cartridge chamber 60. The device-side first wall 65 is located on the −Y-axis direction side of the cartridge chamber 60. The device-side second wall 66 is located on the +Y-axis direction side of the cartridge chamber 60. The device-side third wall 62 is located on the −Z-axis direction side of the cartridge chamber 60. The device-side fourth wall 64 is located on the +Z-axis direction side of the cartridge chamber 60. The device-side fifth wall 67 is located on the +X-axis direction side of the cartridge chamber 60. The device-side sixth wall 68 is located on the −X-axis direction side of the cartridge chamber 60.

As shown in FIGS. 5 and 6, the cartridge holder 6 is formed in an external of almost rectangular parallelepiped. The device-side first wall 65, the device-side second wall 66, the device-side fifth wall 67 and the device-side sixth wall 68 are almost vertical walls in the use state. The device-side third wall 62 and the device-side fourth wall 64 are almost horizontal walls in the use state.

The device-side second wall 66 has an opening OP (FIG. 8), which the cartridge 4 passes through in the course of attachment to the cartridge holder 6. The cartridge 4 is moved along the Y-axis direction for attachment or detachment of the cartridge 4. More specifically, the −Y-axis direction is the direction of attachment of the cartridge 4 to the cartridge holder 6. The +Y-axis direction is the direction of detachment of the cartridge 4 from the cartridge holder 6.

As shown in FIGS. 4 and 7, a contact mechanism 80, a flow unit 70 and first and second positioning members 76 and 78 are provided on the device-side first wall 65. The respective portions 80, 70, 76 and 78 are provided for each of the slots 61*a* to 61*d*. As shown in FIG. 4, the contact mechanism 80, the first positioning member 76, the flow unit 70 and the second positioning member 78 are arranged in this order from the side close to the device-side second wall 64. The first positioning member 76 and the second positioning member 78 are located at the positions across the flow unit 70 in the Z-axis direction.

As shown in FIGS. 6 to 8, the contact mechanism 80 includes a device-side terminal group 802, a connector base plate 804 (FIG. 8), a terminal holding member 81 and a pressing member 806 (FIG. 8). The device-side terminal group 802 is comprised of nine device-side terminals 803. As shown in FIG. 8, each of the nine device-side terminals 803 is a plate-like member and is elastically deformed. More specifically, one end 812 of the device-side terminal 803 is elastically deformed about a bent 818 in the direction of an arrow R1. The direction of the arrow R1 is a direction parallel to the Y-axis direction and the Z-axis direction. The one end 812 of the device-side terminal 803 is held by the terminal holding member 81 such as to be exposed on the surface of the terminal holding member 81. The other end 813 of the device-side terminal 803 is in contact with the connector base plate 804 to be electrically connected. The connector base plate 804 is also electrically connected with the controller 31 of the printer 10. The one end 812 of the device-side terminal 803 is in contact with a corresponding cartridge-side terminal provided on the cartridge 4 to be electrically connected in the state of attachment of the cartridge 4.

As shown in FIG. 6, the terminal holding member 81 holds the device-side terminal group 802. More specifically, the terminal holding member 81 holds the device-side terminal group 802 (more specifically, a terminal base which the device-side terminal group 802 is fixed to) to be slightly movable in the Z-axis direction and in the X-axis direction. A pair of members 810 and 811 are provided on the respective side faces in the X-axis direction of the terminal holding member 81. The pair of members 810 and 811 are columnar members extended in the Y-axis direction. The pair of members 810 and 811 are inserted into grooves formed in the vicinity of the circuit board 52 of the cartridge 4 in the course of attachment of the cartridge 4 to the cartridge holder 6. The pressing member 806 shown in FIG. 6 is a helical compression spring. The pressing member 806 presses the terminal holding member 81 in the +Y-axis direction. As shown in FIG. 6, engagement of engagement claws 807 provided on the respective side faces in the X-axis direction of the terminal holding member 81 with engagement walls 651 provided on the device-side first wall 65 restricts the move of the terminal holding member 81 in the +Y-axis direction. Application of an external force in the −Y-axis direction allows the terminal holding member 81 to move in the −Y-axis direction against the pressing force of the pressing member 806.

As described above, the device-side terminals 803 are movable in the three directions, i.e., the X-axis direction, the Y-axis direction and the Z-axis direction. Moving the device-side terminals 803 in these three directions finely adjusts the position of the device-side terminals 803 relative to the position of the cartridge-side terminals, thus ensuring the good contact between the cartridge-side terminals and the device-side terminals 803.

As shown in FIGS. 5, 6 and 8, the first positioning member 76 and the second positioning member 78 are columnar members extended in the +Y-axis direction from the device-side first wall 65. The first and the second positioning members 76 and 78 are inserted into first and second member through holes provided on the cartridge 4 as described later.

As shown in FIGS. 5 and 8, the flow unit 70 includes a flow tube 702, a cover member 706 and a pressing member 712 (FIG. 8). The flow tube 702 is inserted into the printing material supplier 482 of the cartridge 4. Such insertion connects the flow tube 702 with the printing material supplier 482 of the cartridge 4 and causes the ink in the cartridge 4 to flow through the flow tube 702 into the printing device 10. As shown in FIG. 8, the flow tube 702 internally has a flow path 702*d* of circular cross section. A connection hole 702*c* which causes the flow path 702*d* to communication with the outside is formed on the −Z-axis direction side of the circumference of the flow tube 702. The ink in the cartridge 4 flows through the connection hole 702*c* into the printing device 10. The flow tube 702 has a center axis CA, which is extended along the Y-axis direction. The flow tube 702 has a base end 702*a* located on the device-side first wall 65-side and a front end 702*b* located on the device-side second wall 66-side. The direction from the base end 702*a* toward the front end 702*b* is the +Y-axis direction.

As shown in FIG. 8, the cover member 706 surrounds part of the periphery of the flow tube 702. The cover member 706 also has a printing material receiver 710 formed in a concave shape. In the event of leakage of ink from the flow tube 702 or from the printing material supplier 482 of the cartridge 4, the printing material receiver 710 receives and thereby traps the leaked ink. The pressing member 712 is a helical compression spring. The pressing member 712 presses the cover member 706 in the +Y-axis direction. Application of an external force in the −Y-axis direction allows the cover member 706 to move in the −Y-axis direction against the pressing force of the pressing member 712. The printing material receiver 710 is located on the −Z-axis direction side of (immediately below) a printing material supply tube 642, irrespective of displacement from the state prior to attachment of the cartridge 4 to the state of attachment. More specifically, the printing material receiver 710 is located on the −Z-axis direction side of (immediately below) a connection hole 648, irrespective of the move of the cover member 706 from the state prior to attachment of the cartridge 4 to the state of attachment. Even in the event of leakage of ink from the flow tube 702, the printing material receiver 710 traps the ink and thereby reduces the likelihood of ink splash over a wide area. The printing material receiver 710 has a length L1 in the Y-axis direction, which is greater than length L2 of a guide member 606 (FIG. 19) described later.

As shown in FIGS. 6 and 8, a first rail mechanism 89 and a device-side identification member 82 are provided on the device-side fourth wall 64. The respective elements 89 and 82 are provided for each of the slots 61*a* to 61*d*. The first rail mechanism 89 guides the cartridge 4 to the position of attachment while restricting the move of the cartridge 4 in the width direction (X-axis direction) in the course of attachment of the cartridge 4 to the cartridge holder 6. As shown in FIG. 6, the first rail mechanism 89 includes a pair of rail members 86 and 87 arranged at a specified interval in the X-axis direction. The pair of rail members 86 and 87 are members protruded from the device-side fourth wall 64 toward the cartridge chamber 60 and are extended along the Y-axis direction.

Figure 10:
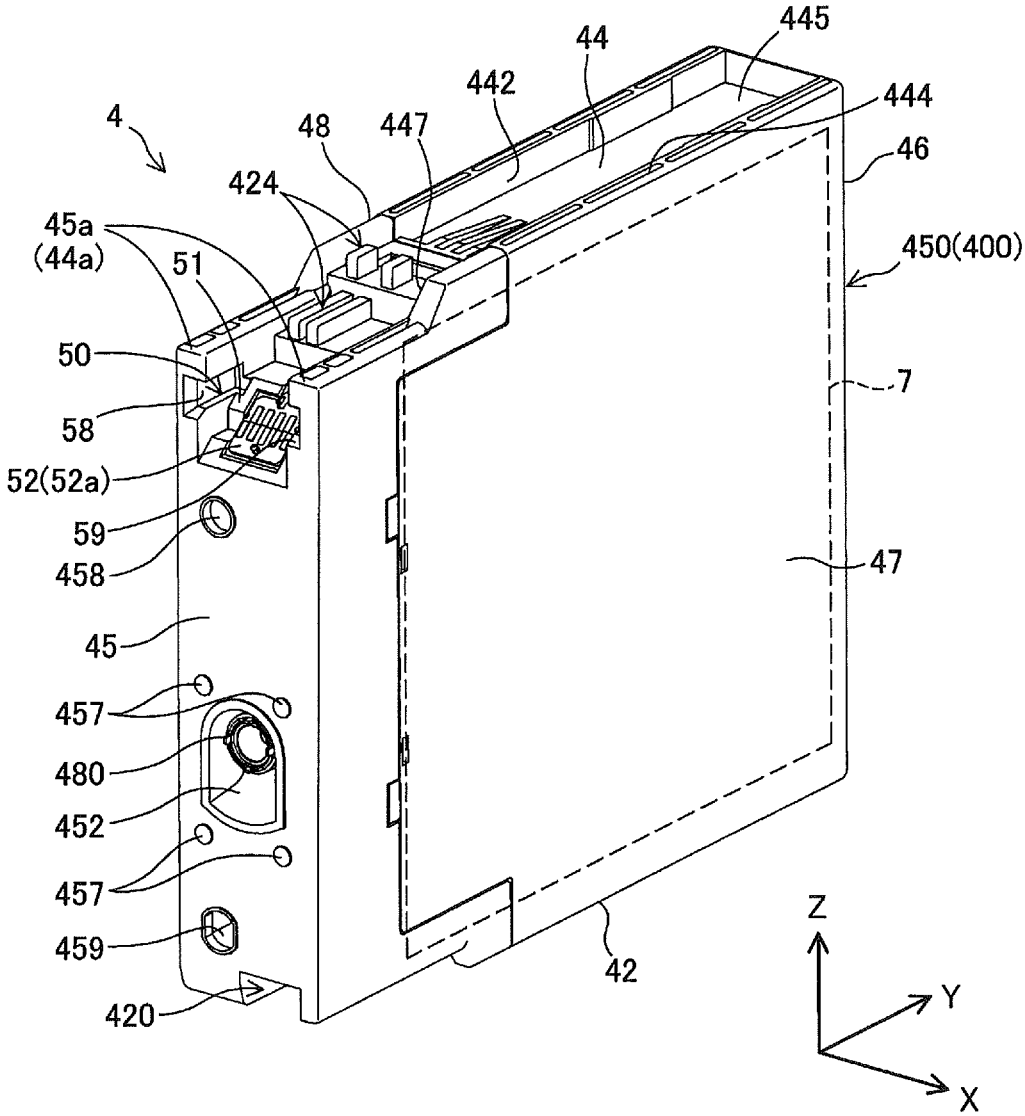
FIG. 10 is a first external perspective view of a cartridge.

The device-side identification member 82 is used to identify whether the right type (right ink color according to the embodiment) of the cartridge 4 is inserted into each of the slots 61*a* to 61*d* of the cartridge chamber 60. The device-side identification member 82 is located on the device-side first wall 65-side (−Y-axis direction side) of the first rail mechanism 89. The respective device-side identification members 82 are formed in different shapes according to the colors of inks in the cartridges 4 to be attached (shown in the same shape for the convenience of illustration in FIG. 6). More specifically, as shown in FIG. 6, each device-side identification member 82 is formed by at least one rib (projection). The respective device-side identification members 82 have different patterns, which are determined by the number and the positions of ribs, according to the respective types of the cartridges 4 to be attached. An identification member 424 comprised of ribs (called "cartridge-side identification member") is also provided on the cartridge 4 (FIG. 10). The identification member 424 of the cartridge 4 is formed in a different shape according to the color of ink contained in the cartridge 4. In the case that the right type of cartridge 4 is inserted into the slot 61, the device-side identification member 82 and the cartridge-side identification member 424 are fit to each other without collision. When the wrong type of cartridge 4 is inserted into the slot 61, on the other hand, the device-side identification member 82 and the cartridge-side identification member 424 collide with each other to interfere with further insertion of the cartridge 4. This reduces the likelihood that the wrong type of cartridge 4 is inserted into each of the slots 61*a* to 61*d* of the cartridge holder 6.

As shown in FIGS. 5 and 8, a second rail mechanism 84 and a device-side engagement structure 75 are provided on the device-side third wall 62. The respective elements 84 and 75 are provided for each of the slots 61*a* to 61*d*. The second rail mechanism 84 guides the cartridge 4 to the position of attachment while restricting the move of the cartridge 4 in the width direction (X-axis direction) in the course of attachment of the cartridge 4 to the cartridge holder 6. As shown in FIG. 5, the second rail mechanism 84 includes a pair of rail members 88 and 89 arranged at a specified interval in the X-axis direction. The pair of rail members 88 and 89 are members protruded from the device-side third wall 62 toward the cartridge chamber 60 and are extended along the Y-axis direction.

The device-side engagement structure 75 is engaged with the cartridge-side engagement structure 420 of the cartridge 4 (FIG. 9). Such engagement restricts the move of the cartridge 4 in the +Y-axis direction in the state of attachment. As shown in FIGS. 5, 8 and 9, the device-side engagement structure 75 includes a lever member 73, a mounting member 72 (FIG. 9) and a pressing member 79.

As shown in FIG. 8, the lever member 73 is located on the device-side first wall 65-side of the second rail mechanism 84. The lever member 73 includes a lever body 77, a projection 74 and a shaft 71. The lever body 77 is in a plate-like shape and has elasticity. The lever body 77 is extended horizontally in the state that no cartridge 4 is attached. The shaft 71 is located on a device-side first wall 65-side (−Y-axis direction side) end of the lever body 77. The shaft 71 is in a cylindrical shape and is extended in the −Z-axis direction from the lever body 77. As shown in FIG. 8, a projection 628 which is a part of the device-side third wall 62 is inserted into a shaft hole of the shaft 71. Such insertion allows the lever body 77 to rotationally move about the shaft 71 as the axis of rotation. A shaft 71-side part of the lever member 73 is clamped between the device-side first wall 65 and the device-side third wall 62 in the Z-axis direction. This allows a projection 74-side part of the lever member 73 to be elastically deformed in a direction RC including the vertical direction.

The projection 74 is a part to be engaged with the cartridge-side engagement structure 420 of the cartridge 4 (FIG. 9). The projection 74 is located on a device-side second wall 66-side (+Y-axis direction side) end of the lever body 77. The projection 74 is protruded from the lever body 77 in the +Z-axis direction. In the state of engagement of the cartridge-side engagement structure 420 with the device-side engagement structure 75 (called "state of engagement"), the projection 74-side of the lever member 73 is displaced in the −Z-axis direction by an external force from the cartridge 4. This causes the projection 74 of the lever member 73 to apply the elastic force almost in the +Z-axis direction onto the cartridge 4 in the state of engagement. The state of engagement herein is identical with the state of attachment.

As shown in FIG. 9, the pressing member 70 is a helical extension spring. The pressing member 79 has one end attached to the mounting member 72 and the other end attached to a part 627 of the device-side third wall 62. As shown in FIG. 5, application of an external force against the pressing member 79 to the lever body 77 causes the lever body 77 to be rotated in the direction of an arrow +RB. FIG. 5 illustrates the state of the lever body 77 under no application of the external force (non-load state). Releasing the external force applied to the lever body 77 causes the lever body 77 to be rotated in the direction of an arrow −RB. As described above, the lever body 77 is rotated in a plane parallel to the X-axis direction and the Y-axis direction (horizontal plane).

A-3. External Structure of Cartridge

Figure 11:
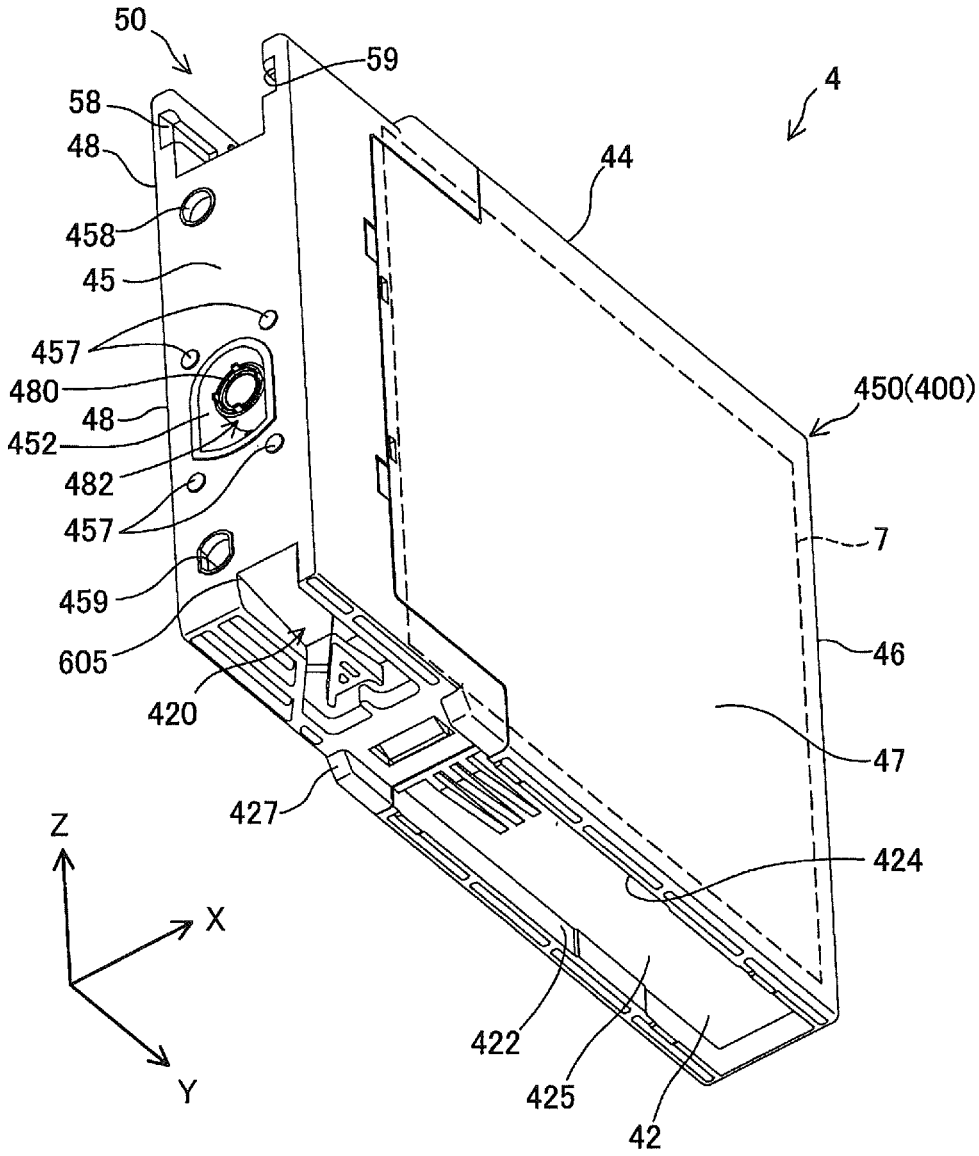
FIG. 11 is a second external perspective view of the cartridge.
Figure 12:
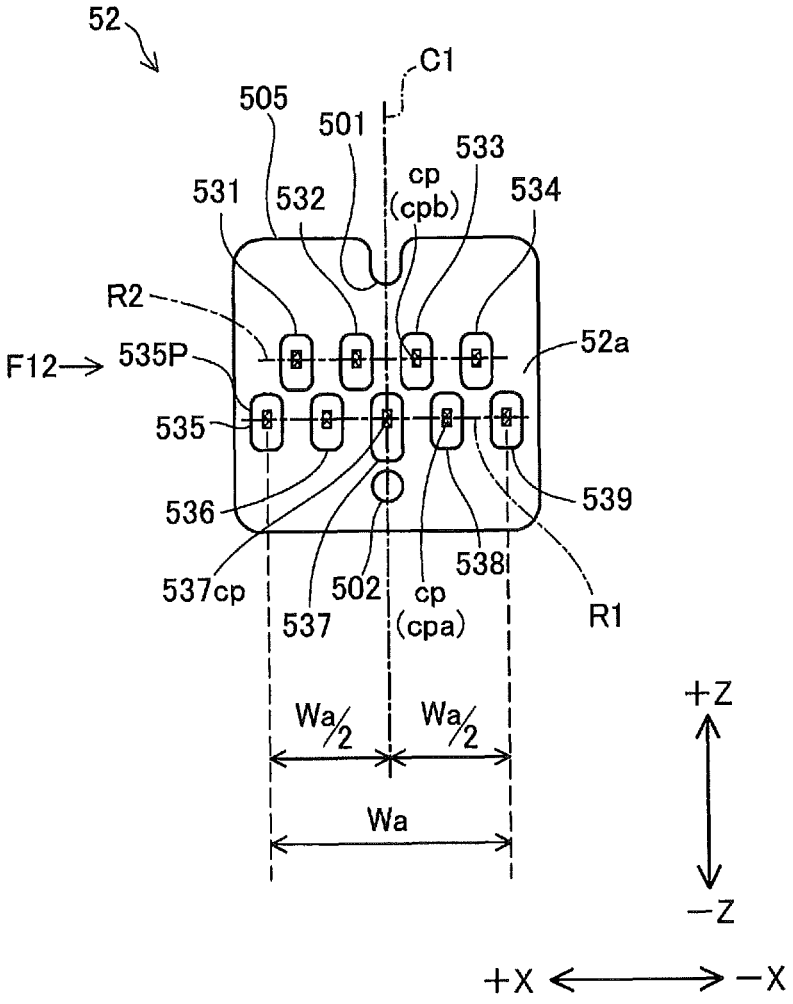
FIG. 12 is a front view of a circuit board.
Figure 13:
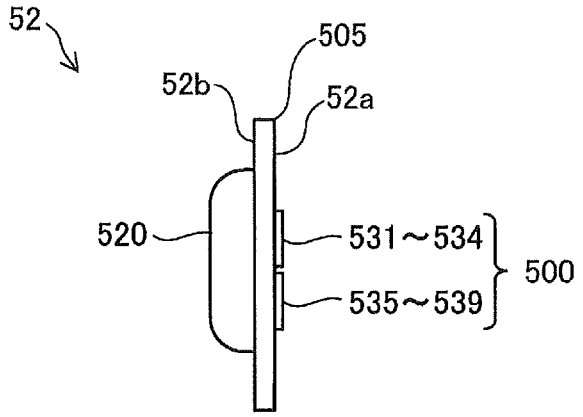
FIG. 13 is a side view of the circuit board.
Figure 14:
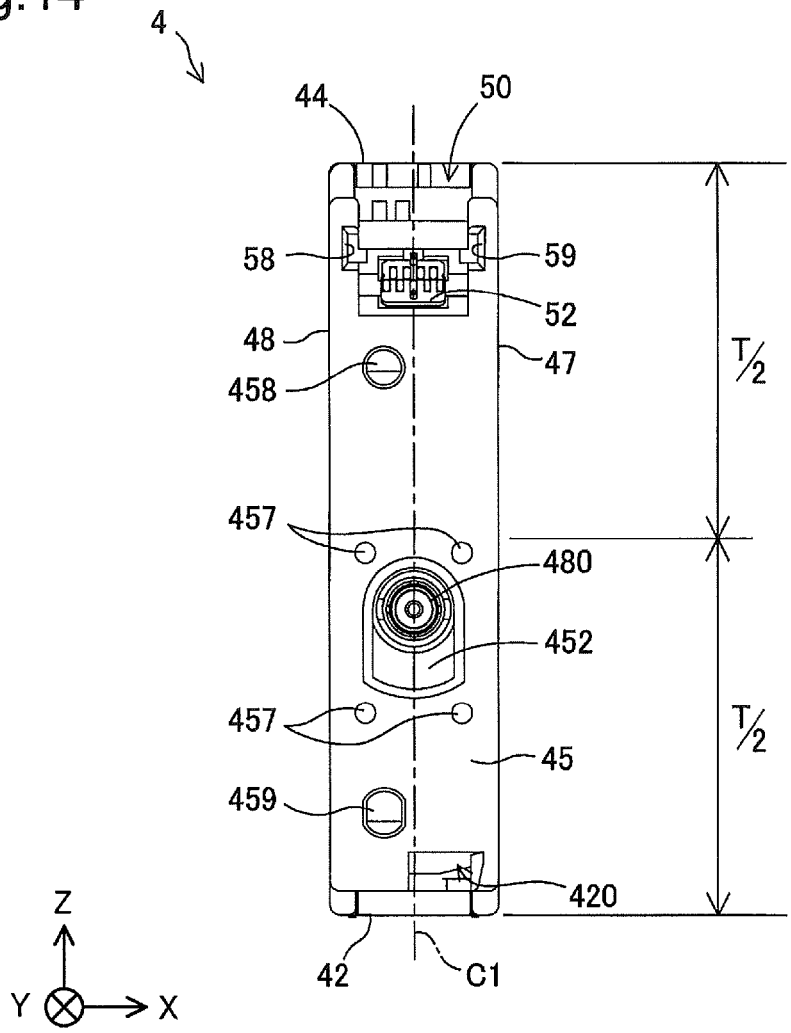
FIG. 14 is a front view of the cartridge.
Figure 15:
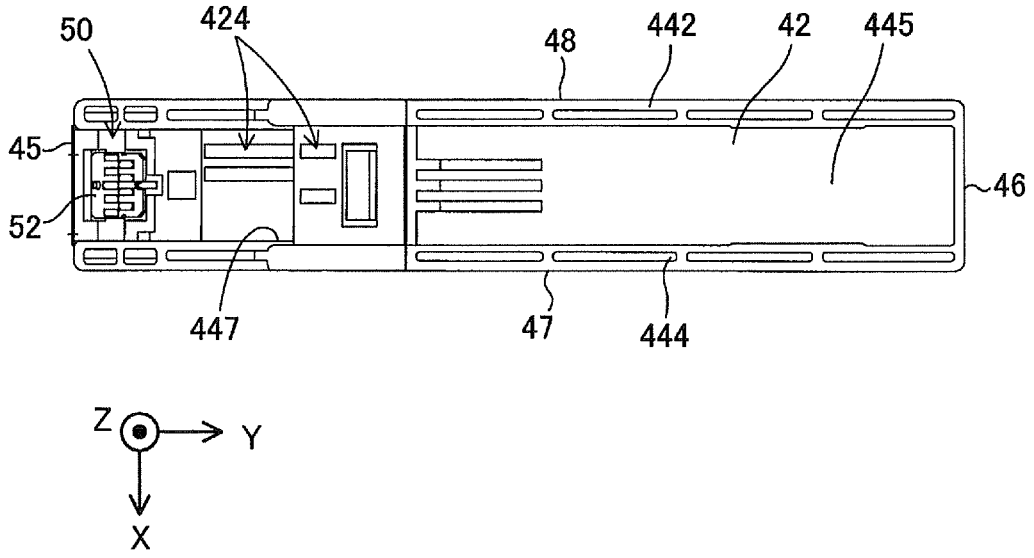
FIG. 15 is a top view of the cartridge.
Figure 16:
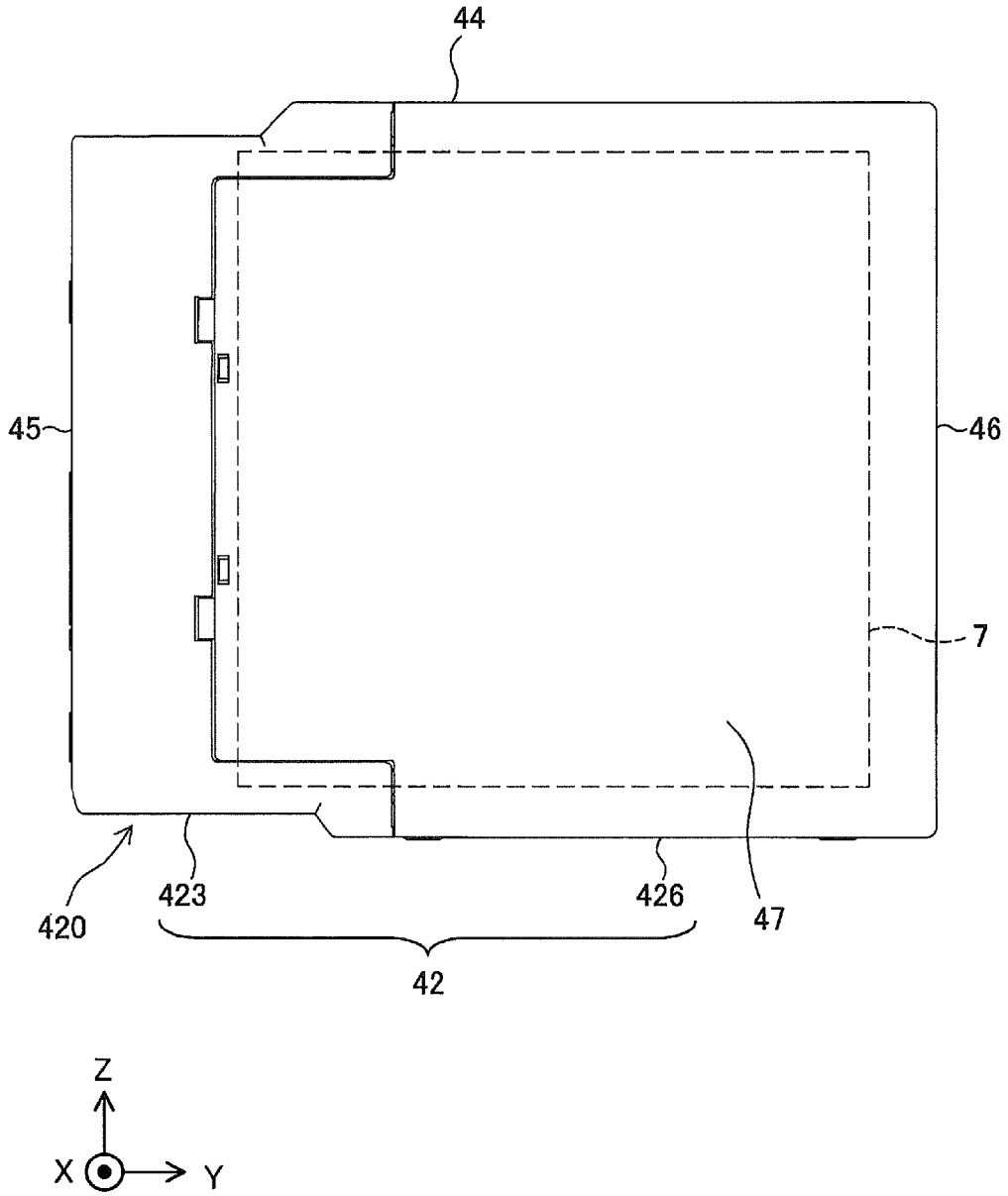
FIG. 16 is a first side view of the cartridge.
Figure 17:
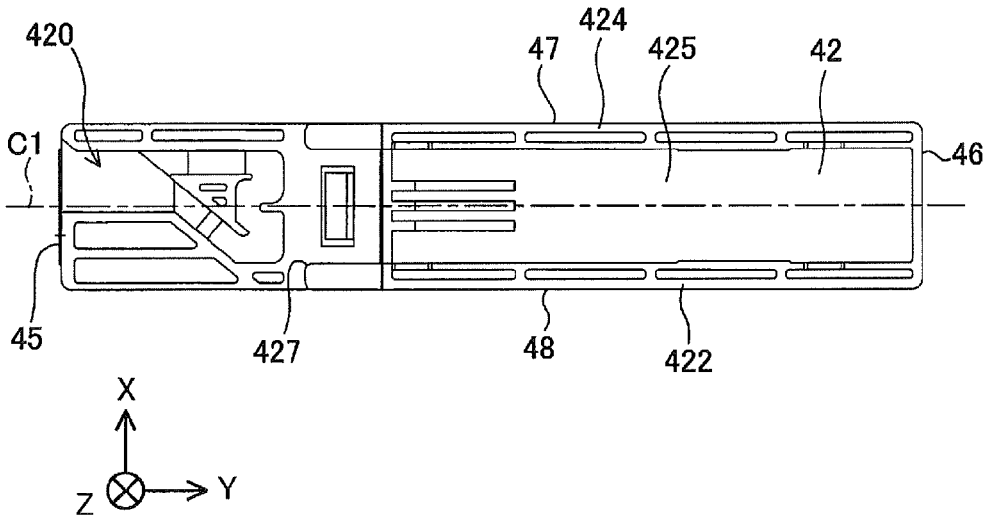
FIG. 17 is a bottom view of the cartridge.
Figure 18:
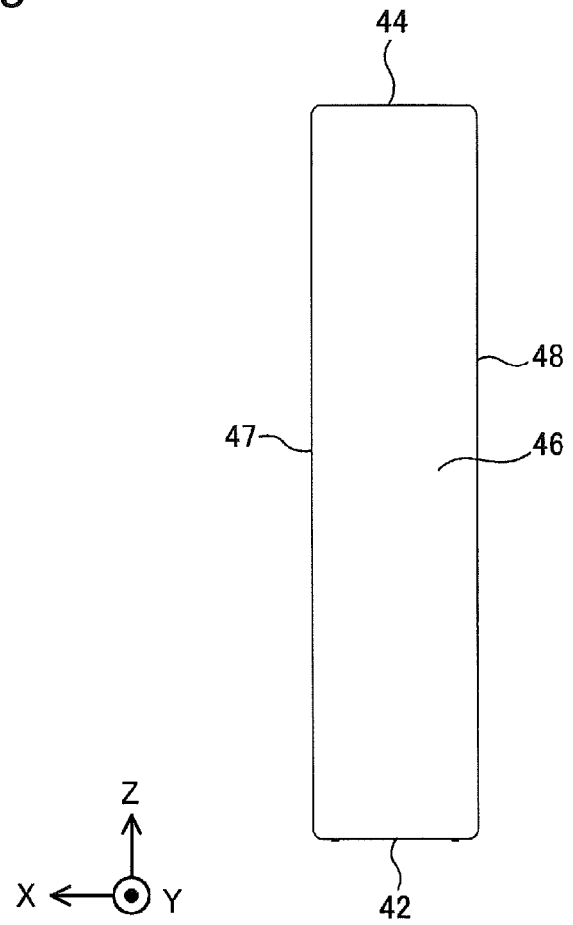
FIG. 18 is a rear view of the cartridge.
Figure 19:
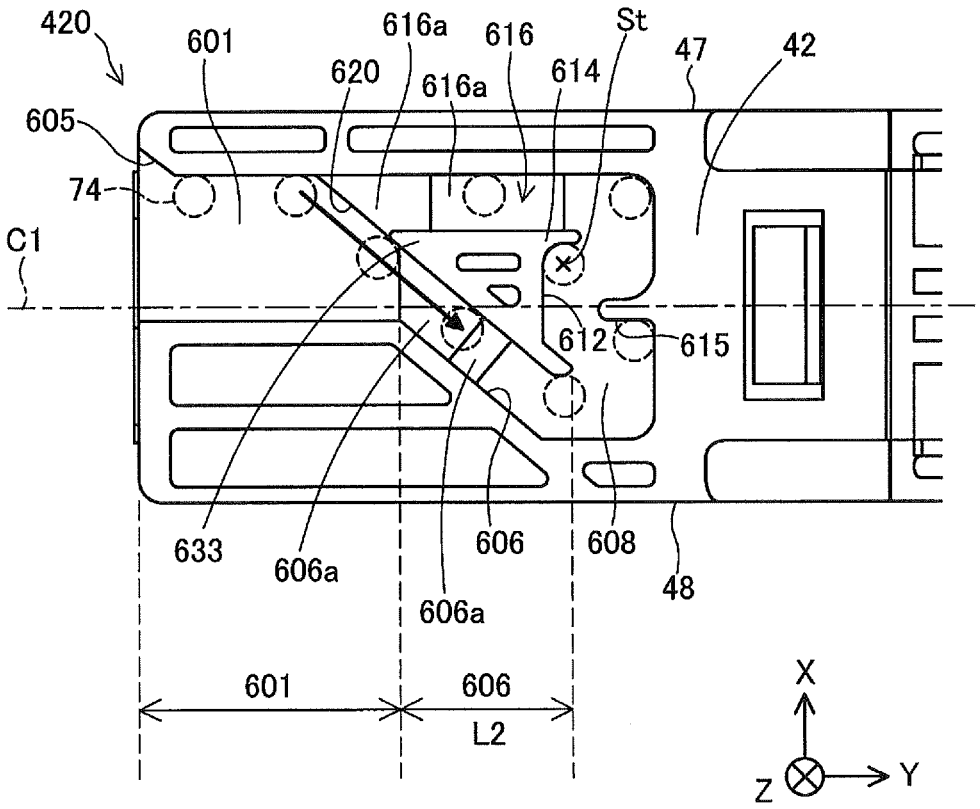
FIG. 19 is a partial enlarged view of FIG. 17.

The following describes the external structure of the cartridge 4 with reference to FIGS. 10 to 19. FIG. 10 is a first external perspective view of the cartridge 4. FIG. 11 is a second external perspective view of the cartridge 4. FIG. 12 is a front view of the circuit board 52. FIG. 13 is a side view of the circuit board 52. FIG. 14 is a front view of the cartridge 4. FIG. 15 is a top view of the cartridge 4. FIG. 16 is a first side view of the cartridge 4. FIG. 17 is a bottom view of the cartridge 4. FIG. 18 is a rear view of the cartridge 4. FIG. 19 is a partial enlarged view of FIG. 17. In order to facilitate understanding, the projection 74 of the device-side engagement structure 75 is also illustrated in FIG. 19. The XYZ axes illustrated in the drawings for description of the cartridge 4 correspond to the XYZ axes of the printing device 10 in the state of attachment.

As shown in FIGS. 10 and 11, the cartridge 4 is in an external shape of almost rectangular parallelepiped. According to this embodiment, the dimensions of the cartridge 4 decrease in the sequence of the Y-axis direction, the Z-axis direction and the X-axis direction. In the description of this embodiment, the X-axis direction is also called "width direction" of the cartridge 4; the Y-axis direction is also called "length direction" of the cartridge 4; and the Z-axis direction is also called "height direction" of the cartridge 4. The cartridge 4 includes a container main body 450 to internally contain ink. The container main body 450 is a housing formed by molding a synthetic resin such as polypropylene or polystyrene. The container main body 450 forms an outer shell (outer surface) 400 of the cartridge 4. The cartridge 4 has a first surface 45, a second surface 46, a third surface 42, a fourth surface 44, a fifth surface 47 and a sixth surface 48. The first to the sixth surfaces 45, 46, 42, 44, 47 and 48 constitute the outer shell (outer surface) 400 of the cartridge 4 formed by the container main body 450. A printing material container 7 for containing ink is placed inside of the outer shell 400. The external shape of each of the first to the sixth surfaces 45, 46, 42, 44, 47 and 48 in the planar view is an almost rectangular shape. The surface of each of the first to the sixth surfaces 45, 46, 42, 44, 47 and 48 is almost planar. The terminology "almost planar" herein includes both the state that the entire surface is perfectly flat and the state that the surface partially has some irregularities. In other words, "almost planar" includes the state that the surface is recognizable as the outer surface of the cartridge 4 even when the surface partially has slight irregularities or slight level differences. The first surface 45 is also called "front face 45"; the second surface 46 is also called "rear face 46"; the third surface 42 is also called "bottom face 42"; the fourth surface 44 is also called "upper face 44"; the fifth surface 47 is also called "first side face 47"; and the sixth surface 48 is also called "second side face 48".

The first surface 45 and the second surface 46 are opposed to each other in the Y-axis direction. The third surface 42 and the fourth surface 44 are opposed to each other in the Z-axis direction. The fifth surface 47 and the sixth surface 48 are opposed to each other in the X-axis direction.

As shown in FIG. 16, the first surface 45 and the second surface 46 are opposed to each other across the printing material container 7 (internal space of the cartridge 4). The third surface 42 and the fourth surface 44 are opposed to each other across the printing material container 7. As shown in FIGS. 10 and 14, the fifth surface 47 and the sixth surface 48 are opposed to each other across the printing material container 7. As shown in FIG. 16, the first surface 45 is located on the −Y-axis direction side of the printing material container 7. The second surface 46 is located on the +Y-axis direction side of the printing material container 7. The third surface 42 is located on the −Z-axis direction side of the printing material container 7. The fourth surface 44 is located on the +Z-axis direction side of the printing material container 7. As shown in FIGS. 10 and 14, the fifth surface 47 is located on the +X-axis direction side of the printing material container 7. The sixth surface 48 is located on the −X-axis direction side of the printing material container 7. The third surface 42 intersects the first surface 45, the second surface 46, the fifth surface 47 and the sixth surface 48. The fourth surface 44 intersects the first surface 45, the second surface 46, the fifth surface 47 and the sixth surface 48. The fifth surface 47 intersects the first surface 45, the second surface 46, the third surface 42 and the fourth surface 44. The sixth surface 48 intersects the first surface 45, the second surface 46, the third surface 42 and the fourth surface 44. According to this embodiment, the terminology "intersecting" denotes any of the state that two surfaces actually cross each other, the state that an extension of one surface actually crosses the other surface, and the state that an extension of one surface actually crosses an extension of the other surface.

As shown in FIG. 16, the first surface 45 is the surface opposed to the cartridge holder 6 in the state of attachment. The first surface 45 is almost perpendicular to the horizontal plane in the state of attachment. The third surface 42 has one-end-side face 426 and other-end-side face 423. The one-end-side face 426 is connected with the second surface 46. The other-end-side face 423 is connected with the first surface 45. The one-end-side face 426 and the other-end-side face 423 are connected with each other. The other-end-side face 423 is located at a position closer to the fourth surface 44 than the one-end-side face 426 in the Z-axis direction. In other words, the other-end-side face 423 is located on the upper side (on the +Z-axis direction side) of the one-end-side face 426.

Additionally, the cartridge 4 has a corner section 50 where the first surface 45 intersects the fourth surface 44 as shown in FIG. 10. The corner section 50 is a recess formed across the first surface 45 and the fourth surface 44. The corner section 50 is an area where a fourth surface 44-side end 45*a* of the first surface 45 and a first surface 45-side end 44*a* of the fourth surface 44 are located. A slope surface 51 connecting the first surface 45 with the fourth surface 44 is formed on the bottom of the corner section 50. The slope surface 51 faces in a direction including a +Z-axis direction component and a −Y-axis direction component. In other words, the slope surface 51 is inclined to approach from the first surface 45 to the second surface 46 accompanied with an approach from the third surface 42 to the fourth surface 44. The circuit board 52 is placed on the slope surface 51. The surface 52*a* of the circuit board 52 is inclined at approximately the same angle as that of the slope surface 51. The surface 52*a* accordingly faces in the direction including the +Z-axis direction component and the −Y-axis direction component. As shown in FIGS. 11 and 14, a first groove 58 and a second groove 59 are formed on the respective side faces of the corner section 50. The first groove 58 and the second groove 59 are respectively extended from the first surface 45 in the +Y-axis direction. In the process of attachment of the cartridge 4, the member 811 (FIG. 6) is inserted into the first groove 58 and the member 810 (FIG. 6) is inserted into the second groove 59. Such insertion positions the device-side terminal group 802 relative to a cartridge-side terminal group 500.

As shown in FIGS. 12 and 13, the circuit board 52 has the cartridge-side terminal group 500 provided on the surface 52*a* and a memory unit 520 provided on a rear face 52*b*. The surface 52*a* and the rear face 52*b* are both planes. A part (side) of the planar surface 52*a* closest to the +Z-axis direction side in the state of attachment to the cartridge 4 is called substrate end 505.

The cartridge-side terminal group 500 is comprised of nine cartridge-side terminals 531 to 539. The memory unit 520 stores information regarding ink in the cartridge 4 (for example, the remaining amount of ink and the color of ink to be contained). The contact between the cartridge-side terminal group 500 and the device-side terminal group 802 of the printing device 10 (FIG. 6) causes the memory unit 520 to send and receive data signals to and from the controller 31 of the printing device 10. The controller 31 (FIG. 1) determines attachment of the cartridge 4 to the printing device 10, based on the contact between the respective terminals 531 to 539 of the cartridge-side terminal group 500 and the respective terminals (nine terminals) of the device-side terminal group 802. After such determination, the controller 31 of the printing device 10 controls the printing device 10 to be available for printing operation.

As shown in FIG. 12, each of the nine cartridge-side terminals 531 to 539 is formed in an almost rectangular shape. Each of the nine cartridge-side terminals 531 to 539 has a contact part cp. The nine cartridge-side terminals 531 to 539 are arranged to form two rows R1 and R2. The two rows R1 and R2 are located at different heights. The two rows R1 and R2 are respectively lines extended along the width direction (Y-axis direction) in which the fifth surface 47 and the sixth surface 48 of the cartridge 4 are opposed to each other. Out of the two rows R1 and R2, the row on the −Z-axis direction side is called first terminal row R1, and the row on the +Z-axis direction side is called second terminal row R2. The first terminal row R1 is comprised of five cartridge-side terminals 535, 536, 537, 538 and 539, and the second terminal row R2 is comprised of four cartridge-side terminals 531, 532, 533 and 534. A contact portion cp that is in contact with the device-side terminal 803 of the contact mechanism 80 (FIG. 6) is provided in a center area of each of the terminals 541 to 539. The first terminal row R1 and the second terminal row R2 may thus be regarded as rows respectively formed by a plurality of contact portions cp.

The contact portions cp of the terminals 535 to 539 forming the first terminal row R1 and the contact portions cp of the terminals 531 to 534 forming the second terminal row R2 are arranged alternately. More specifically, the respective contact portions cp are arranged in zigzag.

Among the plurality of (five) contact portions cp forming the first terminal row R1, a contact portion located at the center of a width Wa of the plurality of (five) contact portions cp is called first contact portion 537*cp*. The terminal having the first contact portion 537*cp* is called first terminal 537. A virtual plane that passes through the first terminal 537 and is perpendicular to the width direction (X-axis direction) is called "plane C1". The plane C1 passes through the first contact portion 537*cp*. According to the embodiment, the plane C1 passes through the center of the width of the circuit board 52 and also passes through the center of the width of the cartridge 4. The five contact portions cp arranged on the first terminal row R1 correspond to the "plurality of contact portions" described in Solution to Problem. The plurality of contact portions cp forming the first terminal row R1 are also called "plurality of contact portions cpa", and the plurality of contact portions cp forming the second terminal row R2 are also called "plurality of contact portions cpb". The cartridge-side terminals 531 to 539 are formed in two terminal rows in this embodiment, but this is not restrictive. The cartridge-side terminals may form only the first terminal row R1 or may form only the second terminal row R2.

As shown in FIG. 12, a boss groove 501 is formed on a +Z-axis direction side end of the circuit board 52, and a boss hole 502 is formed on a −Z-axis direction side end of the circuit board 52. The circuit board 52 mounted on the cartridge 4 is fixed to the slope surface 51 of the cartridge 4 (FIG. 10) by using the boss groove 501 and the boss hole 502. According to another embodiment, at least one of the boss groove 501 and the boss hole 502 may be omitted from the circuit board 52, and the circuit board 52 may be fixed to the slope surface 51 by using an adhesive. Alternatively the circuit board 52 may be fixed to the slope surface 51 by using an engagement claw (not shown) provided on the slope surface 51.

As shown in FIG. 11, a through hole 452, a first member through hole 458, a second member through hole 459 and abutting portions 457 are provided on the first surface 45. The through hole 452 receives the printing material supplier 482. At least a supply port 480 forming one end of the printing material supplier 482 is placed in the through hole 452. As shown in FIG. 14, the supply port 480 is disposed at a position passing through the plane C1. The supply port 480 is in a circular shape. The center of the supply port 480 is located at the position passing through the plane C1. The supply port 480 is disposed at a position closer to the third surface 42 than the fourth surface 44 in the Z-axis direction. In other words, the supply port 480 is located in a lower area than half a height T of the cartridge 4. In the state prior to attachment of the cartridge 4 to the cartridge holder 6 (called "initial state"), the supply port 480 may be covered with a sheet member. The sheet member has such a thickness as to be broken by the flow tube 702.

As shown in FIG. 11, the first member through hole 458 and the second member through hole 459 are arranged in a positional relationship across the through hole 452 in the Z-axis direction. In the state of attachment, the first positioning member 76 (FIG. 8) is inserted into the first member through hole 458, and the second positioning member 78 (FIG. 8) is inserted into the second member through hole 459. The cooperation of the pair of member through holes 458 and 459 with the pair of positioning members 76 and 78 restricts the move of the cartridge 4 in an in-plane direction perpendicular to the direction of insertion of the cartridge 4 in the course of attachment of the cartridge 4 to the cartridge holder 6. The in-plane direction is the direction parallel to the X-axis direction and the Z-axis direction. The first member through hole 458 has a cross section perpendicular to the Y-axis direction in an almost circular shape. The second member through hole 459, on the other hand, has a cross section perpendicular to the Y-axis direction in an elliptical shape elongated in the Z-axis direction. The length of the second member through hole 459 in the Y-axis direction is greater than the length of the second positioning member 78 in the Y-axis direction. When the second positioning member 78 is inserted into the second member through hole 459, a small clearance is produced in the Y-axis direction. The greater length of the second member through hole 459 in the Y-axis direction facilitates the allowance for dimensional tolerance, while maintaining the accuracy of positioning. In other words, the accuracy of positioning the cartridge 4 in the slot 61 is assured by the first member through hole 458. The positional misalignment between the second member through hole 459 and the second positioning member 78 by the dimensional tolerance or the like is absorbed by the second member through hole 459.

There are four abutting portions 457. The abutting portions 457 are formed in a disc shape protruded from the first surface 45. As shown in FIG. 14, the four abutting portions 457 are arranged around the periphery of the through hole 452. The four abutting portions 457 are in abutment with a +Y-axis direction-side end face 703 (FIG. 5) of the cover member 706 of the cartridge holder 6 (FIG. 8).

As shown in FIG. 10, a groove 445 and a cartridge-side identification member 424 are provided on the fourth surface 44. The groove 445 is extended from the middle of the fourth surface 44 to its second surface 46-side end. A pair of side walls 442 and 444 defining and forming the groove 445 are arranged at a predefined interval in the width direction of the cartridge 4. More specifically, the pair of side walls 442 and 444 are arranged at such an interval that allows the pair of rail members 86 and 87 (FIG. 6) to be inserted and fit in the groove 445. The cartridge-side identification member 424 is formed by at least one rib (projection). The pattern of the cartridge-side identification member 424 determined by the number and the positions of ribs differs according to the type of the cartridge 4. The cartridge-side identification member 424 is located in the Y-axis direction near a groove inlet 447 formed on a first surface 45-side end of the groove 445. The cartridge-side identification member 424 is also located closer to the second surface 46 than the circuit board 52.

As shown in FIG. 11, a groove 425 and a cartridge-side engagement structure 420 are provided on the third surface 42. The groove 425 is extended from the middle of the third surface 42 to its second surface 46-side end. A pair of side walls 422 and 424 defining and forming the groove 425 are arranged at a predetermined interval in the width direction of the cartridge 4. More specifically, the pair of side walls 422 and 424 are arranged at such an interval that allows the pair of rail members 88 and 89 (FIG. 5) to be inserted and fit in the groove 425. The cartridge-side engagement structure 420 is located closer to the first surface 45 than the groove 425 (groove inlet 427). The cartridge-side engagement structure 420 is formed in a groove shape (groove structure). The cartridge-side engagement structure 420 is engaged with the device-side engagement structure 75, so as to restrict the move of the cartridge 4 in the +Y-axis direction against the external forces Fp and Fs1 (FIG. 3) in the direction of detachment (+Y-axis direction) applied from the cartridge holder 6.

As shown in FIG. 19, the cartridge-side engagement structure 420 includes a receiver portion 601, a guide portion 606, a connector portion 608, an engagement portion 612 and an outlet portion 616. In the course of attachment of the cartridge 4 to the cartridge holder 6, the projection 74 moves in the sequence of the receiver portion 601, the guide portion 606, the connector portion 608 and the engagement portion 612. In the state of attachment, the projection 74 engages with the engagement portion 612 at a specified engagement position St of the engagement portion 612. In the course of detachment of the cartridge 4 from the cartridge holder 6, on the contrary, the projection 74 moves in the sequence of the engagement portion 612, the outlet portion 616 and the receiver portion 601.

The receiver portion 601 is extended from the first surface 45 toward the second surface 46 and receives the projection 74 of the device-side engagement structure 75. The receiver portion 601 has an opening 605 formed on the first surface 45. The projection 74 is received into the receiver portion 601 through the opening 605. The receiver portion 601 has a greater depth than those of the other portions 606, 608, 612 and 616 of the cartridge-side engagement structure 420. While the projection 74 is located in any of the other portions 606, 608, 612 and 616, the projection 74-side of the lever body 77 is pressed down. Accordingly the cartridge 4 receives the external force Ft (FIG. 3) in the press-up direction (+Z-axis direction 9 via the projection 74 by the elastic force of the lever body 77.

The guide portion 606 is a portion serving to guide the projection 74 of the device-side engagement structure 75 to the engagement position St (position where the engagement portion 612 is formed). The guide portion 606 is connected with the receiver portion 601. The guide portion 606 is extended in a direction inclined to the direction of attachment of the cartridge 4 (−Y-axis direction) in the process of attachment of the cartridge 4 to the cartridge holder 6. More specifically, the guide portion 606 is inclined in the width direction of the cartridge 4 relative to the direction of attachment. The guide portion 606 has a slope 606*a* formed to decrease the depth of the groove with increasing distance from the receiver portion 601. There is no step on the boundary between the guide portion 606 and the receiver portion 601. The guide portion 606 has a length L2 in the direction in which the first surface 45 and the second surface 46 are opposed to each other (direction of attachment and direction of detachment). The length L2 is shorter than the length L1 of the printing material receiver 710 (FIG. 8).

The connector portion 608 connects the guide portion 606 with the engagement portion 612. The connector portion 608 has a projection wall 615 protruded in the −Y-axis direction from a +Y-axis direction-side wall defining and forming the groove. The engagement portion 612 is opposed to the projection wall 615. The engagement portion 612 has an engagement wall 614. The engagement wall 614 is formed by a wall portion 633, which is one of a plurality of walls defining and forming the groove of the cartridge-side engagement structure 420. The engagement portion 612 is formed at a position passing through the plane C1. The outlet portion 616 connects the engagement portion 612 with the receiver portion 601. The outlet portion 616 has a slope 616*a* formed to increase the depth of the groove with decreasing distance from the receiver 601. There is a step 620 formed on the boundary between the outlet portion 616 and the receiver portion 601.

The following describes the move of the projection 74 in the cartridge-side engagement structure 420 during the attachment operation and the detachment operation of the cartridge 4 with reference to FIG. 19. During the attachment operation, after the first positioning member 76 starts inserting into the first member through hole 458 (FIG. 11) and the second positioning member 78 starts inserting into the second member through hole 459 (FIG. 11), the projection 74 moves from the receiver portion 601 to the guide portion 606. While the projection 74 moves along the guide portion 606, the lever body 77 rotates in the direction including the −X-axis direction component (direction of the arrow +RB in FIG. 5) against the pressing force of the pressing member 79 (FIG. 9). While the projection 74 moves along the guide portion 606, the first surface 45 (more specifically, the abutting portions 457) of the cartridge 4 are in abutment with the end face 703 of the cover member 706 (FIG. 5). The cartridge 4 is further pressed in the direction of attachment against the pressing force of the pressing member 712 (FIG. 8), so that the projection 74 reaches the connector portion 608. The projection 74 reaching the connector portion 608 moves in the direction including the +X-axis direction component (direction of the arrow −RB in FIG. 5) by the pressing force of the pressing member 79 of the device-side engagement structure 75. The projection 74 then hits against the projection wall 615 and stops, so that a click is produced. This click enables the user to check the sufficient advance of the cartridge 4 in the direction of attachment.

When the user's press of the cartridge 4 in the direction of attachment is released, the cartridge 4 is slightly pressed back in the direction of detachment (+Y-axis direction) by the pressing force of the pressing member 712 of the flow unit 70 (FIG. 8). This releases the engagement by the projection wall 615 and causes the projection 74 to reach the engagement portion 612. The projection 74 eventually hits against the engagement wall 614 of the engagement portion 612. This restricts the move of the projection 74 in the +X-axis direction by the pressing force of the pressing member 79 (FIG. 9). When the projection 74 hits against the engagement wall 614, a click is produced. This click enables the user to check the reach of the cartridge 4 at the engagement position St and completion of attachment of the cartridge 4 to the cartridge holder 6. In the state of attachment, the pressing member 712 (FIG. 8) applies the external force Fp in the direction of detachment (+Y-axis direction) (FIG. 3). The projection 74 is, however, in abutment with the engagement wall 614, so as to restrict the move of the cartridge 4 in the direction of detachment.

The cartridge 4 is detached from the cartridge holder 6 by the following procedure. The user presses the cartridge 4 in the state of attachment further in the direction of attachment. The projection 74 is accordingly away from the engagement wall 614, so as to disengage the cartridge-side engagement structure 420 from the device-side engagement structure 75. The cartridge 4 is then moved in the direction of detachment (+Y-axis direction) by the pressing force of the pressing member 712 of the cover member 706. The projection 74 accordingly passes through the outlet portion 616 and reaches the receiver portion 601. The user grasps the cartridge 4 moved by a predetermined distance in the direction of detachment by the pressing force of the pressing member 712 and detaches the cartridge 4 from the cartridge holder 6.

A-4. Internal Structure of Cartridge

Figure 20:
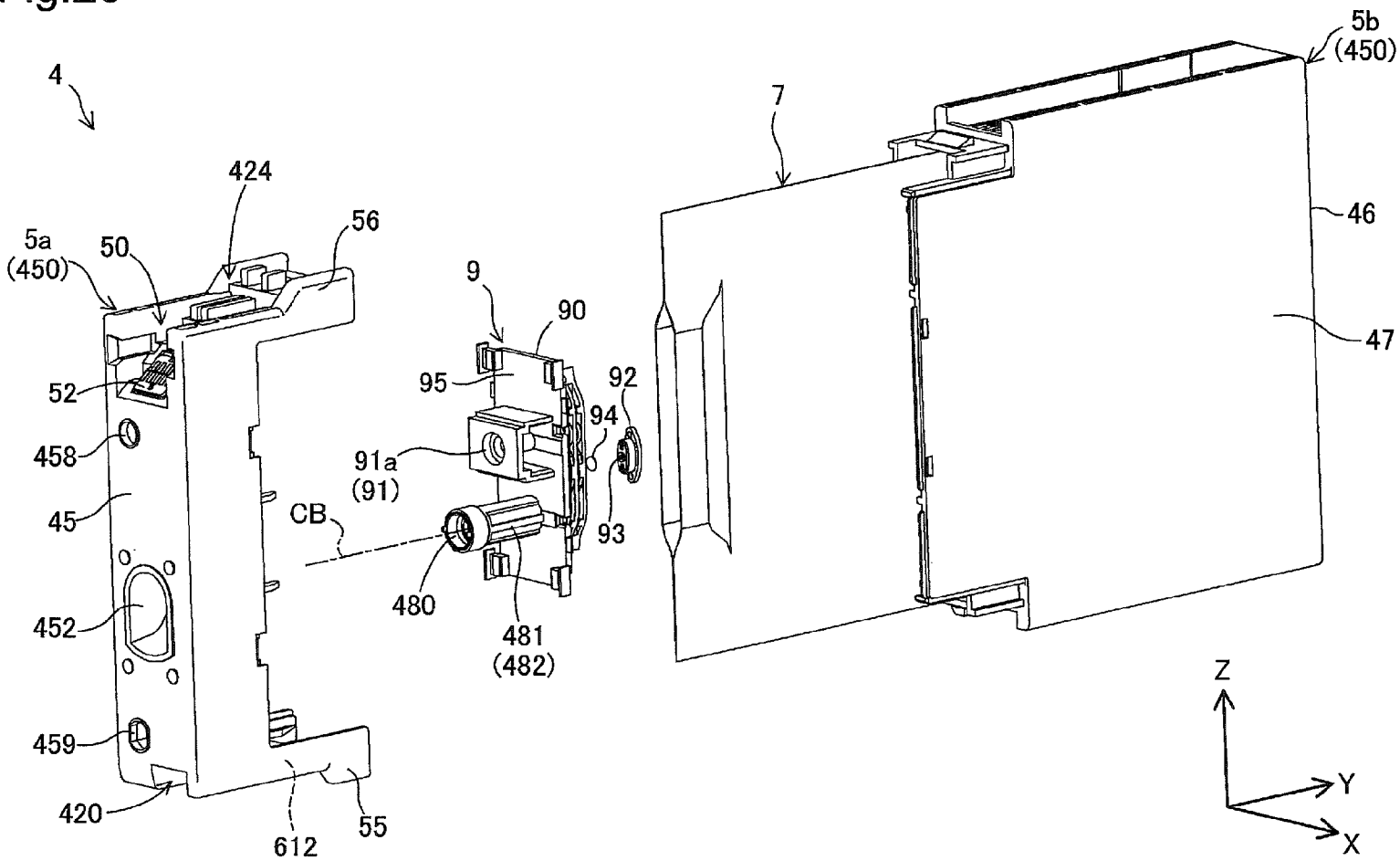
FIG. 20 is an exploded perspective view of the cartridge.
Figure 21:
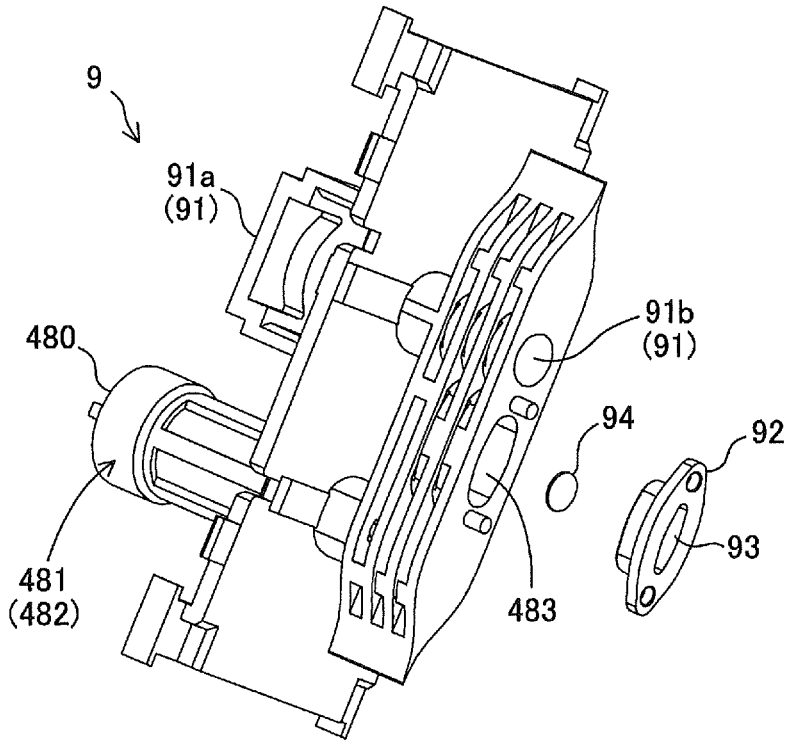
FIG. 21 is an exploded perspective view of a flow path unit.

FIG. 20 is an exploded perspective view of the cartridge 4. FIG. 21 is an exploded perspective view of a flow path unit 9. As shown in FIG. 20, the container main body 450 is comprised of a first container body 5*a* and a second container body 5*b*. The first container body 5*a* and the second container body 5*b* are separated from each other by disassembling. In other words, the first container body 5*a* and the second container body 5*b* are provided as separate bodies. The first container body 5*a* includes the first surface 45 but does not include the second surface 46. The second container body 5*b* includes the second surface 46 but does not include the first surface 45. The printing material container 7 is mainly accommodated in the second container body 5*b*. The corner section 50 is formed on the first container body 5*a*. The first container body 5*a* has projections 55 and 56 located on both ends in the Z-axis direction and protruded toward the second container body 5*b*. Part of the cartridge-side engagement structure 420 including the engagement portion 612 (FIG. 19) is formed on the projection 55. The projections 55 and 56 of the first container body 5*a* are fit in the second container body 5*b*, so that the first container body 5*a* and the second container body 5*b* are assembled. There is some play between the projections 55 and 56 and the second container body 5*b*. This play enables the second container body 5*b* to be slightly moved relative to the first container body 5*a*.

The printing material container 7 is provided as a bag member. Ink is filled in the printing material container 7. The printing material container 7 is made of an aluminum-laminated multilayer film formed by stacking an aluminum layer on a resin film layer. The printing material container 7 has flexibility. The printing material container 7 is designed such that the internal volume of the printing material container 7 decreases with a decrease in remaining amount of ink in the printing material container 7. A flow path unit 9 communicating with the inside of the printing material container 7 is mounted on a first surface 45-side face of the printing material container 7.

As shown in FIGS. 20 and 21, the flow path unit 9 includes a flow path main body 90, a valve 94 and a valve seat 92. The flow path main body 90 and the valve seat 92 are formed by molding a synthetic resin, such as polypropylene or polystyrene. The valve 94 is made of an elastic material such as synthetic resin.

The flow path main body 90 has a printing material supplier 482 and a decompression unit 91. The printing material supplier 482 forms a flow path to supply ink in the printing material container 7 to the printing device 10. The front end 702*b*-side of the flow tube 702 is inserted into the printing material supplier 482. Insertion of the flow tube 702 into the printing material supplier 482 restricts the move of the cartridge 4 to some extent in the in-plane direction perpendicular to the direction of attachment of the cartridge 4. This accordingly positions the cartridge 4 relative to the cartridge holder 6 in the direction perpendicular to the direction of attachment. As shown in FIG. 21, one end of the printing material supplier 482 forms the supply port 480, and the other end forms a connecting hole 483. The supply port 480 is open to the outside. The connecting hole 483 is located in the printing material container 7. As shown in FIG. 20, the printing material supplier 482 has a flow path-forming member 481 extended from a surface 95 on the first surface 45-side of the flow path main body 90. The flow path-forming member 481 is extended in the −Y-axis direction from the surface 95. The flow path-forming member 481 is in a cylindrical shape. The flow path-forming member 481 is a one-end-side section of the printing material supplier 482 including the supply port 480. A center axis CB of the flow path-forming member 481 is extended along the Y-axis direction. A one-end-side flow path including the supply port 480 in the flow path of the printing material supplier 482 is formed by the flow path-forming member 481. In other words, the internal flow path in the one-end-side section of the printing material supplier 482 including the supply port 480 is extended along the Y-axis direction.

A valve unit (not shown) is placed in the flow path-forming member 481. The valve unit includes a valve and a valve seat with a valve hole. The valve seat is made of an elastic material such as synthetic rubber. Insertion of the flow tube 702 into the printing material supplier 482 through the supply port 480 causes the valve to be separated from the valve seat. The valve unit is accordingly set in the valve-opening position to open the internal flow path of the printing material supplier 482. The outer circumference of the flow tube 702 is air-tightly surrounded by the valve seat. Insertion of the flow tube 702 into the printing material supplier 482 positions the cartridge 4 relative to the cartridge holder 6. more specifically, this positions the cartridge 4 in the in-plane direction perpendicular to the direction of attachment of the cartridge 4. According to this embodiment, in the state of attachment, the outer circumference of the flow tube 702 is air-tightly surrounded by the valve seat. Any other suitable technique may, however, be employed to prevent ink from being externally leaked from the clearance between the flow tube 702 and the printing material supplier 482. For example, the flow tube 702 may be inserted and fit in the printing material supplier 482. In other words, the inner circumference of the printing material supplier 482 may be in contact with the entire outer circumference of the flow tube 702 in the circumferential direction.

As shown in FIGS. 20 and 21, the valve seat 92 has a valve hole 93 which ink flows through. When the ink flows from the printing material container 7 to the printing device 10, the valve 94 is separated from the valve seat 92. The valve 94 is accordingly set in the valve-opening position to allow the ink to flow through the printing material supplier 482. The ink flowing through the printing material supplier 482 then flows into the printing device 10. When there is a reverse ink flow back to the printing material container 7, the valve 94 is seated on the valve seat 92 to block the valve hole 93, so as to interfere with the back flow of ink. As described above, the printing material supplier 482 connects the printing material container 7 with the printing device 10.

The decompression unit 91 is used to reduce the internal pressure of the printing material container 7, when the printing material container 7 is filled with ink. One end 91*a* of the decompression unit 91 is open to the outside. The other end 91*b* of the decompression unit 91 is open in the printing material container 7. Before the printing material container 7 is filled with ink, the decompression unit 91 is actuated to externally reduce the pressure of the printing material container 7. After decompression, ink is flowed through the printing material supplier 482 into the printing material container 7. The flow path of the decompression unit 91 is blocked by, for example, thermal welding, after the printing material container 7 is filled with ink.

A-5. Attachment Process of Cartridge

Figure 22:
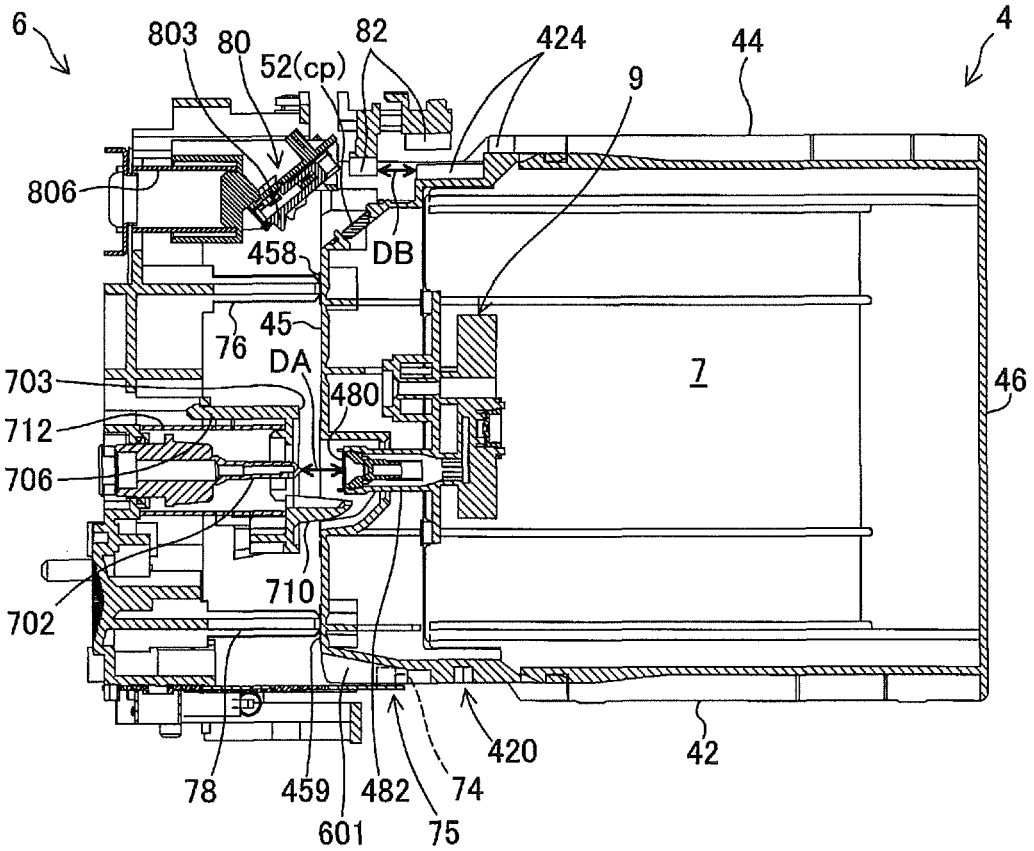
FIG. 22 is a first explanatory diagram.
Figure 22:
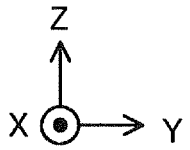
Figure 23:
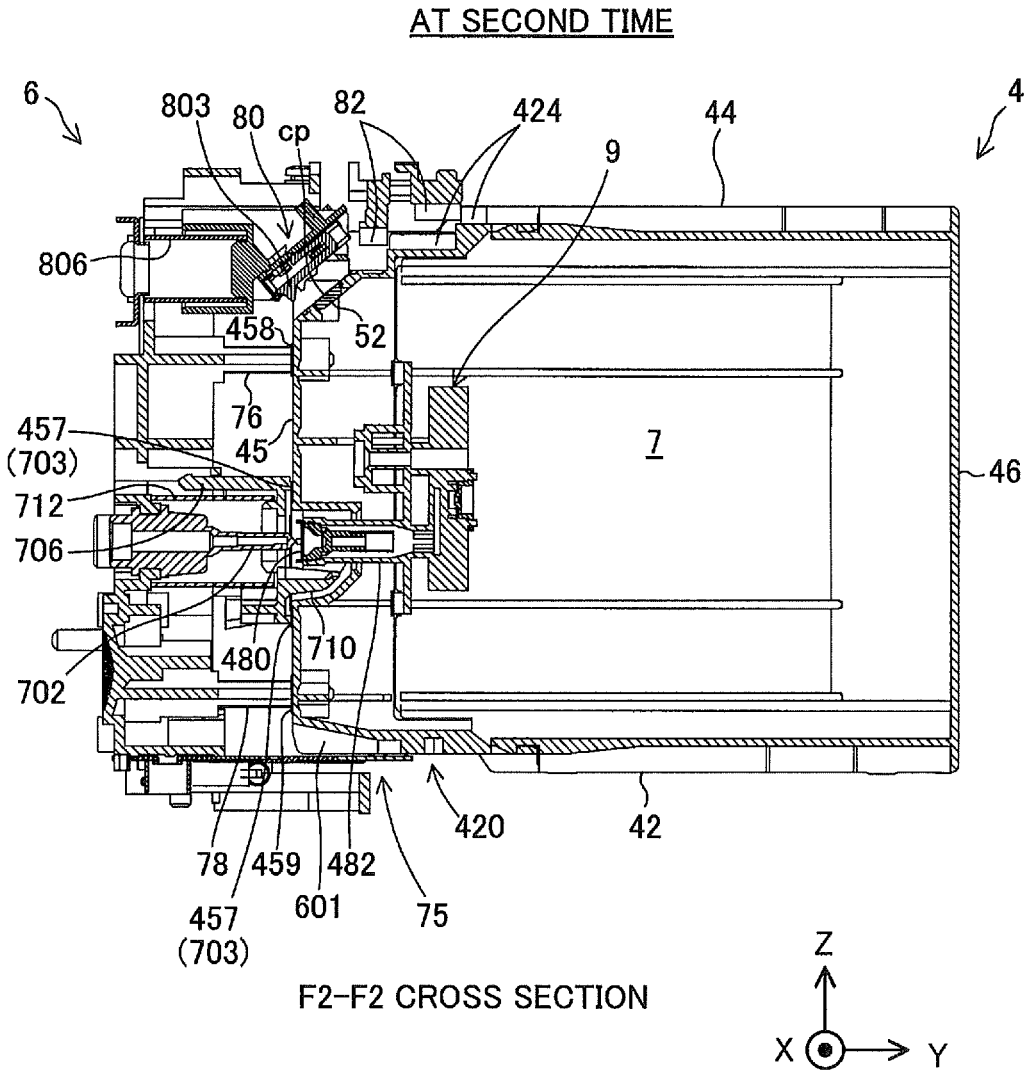
FIG. 23 is a second explanatory diagram.
Figure 24:
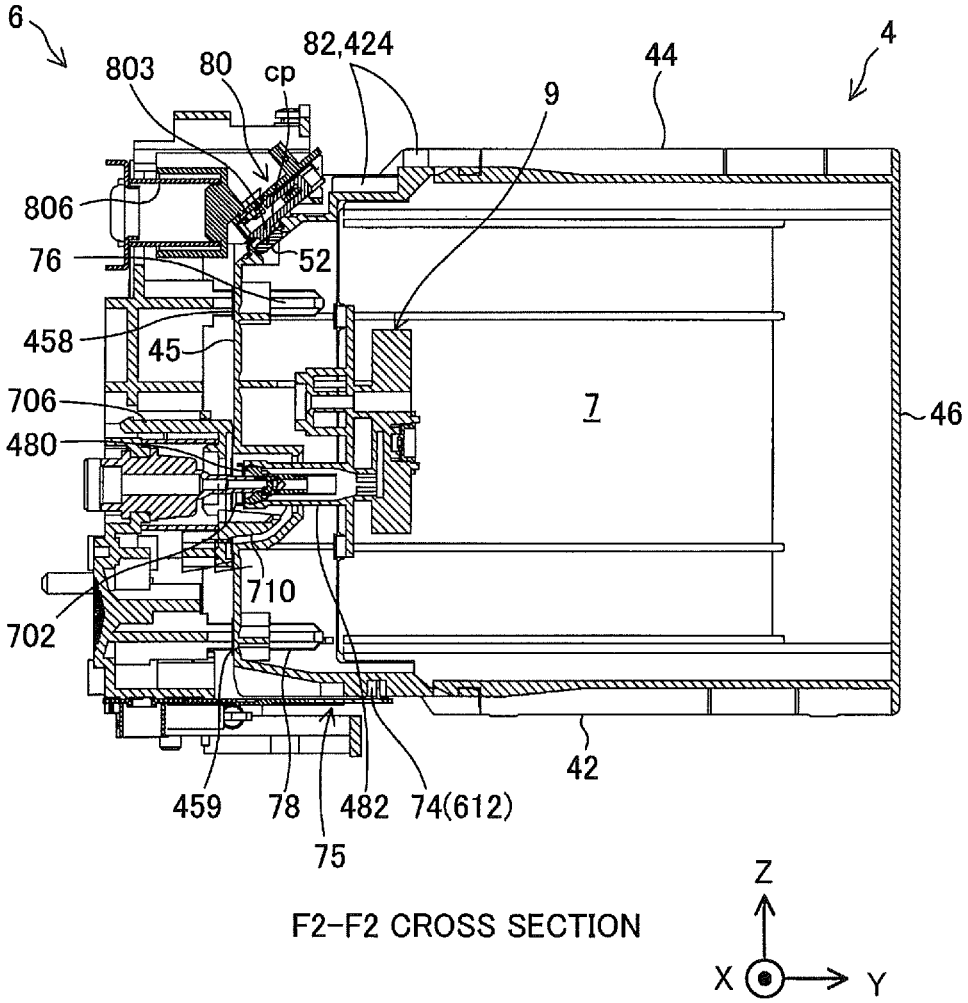
FIG. 24 is a third explanatory diagram.

The following describes the process of attachment of the cartridge 4 to the cartridge holder 6 with reference to FIGS. 22 to 24. FIG. 22 is a first explanatory diagram; FIG. 23 is a second explanatory diagram; and FIG. 24 is a third explanatory diagram. The operation of attachment of the cartridge 4 to the cartridge holder 6 proceeds in the sequence of FIG. 22, FIG. 23 and FIG. 24. FIG. 22 is the diagram at the time when insertion of the first positioning member 76 into the first member through hole 458 and insertion of the second positioning member 78 into the second member through hole 459 are started (called "first time"). FIG. 23 is the diagram at the time when the cartridge-side identification member 424 reaches the device-side identification member 82 (called "second time"). In other words, FIG. 23 is the diagram at the time when fitting between the cartridge-side identification member 424 and the device-side identification member 82 is started. FIG. 24 is the diagram at the time when the cartridge 4 is attached to the cartridge holder 6 (called "third time"). FIG. 24 is accordingly the F2-F2 cross sectional view in the state of attachment.

As shown in FIG. 22, at the first time, fitting between the device-side identification member 82 and the cartridge-side identification member 424 has not yet been started. At the first time, the cover member 706 is not in contact with but is separated from the cartridge 4. At the first time, the printing material supplier 482 and the flow tube 702 are away from each other in the Y-axis direction by a distance DA. At the first time, the cartridge-side identification member 424 and the device-side identification member 82 are away from each other in the Y-axis direction by a distance DB. At the first time, the printing material supply system 1 has the relationship of the distance DA>the distance DB. At the first time, the supply port 480 is located on the upper side (immediately above, on the fourth surface 44-side, +Z-axis direction side) of the printing material receiver 710. In other words, the supply port 480 and the third surface 42 have the positional relationship across the printing material receiver 710 in the Z-axis direction. The first time is the time prior to engagement of the device-side engagement structure 75 with the cartridge-side engagement structure 420. At the first time, the projection 74 of the device-side engagement structure 75 is located in the receiver portion 601.

As shown in FIG. 23, at the second time, the first surface 45 of the cartridge 4 is in abutment with the cover member 706, so as to apply a force in the −Y-axis direction (direction of attachment) to the cover member 706. The cover member 706 accordingly moves in the −Y-axis direction against the pressing force of the pressing member 712. The flow tube 702 is inserted into the printing material supplier 482 during the period from the second time to the third time. More specifically, the flow tube 702 is inserted into the printing material supplier 482, before the device-side terminals 803 come into contact with the contact portions cp of the circuit board 52.

As shown in FIG. 24, at the third time, the device-side terminals 803 are in contact with the contact portions cp of the circuit board 52. A the third time, the flow tube 702 is inserted into the printing material supplier 482 to allow for the ink flow from the printing material supplier 482 into the flow tube 702. More specifically, after insertion of the flow tube 702 into the printing material supplier 482, the device-side terminals 803 come into contact with the contact portions cp of the circuit board 52. At the third time, the projection 74 of the device-side engagement structure 75 engages with the engagement portion 612 of the cartridge-side engagement structure 420. The engagement portion 612 is a portion to be engaged with the device-side engagement structure 75.

As described above, the respective components of the printing material supply system 1 have the following relationships in the process of attachment of the cartridge 4 to the cartridge holder 6. After insertion of the pair of positioning members 76 and 78 into the pair of member through holes 458 and 459 is started, fitting between the device-side identification member 82 and the cartridge-side identification member 424 is started. After fitting between the device-side identification member 82 and the cartridge-side identification member 424 is started, the flow tube 702 is inserted into the printing material supplier 482. After the insertion of the flow tube 702 into the printing material supplier 482 allows for the ink flow from the printing material supplier 482 to the flow tube 702, the device-side terminals 803 come into contact with the contact portions cp of the circuit board 52.

A-6. Advantageous Effects

Figure 25:
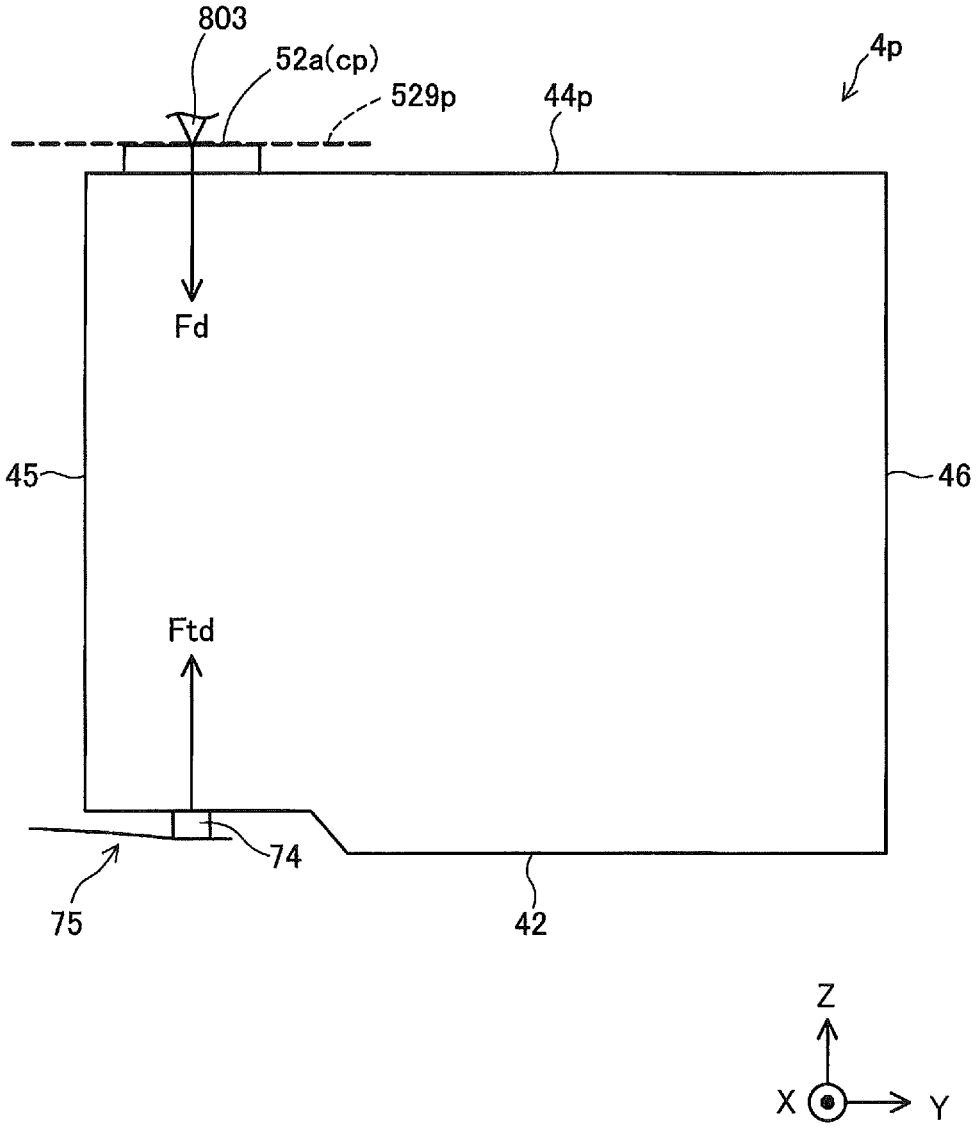
FIG. 25 is a first diagram illustrating the advantageous effects.
Figure 26:
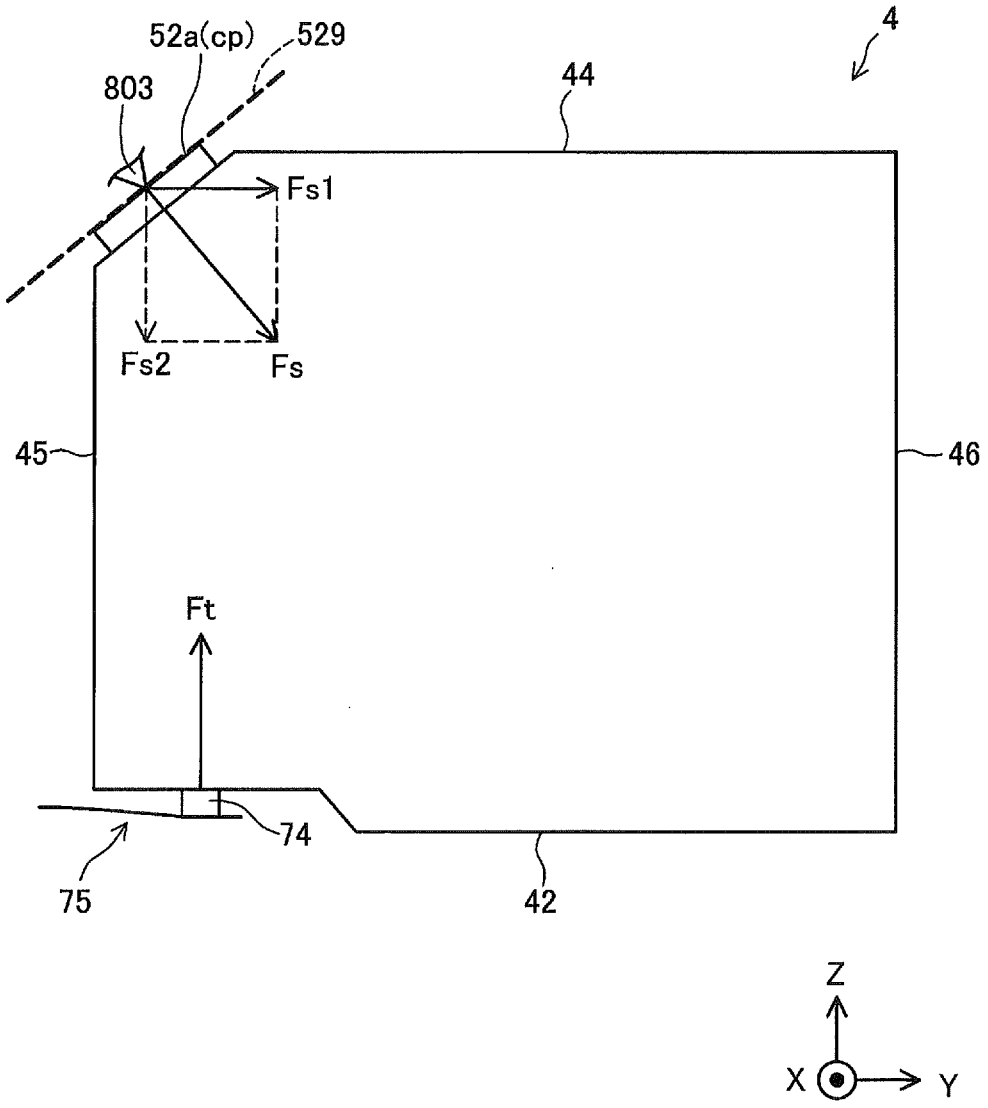
FIG. 26 is a second diagram illustrating the advantageous effects.

FIG. 25 is a first diagram illustrating the advantageous effects. FIG. 26 is a second diagram illustrating the advantageous effects. FIG. 25 shows an example of a cartridge 4*p* having a contact surface 529*p* which is not inclined to a fourth surface 44*p* but forms a horizontal plane. FIG. 25 schematically illustrates part of the forces applied from a cartridge holder to the cartridge 4*p* in the state of attachment of the cartridge 4*p*. FIG. 26 schematically illustrates part of the forces applied from the cartridge holder 6 to the cartridge 4 of the embodiment in the state of attachment. FIGS. 25 and 26 illustrate the forces having components in the clamping direction of the cartridge 4 or 4*p* along the Z-axis direction.

As shown in FIGS. 25 and 26, forces Fs and Fd applied from the device-side terminals 803 to the contact portions cp arranged on the surface 52*a* of the circuit board 52 are respectively set to have predetermined angles relative to the contact surfaces 529 and 529*p*. In FIGS. 25 and 26, the external forces Fs and Fd are both almost perpendicular to the contact surfaces 529 and 529*p*. The external forces Fs and Fd have the same magnitude. External forces Ft and Ftd are respectively applied from the projection 74 of the device-side engagement structure 75 to the third surface 42. The directions of the external forces Ft and Ftd are respectively almost vertically upward direction.

As shown in FIG. 25, the contact surface 529*p* is not inclined to the fourth surface 44*p*. In this case, the forces applied in the direction perpendicular to the direction of detachment and applied in the clamping direction of the cartridge 4*p* are the forces Fd and Ftd. The force Fd and the force Ftd have the same magnitude, so that the forces applied in the vertical direction of the cartridge 4*p* (Z-axis direction) are balanced.

As shown in FIG. 26, the contact surface 529 is inclined to the fourth surface 44 along the predefined direction. In this case, the force Fs is resolved into a force component Fs2 in the vertically downward direction and a force component Fs1 in the direction of detachment. The vertically downward direction is the direction from the fourth surface 44 to the third surface 42. The direction of detachment is the direction from the first surface 45 to the second surface 46. The force component Fs2 and the force Ft have the same magnitude, so that the forces applied in the vertical direction of the cartridge 4 (Z-axis direction) are balanced. Since Fs=Fd, the following relationships are satisfied: Fs2<Fd and Ft<Ftd.

As described above, according to this embodiment, the contact surface 529 is inclined to the fourth surface 44 along the predefined direction. Such inclination of the contact surface 529 reduces the force Fs2 in the clamping direction of the cartridge 4 (−Z-axis direction) out of the force Fs applied to the contact portions cp in the state of attachment, compared with the contact surface 529*p* without inclination. This enables the cartridge 4 to be readily detached from the cartridge holder 6. For example, when the cartridge-side engagement structure 420 is disengaged from the device-side engagement structure 75, the cartridge 4 is enabled to be smoothly moved in the direction of detachment by the pressing force produced by the pressing member 712 of the cover member 706 (FIG. 8). More specifically, the cartridge 4 is enabled to be moved in the direction of detachment to such an extent that the contact portions cp are sufficiently away from the device-side terminals 803 by the pressing force of the pressing member 712. This enables the user to detach the cartridge 4 from the cartridge holder 6.

Since the contact surface 529 is inclined to the fourth surface 44 along the predefined direction, the force Fs applied to the contact portions cp has the force component Fs1 in the direction of attachment. This enables the cartridge 4 to be more readily detached from the cartridge holder 6. For example, in the state immediately after disengagement of the cartridge-side engagement structure 420 from the device-side engagement structure 75, the pressing force Fp of the pressing member 712 (FIG. 3) and the force component Fs1 are applied in the direction of detachment of the cartridge 4. This increases the force applied in the direction of detachment and enables the cartridge 4 to be more smoothly moved in the direction of detachment.

The force Ft balances with the force component Fs2 and is thereby made smaller corresponding to the smaller force component Fs2. This reduces the force Ft applied in almost vertically upward direction from the device-side engagement structure 75 to the cartridge 4.

According to the above embodiment, the engagement portion 612 of the cartridge 4 is located at the position passing through the first terminal 537 and passing through the plane C1 perpendicular to the width direction (FIG. 19). Engagement of the engagement portion 612 with the projection 74 restricts the move of the cartridge 4 in the direction of detachment (+Y-axis direction). More specifically, the engagement portion 612 serves to position the cartridge 4 relative to the cartridge holder 6 to some extent. Locating the engagement portion 612 at the position passing through the plane C1 enables the plurality of terminals 535 to 539 forming the first terminal row R1 to be positioned relative to the cartridge holder 6 with high accuracy. The plurality of terminals 531 to 534 forming the second terminal row R2 has a certain positional relationship to the plurality of terminals 535 to 539 forming the first terminal row R1. This accordingly enables all the terminals 531 to 539 of the cartridge 4 to be positioned to the cartridge holder 6 with high accuracy. This reduces the likelihood of contact failure (poor electrical continuity) between the cartridge-side terminal group 500 and the device-side terminal group 802.

In the state of attachment, the unbalance of the external force in the clamping direction of the cartridge 4 may cause the cartridge 4 to be tilted or rotated from the correct attitude of attachment. The tilt or rotation of the cartridge 4 from the correct attitude of attachment may make it difficult to detach the cartridge 4 from the cartridge holder 6. The tilt or rotation of the cartridge 4 from the correct attitude of attachment may also cause a contact failure between the contact portions cp and the printing device 10 (more specifically, device-side terminals 803). According to this embodiment, since the engagement portion 612 is located at the position passing through the plane C1, the cartridge 4 is clamped by the engagement portion 612 and the first terminal 537 on the plane C1. More specifically, in the state of attachment, the cartridge 4 is clamped by the force applied to the engagement portion 612 by the projection 74 and the force applied to the first terminal 537 by the device-side terminal 803. This suppresses the cartridge 4 from being tilted or rotated from the correct attitude of attachment. This accordingly enables the cartridge 4 to be readily detached from the cartridge holder 6 and reduces the likelihood of a contact failure between the contact portions cp and the device-side terminals 803.

According to the above embodiment, the first contact portion 537*cp* of the first terminal 537 is located at the position passing through the plane C1 (FIG. 12). The first contact portion 537*cp* is a portion where the cartridge-side terminal group 500 is actually in contact with the device-side terminal group 802. The first contact portion 537*cp* is located at the center of the width Wa of the plurality of contact portions cpa arrayed along the width direction of the cartridge 4 (X-axis direction) (FIG. 12). The arrangement of the first contact portion 537*cp* passing through the plane C1 enables the plurality of terminals 535 to 539 forming the first terminal row R1 to be positioned relative to the cartridge holder 6 with the higher accuracy. This accordingly enables all the terminals 531 to 539 of the cartridge 4 to be positioned relative to the cartridge holder 6 with the higher accuracy. This further reduces the likelihood of a contact failure between the cartridge-side terminal group 500 and the device-side terminal group 802.

Insertion of the flow tube 702 into the printing material supplier 82 also serves to position the cartridge 4 relative to the cartridge holder 6. According to the above embodiment, the supply port 480 of the cartridge 4 is located at the position passing through the plane C1 (FIG. 14). This arrangement of the above embodiment enables the plurality of terminals 535 to 539 forming the first terminal row R1 to be positioned relative to the cartridge holder 6 with the higher accuracy. In other words, this enables all the terminals 531 to 539 of the cartridge 4 to be positioned relative to the cartridge holder 6 with the higher accuracy. This further reduces the likelihood of a contact failure between the cartridge-side terminal group 500 and the device-side terminal group 802.

The supply port 480 serves to position the cartridge 4 to the printing device 10 with the high accuracy and thereby enables the engagement portion 612 and the first terminal 537 passing through the plane C1 to be arranged at the designed positions with high accuracy in the state of attachment. This enables the cartridge 4 to be stably clamped using the engagement portion 612 and the first terminal 537. Suppression of the rotation or tilt of the cartridge 4 facilitates detachment of the cartridge 4 from the printing device 10.

According to the above embodiment, the supply port 480 is located closer to the third face 42 rather than to the fourth face 44 (FIG. 14). This locates the supply port 480 at a distance from the contact portions cp arranged on the corner section 50 where the first surface 45 intersects the fourth surface 44 and thereby reduces the likelihood that the contact portions cp are stained with ink even in the event of leakage of ink from the supply port 480. This accordingly ensures the good contact between the contact portions cp and the printing device 10 (more specifically, the device-side terminal group 802).

According to the above embodiment, the cartridge-side engagement structure 420 is formed on the other-end-side face 423 of the third surface 42 (FIG. 16). The other-end-side face 423 is located at the position closer to the fourth surface 44 than the one-end-side face 426. In other words, the other-end-side face 423 is located on the vertically upper side (+Z-axis direction side) of the one-end-side face 426. This arrangement reduces the first surface 45-side dimension of the cartridge 4 in the direction in which the third surface 42 and the fourth surface 44 are opposed to each other (Z-axis direction). The printing material container 7 of the cartridge 4 is located closer to the second surface 46-side of the container main body 450 than the first surface 45-side (FIG. 16). The second surface 46-side of the container main body 450 is longer in the Z-axis direction than the first surface 45-side of the container main body 450. This arrangement provides the sufficient internal volume and thereby ensures the sufficient capacity of the printing material container 7. Reduction of the first surface 45-side dimension where the cartridge-side engagement structure 420 of the cartridge 4 is located ensures the sufficient space where the device-side engagement structure 75 of the cartridge holder 6 is located. This enhances the flexibility of design of the device-side engagement structure 75. For example, this reduces the likelihood that elastic deformation of the device-side engagement structure 75 in the direction RC (FIG. 8) is extremely limited. In another example, this ensures the sufficient space where the components of the device-side engagement structure 75 (lever member 73 and pressing member 79).

According to the above embodiment, the supply port 480 is located on the upper side of (immediately above) the printing material receiver 710 during the period from the time prior to engagement of the cartridge-side engagement structure 420 with the device-side engagement structure 75 (first time in FIG. 22) to the time of engagement (third time in FIG. 24). In other words, at the first time, the supply port 480 and the third surface 42 are arranged at the positional relationship across the printing material receiver 710. Even in the event of leakage of ink from the supply port 480 downward (to the third surface 42-side) in the course of attachment or detachment of the cartridge 4 to or from the cartridge holder 6, this positional relationship ensures the ink to be trapped by the printing material receiver 710. Trapping the ink reduces the likelihood of ink splash from the supply port 480 over a wide area.

According to the above embodiment, at the first time, the projection 74 of the device-side engagement structure 75 is located in the receiver portion 601 (FIG. 22). At the first time, the supply port 480 is located above the printing material receiver 710 (FIG. 22). More specifically, in the course of attachment of the cartridge 4 to the cartridge holder 6, the supply port 480 is located on the upper side of (immediately above) the printing material receiver 710, while the projection 74 of the device-side engagement structure 75 is located at the guide portion 606. Even in the event of leakage of ink from the supply port 480 downward (toward the third surface 42-side), this arrangement reduces the likelihood of ink splash from the supply port 480 over a wide area, at least while the projection 74 is located at the guide portion 606.

According to the above embodiment, the second container body 5*b* is removably attached to the first container body 5*a* (FIG. 20). The cartridge-side engagement structure 420 is formed on the first container body 5*a* which is located on the direction-of-attachment side (−Y-axis direction side) of the second container body 5*b*. There may be the state that the cartridge-side engagement structure 420 is not disengaged from the device-side engagement structure 75 by the operation of releasing the engagement of the cartridge-side engagement structure 420 with the device-side engagement structure 75 (state of failure). In this case, the user can readily check the state of engagement on the first container body 5*a*-side by simply detaching the second container body 5*b* from the first container body 5*a*. The user can thus readily check the reason for the state of failure. Identification of the reason for the state of failure improves the likelihood that the user eliminates the state of failure.

The printing material container 7 is mainly accommodated in the second container body 5*b*, so that the second container body 5*b*-side is heavier than the first container body 5*a*-side. In the state of attachment, the second container body 5*b*-side is likely to be affected by the gravity and tends to be tilted vertically downward by the gravity. The second container body 5*b* may also be rattled by an external force. According to the above embodiment, the cartridge-side engagement structure 420 and the contact portions cp are arranged on the first container body 5*a*-side of the container main body 450 (FIGS. 10, 12 and 20). The cartridge 4 is clamped by the force applied from the printing device 10 to the cartridge-side engagement structure 420 and the contact portions cp, so that the position of attachment of the first container body 5*a*-side is stabilized. Even when the second container body 5*b* is displaced by, for example, rattling, this reduces the likelihood that the first container body 5*a* where the cartridge-side engagement structure 420 is located is shifted from the designed position of attachment and thereby suppresses a contact failure between the contact portions cp and the printing device 10 (more specifically, the device-side terminals 803). According to the above embodiment, there is some play between the projections 55 and 56 and the second container body 5*b*. The presence of such play further reduces the likelihood that the first container body 5*a* is shifted from the designed position of attachment even when the second container body 5*b* is displaced by, for example, rattling. This further suppresses a contact failure between the contact portions cp and the printing device 10 (more specifically, the device-side terminals 803). The presence of the play also further suppresses the entire cartridge 4 from being tilted or rotated from the correct attitude of attachment.

According to the above embodiment, part of the cartridge-side engagement structure 420 including the engagement portion 612 is formed on the projection 55 (FIG. 20). The projection 55 is located on the direction-of-detachment side of the first container body 5*a*. The user can thus readily check the reason for the state of failure by simply detaching the second container body 5*b* from the first container body 5*a*. This further improves the likelihood that the user eliminates the state of failure.

The printing material container 7 is mainly accommodated in the second container body 5*b*, so that the second container body 5*b*-side is heavier than the first container body 5*a*-side. In the state of attachment, the second container body 5*b*-side is likely to be affected by the gravity and tends to be tilted vertically downward by the gravity. The second container body 5*b* may also be rattled by an external force. According to the embodiment, however, there is some play between the projections 55 and 56 and the second container body 5*b*. The presence of such play further reduces the likelihood that the first container body 5*a* is shifted from the designed position of attachment even when the second container body 5*b* is displaced by, for example, rattling. This further suppresses a contact failure between the contact portions cp and the printing device 10 (more specifically, the device-side terminals 803). The presence of the play also further suppresses the entire cartridge 4 from being tilted or rotated from the correct attitude of attachment. There is a need that at least one of the two projections 55 and 56 has such play.

According to the above embodiment, the respective components of the printing material supply system 1 have the following relationships during attachment of the cartridge 4 to the cartridge holder 6.

First Relationship

As shown in FIGS. 22 and 23, after insertion of the pair of positioning members 76 and 78 into the pair of member through holes 458 and 459 is started, fitting between the device-side identification member 82 and the cartridge-side identification member 424 is started (first relationship). Insertion of the pair of positioning members 76 and 78 into the pair of member through holes 458 and 459 limits the move of the cartridge 4 in the in-plane direction perpendicular to the direction of insertion of the cartridge 4. This causes the cartridge 4 to be positioned relative to the cartridge holder 6 in the direction perpendicular to the direction of insertion and thereby suppresses the positional misalignment of the cartridge-side identification member 424 relative to the device-side identification member 82. This reduces the likelihood that the cartridge-side identification member 424 hits against the device-side identification member 82 to interfere with their fitting in the case that a correct type of cartridge 4 is attached to the cartridge holder 6. In the case that a wrong type of cartridge 4 is intended to be attached to the cartridge holder 6, the cartridge-side identification member 424 effectively hits against the device-side identification member 82 to interfere with further insertion of the cartridge 4. This accordingly reduces the likelihood that any wrong type of cartridge 4 is set in each of the slots 61*a* to 61*d* of the cartridge holder 6.

Second Relationship

As shown in FIGS. 23 and 24, after fitting between the device-side identification member 82 and the cartridge-side identification member 424 starts, the flow tube 702 is inserted into the printing material supplier 482 (second relationship). This reduces the likelihood that ink is supplied from the cartridge 4 to the printing device 10 in the state that a wrong type of cartridge 4 is set in each of the slots 61*a* to 61*d* of the cartridge holder 6.

Third Relationship

As shown in FIGS. 23 and 24, after the ink flow from the printing material supplier 482 to the flow tube 702 is enabled by insertion of the flow tube 702 into the printing material supplier 482, the device-side terminals 803 come into contact with the contact portions cp of the circuit board 52. This prevents the printing device 10 from starting a printing operation in the state before the ink flow from the printing material supplier 482 to the flow tube 702 is enabled. This accordingly prevents an idling operation which is an operation of ejecting the air from the head 22.

According to the above embodiment, the abutting portions 457 provided on the first surface 45 are in abutment with the end face 703 of the cover member 706 (FIG. 23). The accuracy of the timing when the cartridge 4 is in abutment with the cover member 706 is improved by producing the abutting portions 457 with high accuracy instead of increasing the accuracy of production of the entire first surface 45.

B. Second Embodiment

B-1. Details of Printing Material Container 7*a*

Figure 27:
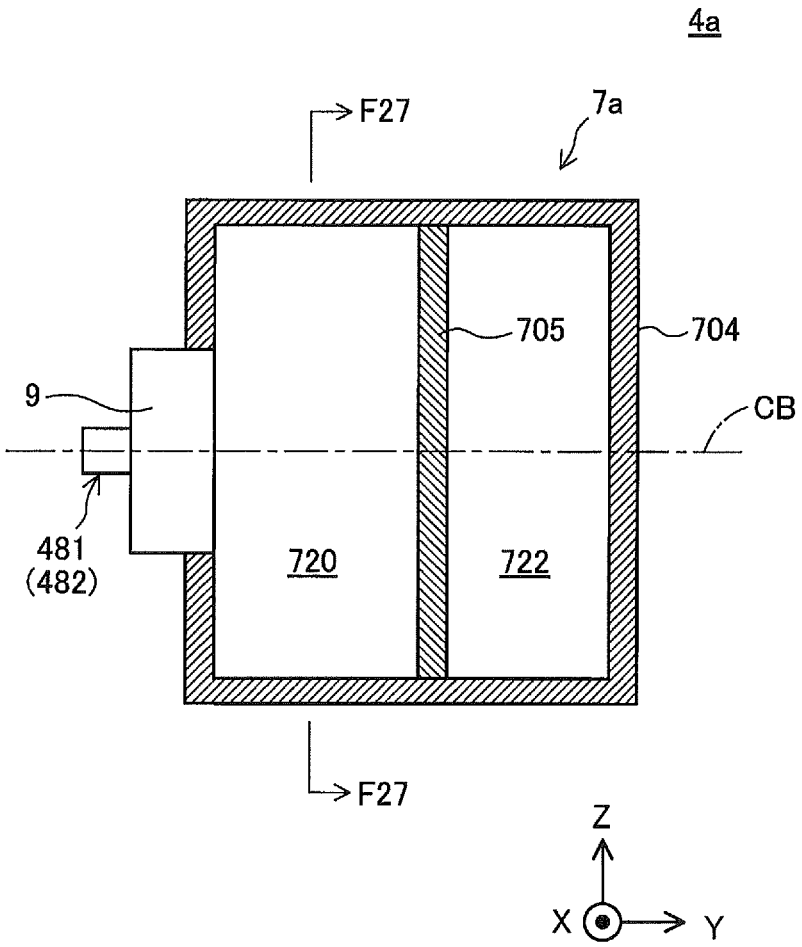
FIG. 27 is a diagram illustrating a printing material container according to a second embodiment.
Figure 28:
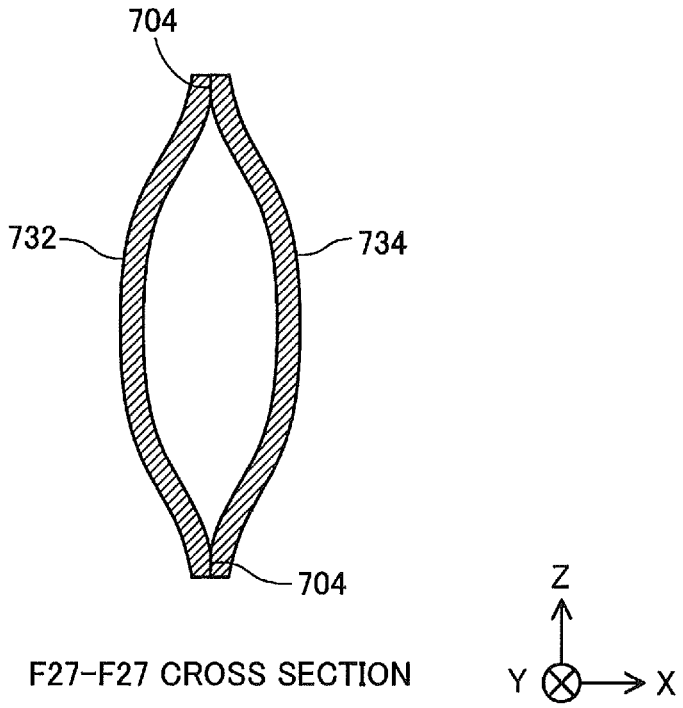
FIG. 28 is an F27-F27 cross sectional view of FIG. 27.

FIG. 27 is a first diagram illustrating a printing material container 7*a* according to a second embodiment. FIG. 28 is an F27-F27 cross sectional view of FIG. 27. FIG. 27 schematically illustrates the printing material container 7*a* cut by a plane parallel to the Y-axis direction and the Z-axis direction. In order to facilitate understanding, the flow unit 9 is also schematically illustrated. A cartridge 4*a* of the second embodiment differs from the cartridge 4 of the first embodiment by the structure of the printing material container 7*a*. Otherwise the structure of the cartridge 4*a* is identical with the structure of the cartridge 4 of the first embodiment. The like components are expressed by the like numerical symbols and are not specifically explained here. A printing device which the cartridge 4*a* of the second embodiment is attached to has the same structure as that of the printing device 10 of the first embodiment. The printing material container 7 of the first embodiment does not have a second sealing part 705 described below.

As shown in FIG. 28, the printing material container 7*a* is comprised of first and second sheet members 732 and 734 forming the outer shell. The first and the second sheet members 732 and 734 are made of an aluminum-laminated multilayer film formed by stacking an aluminum layer on a resin film layer. As shown in FIG. 27, the printing material container 7*a* has a first sealing part 704 and a second sealing part 705. As shown in FIG. 28, the first sealing part 704 is a portion where the outer peripheries of the two sheet members 732 and 734 are welded to each other. The second sealing part 705 is a portion where specified regions of the two sheet members 732 and 734 are inserted from both sides in the X-axis direction and are welded to each other. The second sealing part 705 is formed along a direction perpendicular to the center axis CB of the flow path-forming member 481. The inner space of the printing material container 7*a* is accordingly parted into a first chamber 720 and a second chamber 722. The first chamber 720 is filled with ink. The second chamber 722 is a closed space without being filled with ink. The first chamber 720 communicates with the printing material supplier 482.

The printing material container 7*a* may be produced, for example, by the following procedure. The procedure first welds the outer peripheries of the first and the second sheet members 732 and 734 to each other. During this welding process, the flow unit 9 is attached to respective one side faces of the first and the second sheet members 732 and 734. The procedure then inserts specified regions of the first and the second sheet members 732 and 734, which are away from the flow unit 9 in the +Y-axis direction, and welds the specified regions to each other, so as to form the second sealing part 705. The procedure subsequently uses the flow unit 9 to fill the first chamber 720 with ink.

According to the above second embodiment, the printing material container 7*a* has the first chamber 720 which is filled with ink and the second chamber 722 which is the closed space without being filled with ink. The amount of ink injected into the printing material container 7*a* may differ by the type of the cartridge 4*a* (ink color or type of printing device used). In such cases, plural different types of printing material containers 7*a* containing different amounts of inks are formed from the common first and second sheet members 732 and 734 by simply changing the position of the second sealing part 705. This reduces the manufacturing cost of the cartridge 4*a*. Inks is injected into the first chamber 720 after formation of the second sealing part 705, so that so ink is injected into the second sealing part 705. This reduces the amount of ink that is not used for printing (remaining amount of ink).

In general, ink adheres to the inner surfaces of the first and the second sheet members 732 and 734. The adhering ink is not used for printing but remains in the printing material container 7*a*. When a small amount of ink is injected into the printing material container 7*a* without formation of the second sealing part 705, there is a high ratio of the amount of ink adhering to the inner surfaces of the first and the second sheet members 732 and 734 to the injected amount of ink. In other words, this increases the ratio of the amount of ink not used for printing. Formation of the second sealing part 705 in the printing material container 7*a*, on the other hand, reduces the contact area of the first and the second sheet members 732 and 734 that are exposed to ink. This reduces the ratio of the amount of ink adhering to the inner surfaces of the first and the second sheet members 732 and 734 to the injected amount of ink.

B-2. Modification of Second Embodiment

Figure 29:
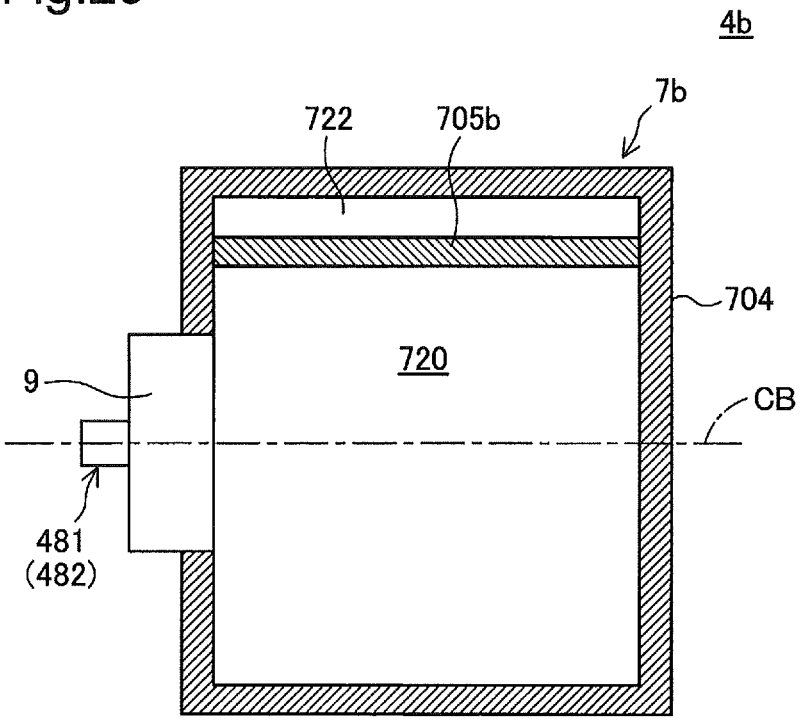
FIG. 29 is a diagram illustrating a modification of the second embodiment.

FIG. 29 is a diagram illustrating a modification of the second embodiment. A printing material container 7*b* of a cartridge 4*b* shown in FIG. 29 differs from the printing material container 7*a* of the second embodiment by the position where a second sealing part 705*b* is formed. Otherwise the structure of the cartridge 4*b* is identical with the structure of the cartridge 4*a* of the second embodiment. The like components are expressed by the like numerical symbols and are not specifically explained here. As shown in FIG. 29, the second sealing member 705*b* may be formed along the center axis CB. This arrangement has the similar advantageous effects to those of the second embodiment: for example, this reduces the production cost of the cartridge 4*b*. The second sealing part 705*b* may alternatively be formed along a direction inclined to the center axis CB.

C. Modifications

The invention is not limited to the above aspects or embodiments but may be implemented by various other aspects without departing from the scope of the invention. Some of possible modifications are given below.

C-1. Modifications with Regard to Contact Surface of Cartridge

Figure 30:
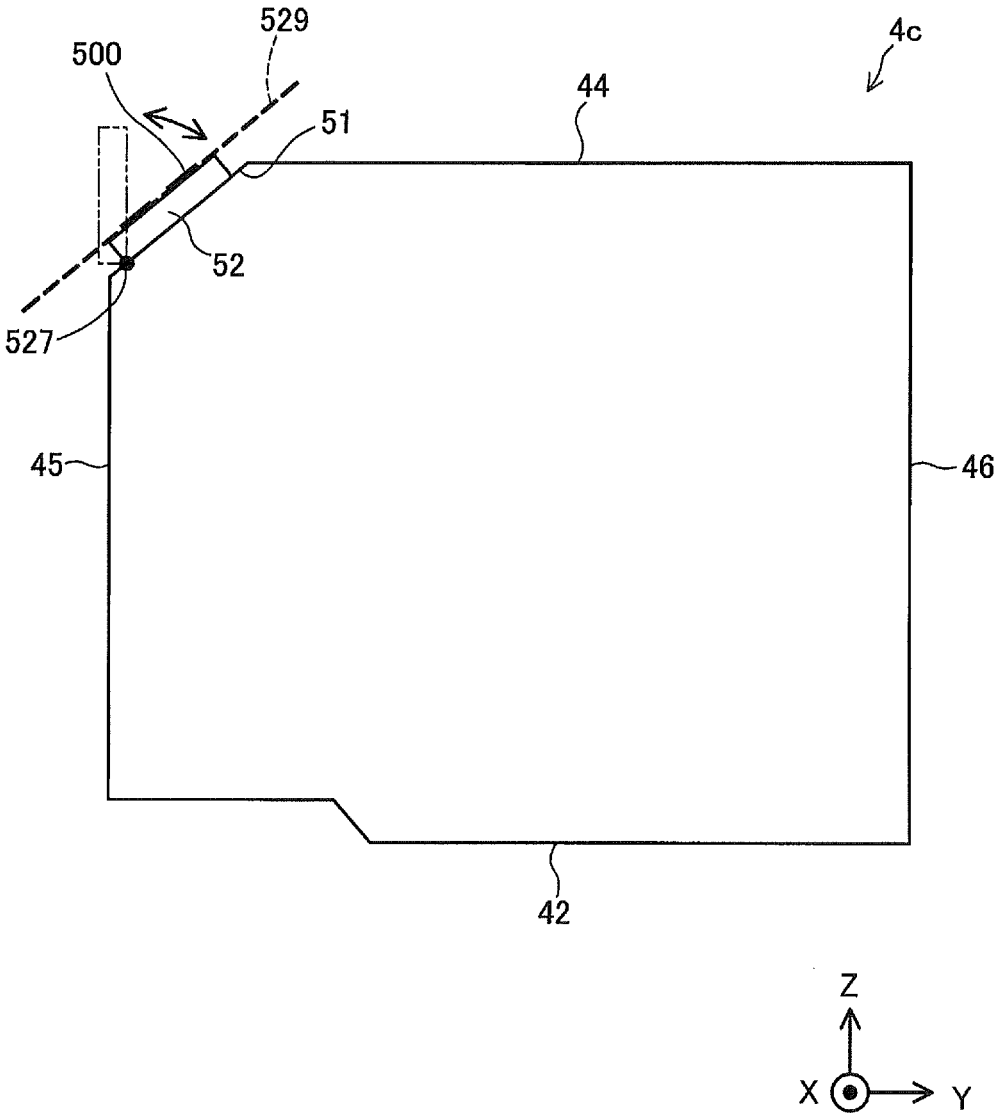
FIG. 30 is a diagram conceptually illustrating a modification with respect to a contact surface of the cartridge.
Figure 31A:
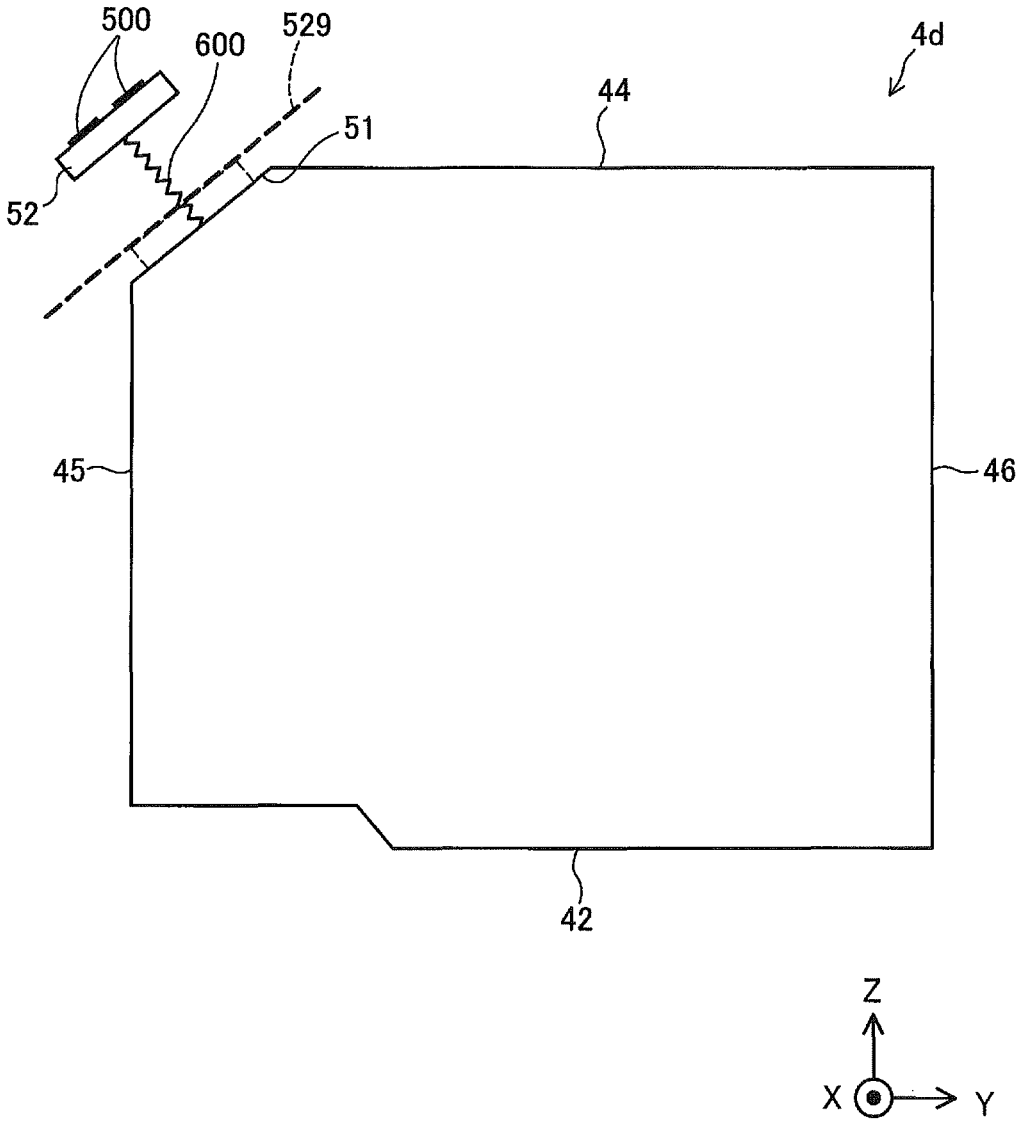
FIG. 31A is a diagram conceptually illustrating another modification with respect to the contact surface of the cartridge.

FIGS. 30 and 31A conceptually illustrate modifications with regard to the contact surface of the cartridge. Cartridges 4*c* and 4*d* respectively shown in FIGS. 30 and 31A differ from the cartridge 4 of the first embodiment by the mounting structure of the circuit board 52. Otherwise the structure of the cartridge and the structure of the printing device 10 are identical with those of the first embodiment. Like components to those of the first embodiment are expressed by like numerical symbols and are not specifically described here.

The cartridge 4*c* shown in FIG. 30 has the circuit board 52 of movable structure. More specifically, a mounting portion 527 is provided on one side face of the circuit board 52 to mount the circuit board 52 on the slope surface 51. The circuit board 52 is movable about the mounting portion 527 as the axis of rotation. In the state of attachment of the cartridge 4*c*, the contact surface 529 is formed, like the first embodiment.

The cartridge 4*d* shown in FIG. 31A has the circuit board 52 mounted on the slope surface 51 by means of a spring 600. In the state of attachment of the cartridge 4*d*, the contact surface 529 is formed, like the first embodiment.

In the description hereof, the term "plane" is used in a sense including both a virtual plane (non-real plane) and a real plane. Accordingly, the contact surface 529 defined by three or more contact portions including the contact portions cpa forming the first terminal row R1 and the contact portions cpb forming the second terminal row R2 includes both a virtual plane inclined in a predefined direction and a real plane inclined in the predefined direction.

Figure 31B:
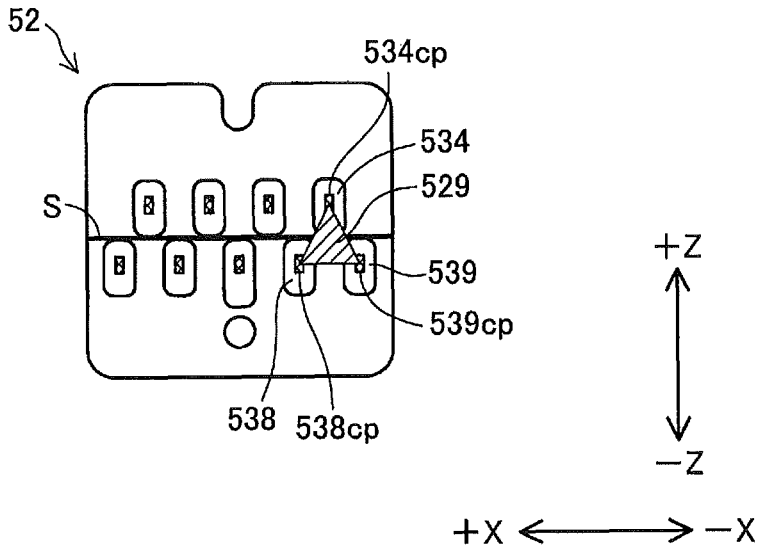
FIG. 31B is a diagram illustrating one example of a virtual contact surface.
Figure 31C:
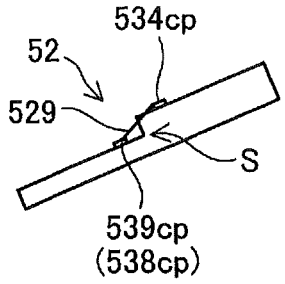
FIG. 31C is a diagram of FIG. 31B viewed from the −X-axis direction.

FIG. 31B is a diagram illustrating one example of the virtual contact surface 529 inclined in the predefined direction. FIG. 31C is a diagram viewed from the −X-axis direction. FIG. 31B illustrates one example of the circuit board 52 having a step S between the first terminal row R1 and the second terminal row R2. In this illustrated example, a virtual contact surface 529 is defined by connecting a contact portion 534*cp* of a terminal 534 included in a first terminal row R1 with contact portions 538*cp* and 539*cp* of terminals 538 and 539 included in a second terminal row R2. As shown in FIG. 31C, the virtual contact surface 529 defined by the respective contact portions 534*cp*, 538*cp* and 539*cp* is inclined in the predefined direction.

Figure 31D:
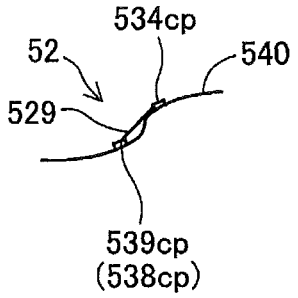
FIG. 31D is a diagram illustrating another example of the virtual contact surface.

FIG. 31D is a diagram illustrating another example of the virtual contact surface 529 inclined in the predefined direction. The circuit board 52 shown in FIG. 31D is made of a bendable (flexible) film. Since the circuit board 52 is bendable, a virtual contact surface 529 is inclined in the predefined direction without formation of the step S shown in FIGS. 31B and 31C.

As described above, the inclined surface formed by the contact portions cp (including both the virtual contact surface 529 and the real contact surface 529) needs to be inclined to the fourth surface 44 in the predefined direction in at least the state of attachment. In any structure other than those described above, inclination of the virtual or real contact surface 529 enables the cartridge 4 to be more readily detached from the cartridge holder 6.

C-2. Modifications with Regard to Shape of Cartridge

Figure 32:
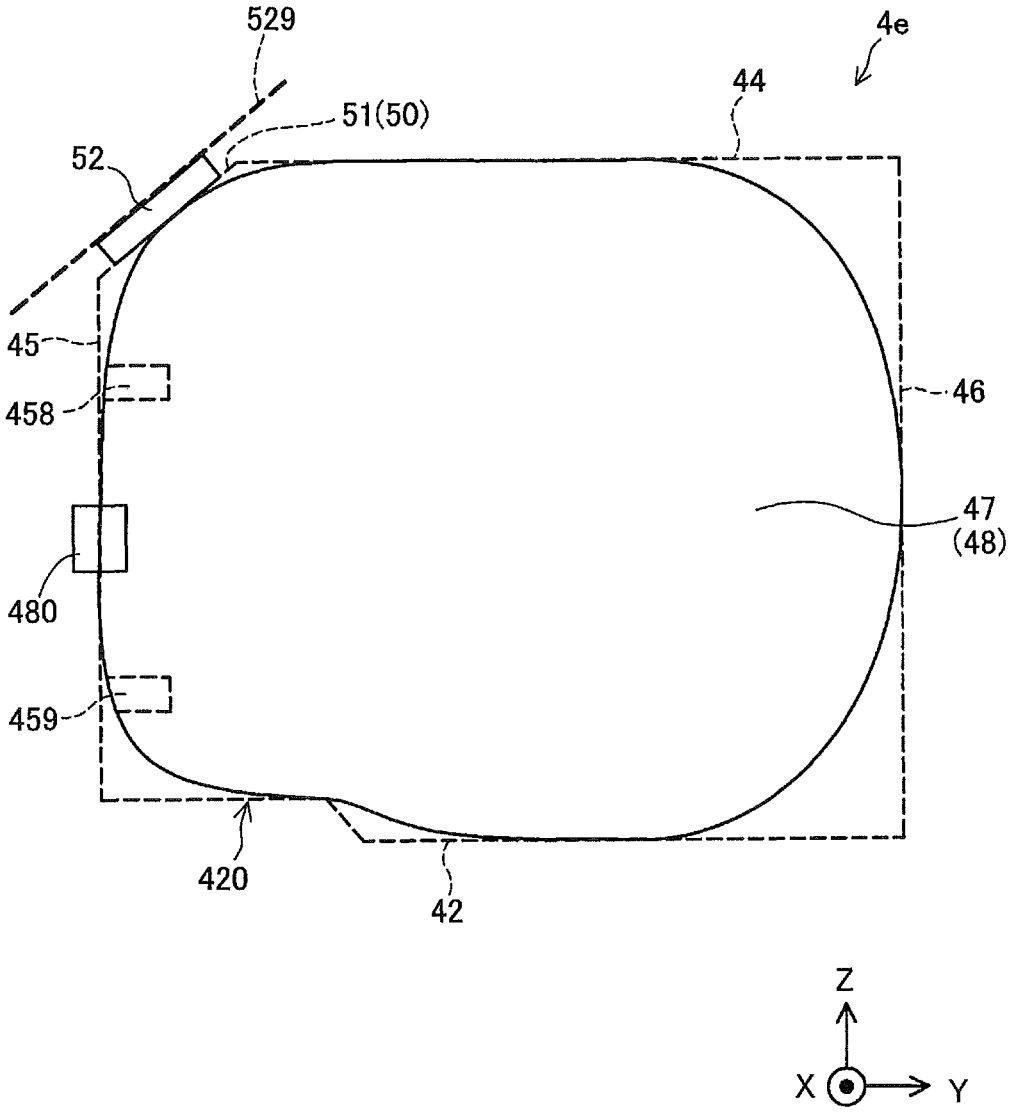
FIG. 32 is a diagram conceptually illustrating a modification with respect to the shape of the cartridge.
Figure 33:
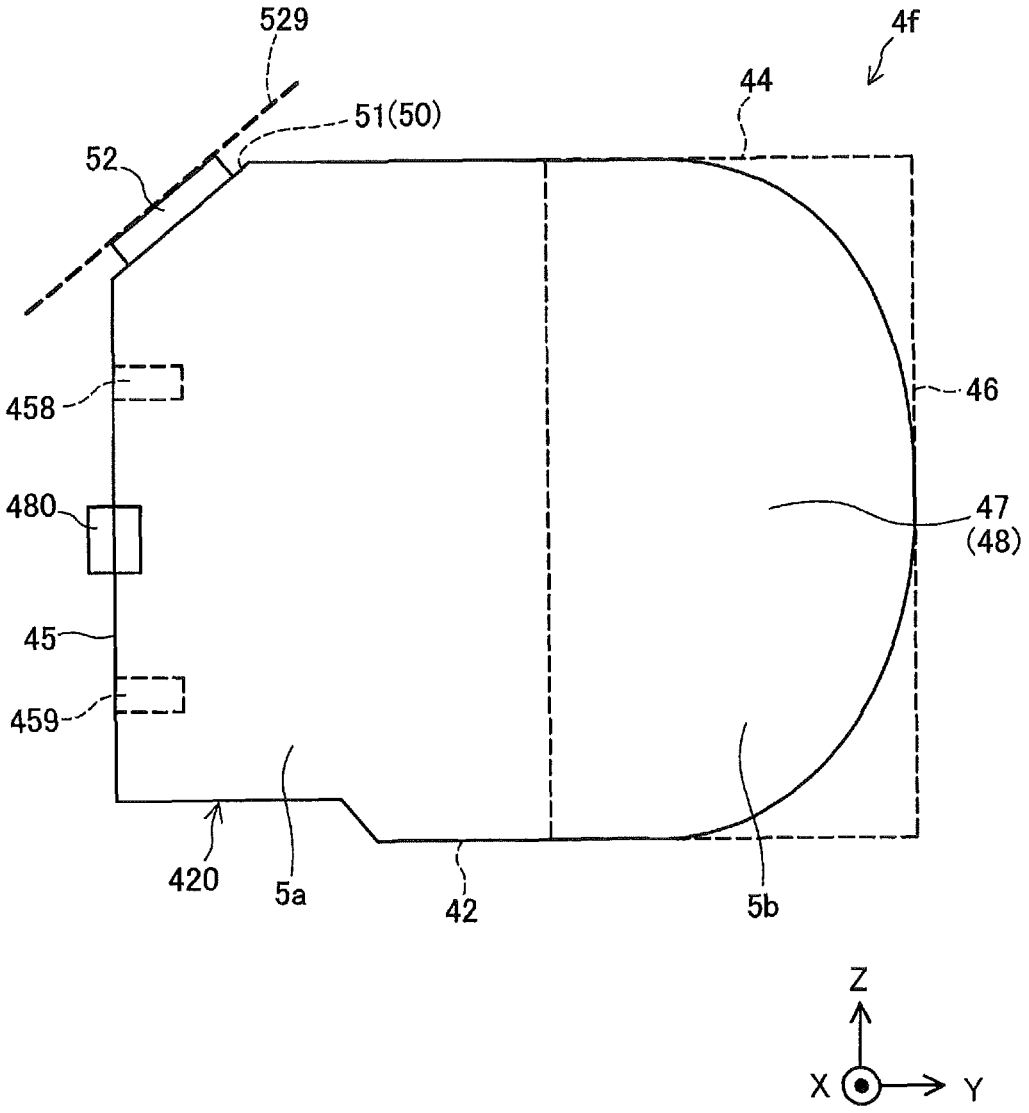
FIG. 33 is a diagram conceptually illustrating another modification with respect to the shape of the cartridge.

FIGS. 32 and 33 conceptually illustrate modifications with regard to the shape of the cartridge. Cartridges 4*e* and 4*f* shown in FIGS. 32 and 33 differ from the cartridge 4 of the first embodiment by the external shape of the cartridge. Otherwise the structure of the cartridge and the structure of the printing device 10 are identical with those of the first embodiment. Like components to those of the first embodiment are expressed by like numerical symbols and are not specifically described here.

The outer shell of the cartridge 4*e* shown in FIG. 32 has an almost elliptical or almost oval side face. The cartridge 4*e* has a supply port 480 and first and second member through holes 458 and 459 on the first surface 45-side, a cartridge-side engagement structure 420 on the third surface 42-side, and a circuit board 52 on the corner section 50. When viewed from the first surface 45-side, this cartridge 4*e* has a fixed width. This cartridge 4*e* provided with the components (for example, the cartridge-side engagement structure 420) corresponding to the respective components of the cartridge holder 6 (for example, the device-side engagement structure 75) is compatible with the cartridge 4 of the first embodiment.

In the cartridge 4*f* shown in FIG. 33, the first container body 5*a* of the members constituting the outer shell is identical with that of the first embodiment. This cartridge 4*f* includes a second container body 5*b* of the outer shell in a curved shape. The cartridge 4*f* has a supply port 480 and first and second member through holes 458 and 459 on the first surface 45-side, a cartridge-side engagement structure 420 on the third surface 42-side, and a circuit board 52 on the corner section 50. When viewed from the first surface 45-side, this cartridge 4*f* also has a fixed width. This cartridge 4*f* provided with the components (for example, the cartridge-side engagement structure 420) corresponding to the respective components of the cartridge holder 6 (for example, the device-side engagement structure 75) is also compatible with the cartridge 4 of the first embodiment.

The external shape of the cartridge may have various modifications as shown in FIGS. 32 and 33. Even when the cartridge has an external shape other than almost rectangular parallelepiped, six surfaces of the almost rectangular parallelepiped, i.e., the first surface 45, the second surface 46, the third surface 42, the fourth surface 44, the fifth surface 47 and the sixth surface 48, may be virtually assumed, for example, as shown by the dotted lines and the solid lines in FIG. 32 or FIG. 33. In the description hereof, the term "plane" is used in a sense including both such a virtual plane (non-real plane) and a real plane described in FIGS. 10 and 11. The term "plane" is also used in a sense including both a flat surface and a curved surface.

C-3. Modifications of Cartridge-Side Terminal Group

Figure 34:
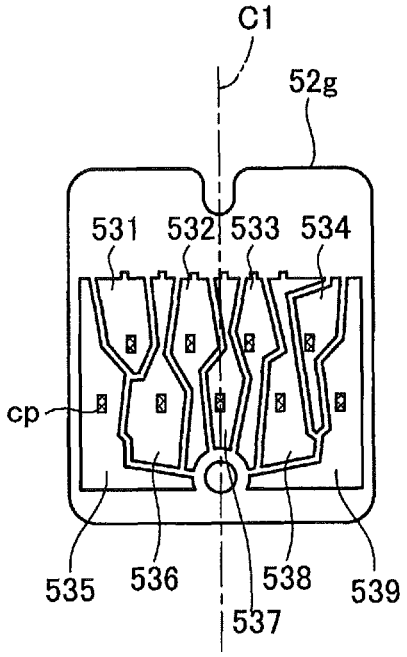
FIG. 34 is a diagram illustrating a modification with respect to the shape of the terminals on the circuit board.
Figure 35:
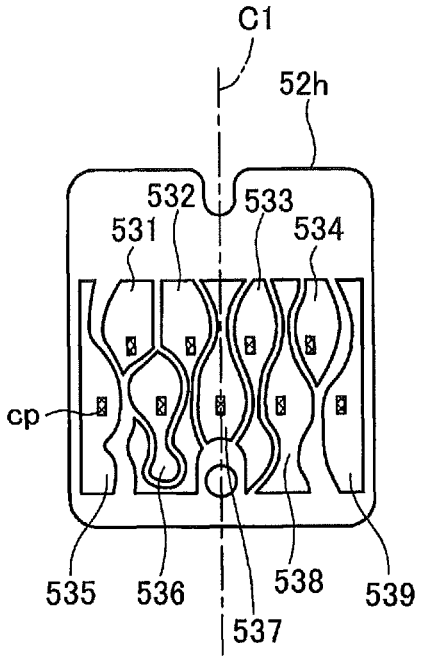
FIG. 35 is a diagram illustrating another modification with respect to the shape of the terminals on the circuit board.
Figure 36:
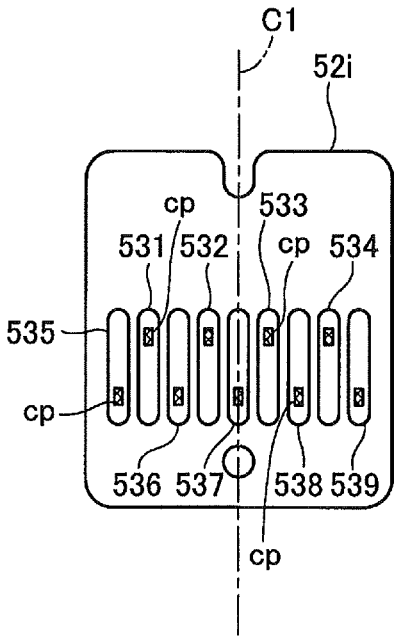
FIG. 36 is a diagram illustrating another modification with respect to the shape of the terminals on the circuit board.

FIGS. 34 to 36 are diagrams illustrating modifications with regard to the shape of the terminals on the circuit board. These circuit boards 52*g* to 52*i* differ from the circuit board 52 shown in FIG. 12 only by the surface shape of the cartridge-side terminals 431 to 539. In the circuit boards 52*g* and 52*h* of FIGS. 34 and 35, the individual terminals are not in almost rectangular shape but in irregular shape. In the circuit board 52*i* of FIG. 36, the nine terminals 531 to 529 are arranged in one array. In these circuit boards 52*g* to 52*i*, the arrangement of the contact portions cp of the respective terminals 531 to 539 to be in contact with the device-side terminals is similar to that in the circuit board 52 shown in FIG. 12. As described above, as long as the contact portions cp maintain the same arrangement, the surface shape of the individual terminals may be modified in various ways.

D. Other Modifications

D-1. First Modification

The printing material container 7 is provided as the bag member in the above embodiment, but this is not restrictive. The printing material container 7 may be in any form to contain ink. For example, the printing material container 7 may be formed by the first and second container bodies 5*a* and 5*b* constituting the outer shell of the cartridge 4.

D-2. Second Modification

Figure 37:
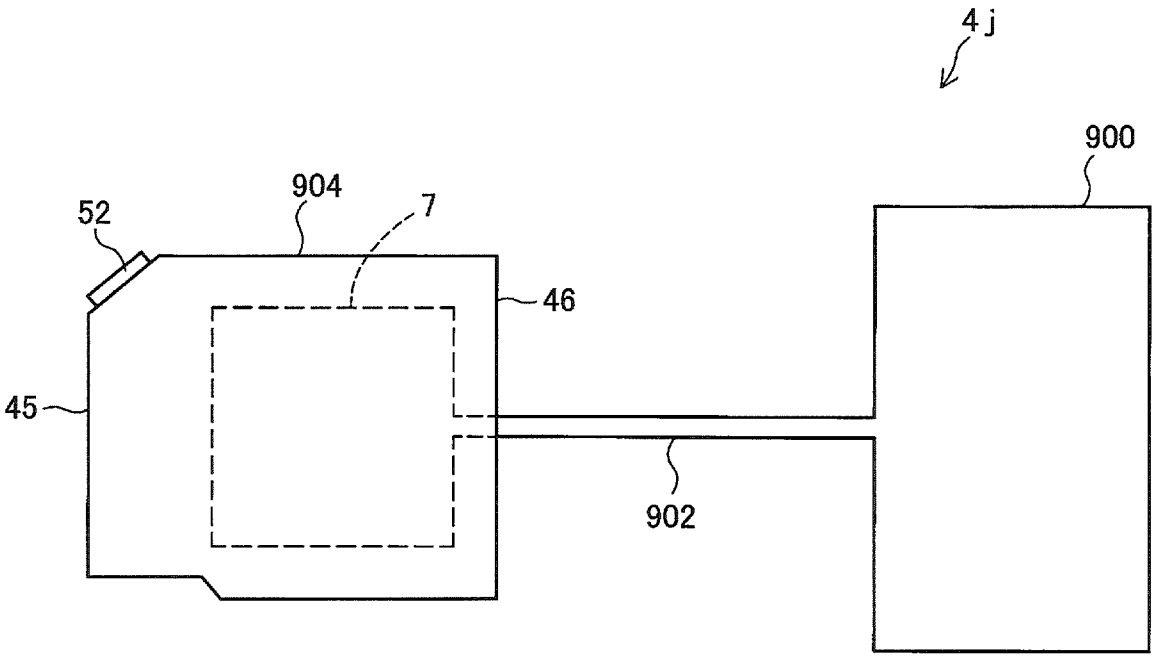
FIG. 37 is a diagram illustrating a second modification.

FIG. 37 is a diagram illustrating a second modification. A cartridge 4*j* shown in FIG. 37 includes a mounting member 904, a container member 900 and a connector member 902. The mounting member 904 has the same structure as that of the cartridge 4 of the first embodiment. The container member 900 is provided as a tank to contain ink therein. The connector member 902 is provided as a hose of connecting the container member 900 with the printing material container 7. The connector member 902 passes through the second surface 46 to be connected with the printing material container 7. The container member 900 is located, for example, outside of the printing device 10. When ink is consumed by the printing device 10, ink is refilled from the container member 900 into the printing material container 7. When ink in the container member 900 is used up, the user may replace the container member 900 or refill ink into the container member 900.

D-3. Third Modification

Figure 38:
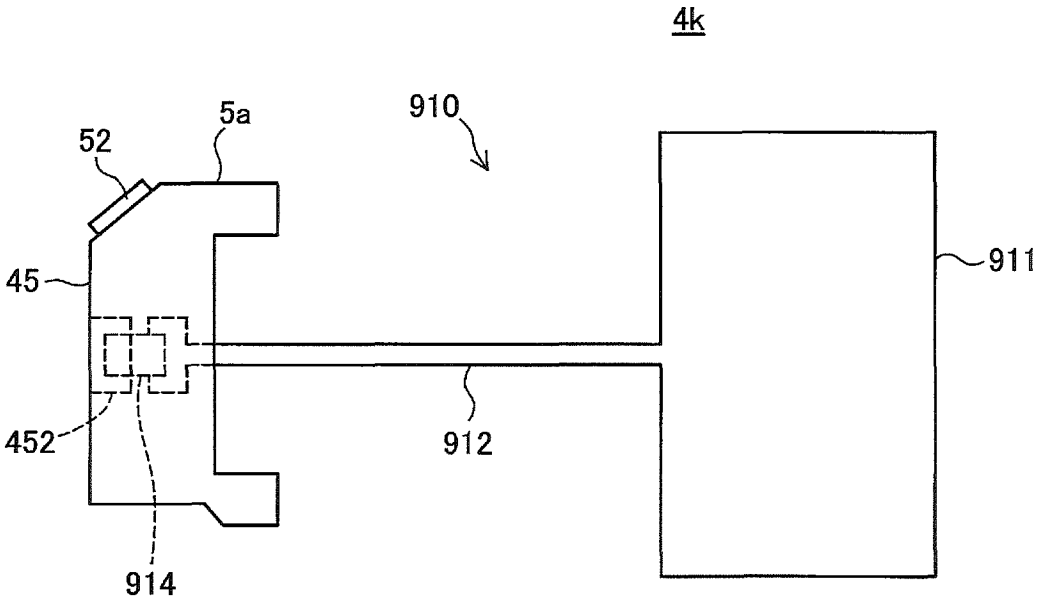
FIG. 38 is a diagram illustrating a third modification.

FIG. 38 is a diagram illustrating a third modification. A cartridge 4*k* shown in FIG. 38 includes a first container body 5*a* and a supply unit 910. The first container body 5*a* is identical with the first container body 5*a* of the first embodiment (FIG. 20). The first container 5*a* has components, such as a circuit board 52 (not shown) and a through hole 452, corresponding to the respective components of the cartridge holder 6 (for example, the device-side terminal group 802). The supply unit 910 has the printing material supplier 482 which the flow tube 702 is inserted in. The supply unit 910 includes a supply member 914 as a printing material supplier, a connector member 912 and a container member 911. The flow tube 702 is inserted into the supply member 914. The supply member 914 has the same structure as that of the flow path-forming member 481 of the first embodiment (FIG. 20). The container member 911 is provided as a tank to contain ink therein. The connector member 912 is provided as a hose of connecting the container member 911 with the supply member 914. The container member 911 is located, for example, outside of the printing device 10. When ink is consumed by the printing device 10, ink is directly supplied from the container member 911 through the supply member 914 to the printing device 10. When ink in the container member 911 is used up, the user may replace the container member 911 or refill ink into the container member 911.

D-4. Fourth Modification

The present invention is not limited to the inkjet printer or its ink cartridge but is also applicable to any printing device (fluid ejection device) that ejects a fluid other than ink and a cartridge (fluid container) used to contain the fluid. For example, the invention is applicable to a variety of fluid ejection devices and their fluid containers:

(1) image recording devices, such as a facsimile machine;

(2) color material ejection devices used to manufacture color filters for image display devices, e.g., liquid crystal display;

(3) electrode material ejection devices used to form electrodes of, for example, organic EL (electroluminescence) display and field emission display (FED);

(4) fluid ejection devices configured to eject a bioorganic material-containing fluid used for manufacturing biochips;

(5) sample ejection devices used as precision pipette;

(6) ejection devices of lubricating oil;

(7) ejection devices of resin solution;

(8) fluid ejection devices for pinpoint ejection of lubricating oil on precision machinery including watches and cameras;

(9) fluid ejection devices configured to eject transparent resin solution, such as ultraviolet curable resin solution, onto the substrate in order to manufacture a hemispherical microlens (optical lens) used for, for example, optical communication elements;

(10) fluid ejection devices configured to eject acidic or alkaline etching solution in order to etch the substrate; and

(11) fluid ejection devices equipped with fluid consumption head for ejecting a very small volume of droplets of another arbitrary fluid.

The "droplet" herein means the state of fluid ejected from the fluid ejection device and may be in a granular shape, a teardrop shape or a tapered threadlike shape. The "fluid" herein may be any material consumable by the fluid ejection device. The "fluid" may be any material in the liquid phase. For example, liquid-state materials of high viscosity or low viscosity, sols, gel water, various inorganic solvents and organic solvents, solutions, liquid resins and liquid metals (metal melts) are included in the "fluid". The "fluid" is not restricted to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiments and liquid crystal. The "ink" includes general water-based inks and oil-based inks, as well as various liquid compositions, such as gel inks and hot-melt inks.

The invention is not limited to the above embodiments, examples or modifications, but a diversity of variations and modifications may be made to the embodiments without departing from the scope of the invention. For example, the technical features of the embodiments, examples or modifications corresponding to the technical features of the respective aspects described in SUMMARY may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A cartridge configured to supply a printing material to a printing device and configured to mount to the printing device in a state of attachment, the cartridge comprising:

a printing material container adapted to contain the printing material;

a printing material supplier that supplies the printing material contained in the printing material container to the printing device when in the state of attachment;

a first surface, which is the leading surface when mounting the cartridge into the state of attachment, the first surface defining a substantially vertical plane when in the state of attachment and a second surface that is opposed to the first surface;

a third surface defining a horizontal plane, substantially perpendicular to the first surface, that intersects with the first surface and the second surface;

a fourth surface that is opposed to the third surface and positioned above the third surface when the cartridge is in the state of attachment;

a cartridge-side engagement structure that is provided on the third surface at a position closer to the first surface than to the second surface and is configured to be engaged with a device-side engagement structure of the printing device when in the state of attachment; and contact portions that are provided in an area where both an end of the first surface proximate to the fourth surface and an end of the fourth surface proximate to the first surface are located and are configured to be in contact with the printing device when in the state of attachment, wherein a contact surface defined by the contact portions is inclined to the fourth surface.

2. The cartridge according to claim 1, further comprising:

a fifth surface that intersects with the first surface, the second surface, the third surface and the fourth surface;

a sixth surface that is opposed to the fifth surface; and a plurality of terminals, each comprising one of the contact portions, wherein the contact portions are arranged to form at least one array in a width direction in which the fifth surface and the sixth surface are opposed to each other, the plurality of terminals include a first terminal having a first contact portion located at a center of the array, and an engagement portion which is a portion of the cartridge-side engagement structure to be engaged with the device-side engagement structure is located on a virtual plane, the virtual plane passing through the first terminal and being perpendicular to the width direction.

3. The cartridge according to claim 2, wherein the printing material supplier includes a supply port at one end, the supply port being located at the first surface at a position on the virtual plane.

4. The cartridge according to claim 2, wherein the first contact portion is located at a position on the virtual plane.

5. The cartridge according to claim 1, wherein the printing material supplier includes a supply port at one end, the supply port being located at a position closer to the third surface than the fourth surface.

6. The cartridge according to claim 1, wherein the third surface has: a one-end-side face that is connected with the second surface; and an other-end-side face that is connected with the first surface and is located at a position closer to the fourth surface than the one-end-side face, and the cartridge-side engagement structure is formed on the other-end-side face.

7. The cartridge according to claim 1, wherein the printing device comprises a flow tube and the printing material supplier is configured to connect to the flow tube; and the printing device also comprises a printing material receiver that traps the printing material, and the printing material supplier includes a supply port at one end, the supply port located above the printing material receiver in a state just prior to engagement of the cartridge-side engagement structure with the device-side engagement structure.

8. The cartridge according to claim 7, wherein the cartridge-side engagement structure comprises a groove structure formed on the third surface, and the cartridge-side engagement structure comprises:

a receiver portion that is extended from the first surface toward the second surface and is configured to receive the device-side engagement structure; and a guide portion that is connected with the receiver portion, is extended in a direction inclined to a direction of attachment of the cartridge in a course of attachment of the cartridge to the printing device and is configured to guide the device-side engagement structure to an engagement position where the device-side engagement structure is engaged with the cartridge-side engagement structure, wherein the guide portion is shorter than the printing material receiver in a direction in which the first surface and the second surface are opposed to each other.

9. The cartridge according to claim 1, wherein the printing device comprises: a flow tube that receives the printing material; and a printing material receiver that traps the printing material, and the printing material supplier includes a supply port at one end, the supply port and the third surface coming to a positional relationship where the printing material receiver is between the supply port and the third surface in a state just prior to engagement of the cartridge-side engagement structure with the device-side engagement structure.

10. The cartridge according to claim 1, further comprising:

a container main body that defines the first surface to the fourth surface and accommodates the printing material container inside thereof, wherein the container main body comprises:

a first container body that includes the first surface but does not include the second surface; and a second container body that includes the second surface but does not include the first surface and is configured to be detachable from the first container body, wherein the cartridge-side engagement structure is formed on the first container body.

11. The cartridge according to claim 10,
wherein the first container body has a projection protruding toward the second container body, wherein
at least part of the cartridge-side engagement structure is formed on the projection, and the projection and the second container body have play therebetween.

12. A printing material supply system, comprising:
the cartridge according to claim 1; and
a printing device that has a flow tube that is to be inserted into the printing material supplier, wherein
the printing device comprises:
a device-side engagement structure that is to be engaged with the cartridge-side engagement structure; and
a contact mechanism that is to be in contact with the contact portions.

* * * * *